US008459311B2

(12) United States Patent
Green

(10) Patent No.: US 8,459,311 B2
(45) Date of Patent: Jun. 11, 2013

(54) MULTI-VALVE DELIVERY SYSTEM

(76) Inventor: Ronald D. Green, Pataskala, OH (US)

( * ) Notice: Subject to any disclaimer, the term of this patent is extended or adjusted under 35 U.S.C. 154(b) by 1295 days.

(21) Appl. No.: 11/264,164

(22) Filed: Nov. 2, 2005

(65) Prior Publication Data

US 2006/0049205 A1 Mar. 9, 2006

Related U.S. Application Data

(63) Continuation-in-part of application No. 10/846,075, filed on May 14, 2004, now Pat. No. 7,036,685, which is a continuation-in-part of application No. 10/168,121, filed on Jun. 17, 2002, now Pat. No. 6,736,288.

(51) Int. Cl.
*B65B 31/00* (2006.01)
*B65B 3/04* (2006.01)
*B65D 35/22* (2006.01)

(52) U.S. Cl.
USPC ..... 141/3; 141/9; 141/20; 141/100; 141/392; 222/145.1; 222/402.16

(58) Field of Classification Search
USPC ..... 141/2, 3, 9, 20, 100, 234, 285, 312, 141/348, 392, 113, 237; 222/145.1, 402.16
See application file for complete search history.

(56) References Cited

U.S. PATENT DOCUMENTS

| | | | | |
|---|---|---|---|---|
| 3,992,003 | A * | 11/1976 | Visceglia et al. | 222/94 |
| 4,589,452 | A * | 5/1986 | Clanet | 141/3 |
| 5,012,951 | A * | 5/1991 | Miczka | 220/626 |
| 5,123,458 | A * | 6/1992 | Collard | 141/1 |
| 5,381,839 | A * | 1/1995 | Dowd | 141/242 |
| 5,586,588 | A * | 12/1996 | Knox | 141/237 |
| 6,640,842 | B1 * | 11/2003 | Laukenmann et al. | 141/2 |
| 6,684,915 | B1 * | 2/2004 | Ver Hage | 141/2 |
| 6,848,480 | B2 * | 2/2005 | Brennan | 141/2 |
| 6,874,544 | B2 * | 4/2005 | O'Connor et al. | 141/3 |
| 6,923,342 | B2 * | 8/2005 | Bourque et al. | 222/136 |
| 6,983,577 | B2 * | 1/2006 | Hartness et al. | 141/237 |

* cited by examiner

*Primary Examiner* — Gregory Huson
*Assistant Examiner* — Nicolas A Arnett
(74) *Attorney, Agent, or Firm* — Law Offices of Richard L Huff

(57) ABSTRACT

A storage and dispensing system for viscous fluids using a single aerosol container having a multi-valve body wherein the valves are activated by a single actuator and viscous materials are kept separate until used. The system may use multiple collapsible bags, a barrier liner, a dip tube, and an omnidirectional valve. Novel mounting cups lacking conventional central pedestal portions are disclosed. New domes for containers are disclosed which eliminate the need for mounting cups. New static mixing devices are disclosed. The devices are made up of static mixing components and static dispensing components. New filling machines for aerosol containers are disclosed. The filling machines contain a plurality of conduits for the separate viscous materials. Filling heads having nozzles depress the actuators of the containers and fill the containers.

6 Claims, 51 Drawing Sheets

MULTI-VALVE DELIVERY SYSTEM

CROSS-REFERENCE TO RELATED APPLICATIONS

This application is a continuation-in-part of my application Ser. No. 10/846,075, filed May 14, 2004 now U.S. Pat. No. 7,036,685, which is a continuation-in-part of Ser. No. 10/168,121, filed Jun. 17, 2002, now U.S. Pat. No. 6,736,288.

STATEMENT REGARDING FEDERALLY SPONSORED RESEARCH OR DEVELOPMENT (Not applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

This invention relates to systems for dispensing more than one viscous material from a pressurized aerosol container. The viscous materials are kept separate from each other during storage inside the container. Each viscous material is dispensed through a separate valve. In use, a single actuator activates each of the valves allowing the separate viscous materials to pass out of the container and to be mixed together in a static mixing device. Additionally, this invention relates to filling machines for aerosol containers using filling heads for multi-valve aerosol containers and aerosol containers having more than one valve. The invention also encompasses static mixing devices and mounting cups and domes for multi-valve containers.

2) Description of the Related Art

Many viscous products are made up of two or more viscous components which must be mixed, in given proportions, only at the time of application. Mixing of the components prior to the time of application will render many such products useless.

The prior art is aware of dispensing single viscous materials such as resins, sealing compounds, dental compositions, adhesives, paints, and the like from single aerosol containers. Also commonly known are methods of dispensing two viscous materials simultaneously from two separate tubes, cartridges, or aerosol containers. In these systems, two separate containers are necessary.

The prior art is also aware of dispensing two viscous materials contained in two separate aerosol containers shrink-wrapped together and equipped with a common valve actuator that is large enough to span both containers and dispense the two materials simultaneously into a common mixing tube. While this permits the administration of the desired ratios of viscous materials, the container is cumbersome and expensive.

Miczka, in U.S. Pat. No. 5,012,951, discloses a system for dispensing viscous materials from a pressurized container. The system comprises a container which is closed at the bottom by a dome-shaped bulkhead and at the top by a funnel, through which dispensing ports are fitted. Inner containers dispense their viscous contents by the internal pressure of the loaded propellant. A venting valve through the funnel controls the dispensing rate. The funnel is made from a thin outer skin, secured to the container by a crimped edge, with inner reinforcing walls to take up the pressure distortion. This device contains two separate dispensing valves with no mention of a mixing tube. The funnel is unique to the container of the above patented device, and is not standard equipment readily available in the art. The valves of this system are separated from each other. Thus, the use of a single actuator would be difficult. No actuator is mentioned by the patent.

The prior art is aware of aerosol containers which allow for the dispensing of two non-viscous materials so that a mixture of the two materials will be sprayed. Thus, U.S. Pat. No. 3,992,003 to Visceglia et al, issued Nov. 16, 1976, discloses an aerosol container holding an aerosol propellant and two collapsible bags holding materials which may be sprayed. This disclosure does not contemplate the dispensing of viscous materials and would be unsuitable for this purpose as adequate mixing would not be obtained.

Pressurized aerosol containers are well known in the art. A conventional container contains a single valve and a single outlet opening. Such containers may dispense a mixture of the product and the propellant or may have the product and the propellant in separate compartments within the container. In either case, activation of the actuator by the user causes the propellant to force the product out of the outlet opening. The filling and pressurizing of such a container involves a possibility of various steps. Conventionally, filling of a compartmentalized container is performed as follows: one collapsible compartment is placed inside the container and filled with the substance to be packaged and dispensed, the container is sealed by crimping either the valve or the flange carrying the valve, and a propellant medium is introduced into the other compartment in the container by means of a hole which is provided in the bottom of the container and sealed by an impermeable rubber stopper through which a hollow needle is passed in order to perform filling or pushing pressure against the rubber stopper into the can and then self sealing.

In some instances, the container is first charged with the propellant. Filling the pre-charged container with the aerosol product may be accomplished with an automatic system used in high volume applications, which meters a pre-selected amount of product into the container, or with a manual system. Regardless of which system is used, usually depending upon volume, the apparatus typically includes a container-holding means spaced below a reservoir for holding the liquid product. A valve which is mounted in the cup of the container is brought into engagement with a reservoir outlet, and liquid flows from the reservoir through the valve and a downwardly depending dip tube, and then into the container.

U.S. Pat. No. 3,995,666 to Michaels, issued Dec. 7, 1976, discloses a method of pressurizing an aerosol container containing a liquid product by providing a dispensing assembly loosely positioned on the rim of the top of the container, evacuating the air from the container, raising the dispensing assembly from the rim, introducing a propellant gas under pressure into the container, and attaching the dispensing assembly to the container. The dispensing assembly is attached at a distance above the rim of the top of the container which will cause the pressurizing gas to enter the container at a velocity sufficient to cause intense agitation of the liquid thereby substantially saturating the liquid with the propellant gas in a very short time.

U.S. Pat. No. 4,015,757 to Meuresch et al, issued Apr. 5, 1977, discloses a valve for a pressurized dispenser which dispenser includes a mounting cup, a valve housing, and an annular gasket clamped between the cup and the housing for sealing a discharge passage of a movable valve stem. A clearance space is provided in the cup around the outer marginal portion of the gasket to accommodate the marginal portion when the gasket is stretched during the filling of the dispenser to provide a flow path to the outside of the housing. Spacers are spaced apart around the periphery of the gasket to define the distance between the cup and the housing within which the gasket is clamped, and between which the stretched gasket extends. This arrangement provides for rapid charging of the container with the contents.

Stoody, in U.S. Pat. No. 4,383,399 issued May 17, 1983, discloses a method of filling and pressurizing an aerosol container. The method comprises introducing a dispensable fluid product into the container, projecting an expansible sac having an open end into the container through its fill-opening, overlapping the open end of the sac upon the fill-opening, introducing a pressurized fluid into the sac, disposing a valve mechanism into the container to overlie the sac's open end, closing the sac and fill-opening for sealing the dispensable fluid within the container and for sealing the pressurized fluid within the sac, closing the container, and extending a communicating means from the valve mechanism through the sac to establish communication between the valve mechanism and the fluid product for isolated passage of the fluid product through the valve mechanism.

U.S. Pat. No. 4,589,452 issued May 20, 1986 to Clanet discloses a method for filling an aerosol container provided with a valve and comprising two compartments separated by a flexible or mobile partition. The substance to be packaged is introduced into a first compartment, this compartment is closed, and a propellant fluid is introduced into the second compartment or produced therein. At the heart of the patented invention is the fact that most of the air in the first compartment is removed before introduction of the substance to be packaged. The substance to be packaged is introduced into the first compartment by means of a metering device without coming into contact with the atmosphere whereupon said first compartment is sealed.

In the method of pressurizing aerosol containers taught by U.S. Pat. No. 4,896,794 issued Jan. 30, 1990 to Banks et al, the method comprises the steps of: providing a pouch having a pressurization system for generating a gas to expand the pouch and produce a predetermined pressure therein, the pouch further having activation means for activating the pressurization system, the activation means being itself activated by the application of a partial vacuum to an outer side of the pouch; inserting the pouch into the container; closing the container; and generating at least a partial vacuum in the container to activate the activation means and expand the pouch under pressure from the gas.

In Pat. No. 5,377,724 issued to Ray on Jan. 3, 1995, an aerosol filling apparatus is disclosed. The apparatus comprises a cylinder having a lower aerosol container valve-engaging portion removably mounted to a part of the apparatus above an aerosol container receiving position, a piston mounted in the apparatus, and means to actuate the piston for movement within the cylinder to force liquid within the cylinder through a valve of an aerosol container mounted to the valve-engaging portion. The piston is mounted for movement from a position outside and above the cylinder. The cylinder has an upper open mouth having an inner surface opening outwardly to provide an upper extremity of greater diameter than that of the piston so as to provide a gradually decreasing entry for the piston into the cylinder and to guide the piston into the cylinder.

In the apparatus, the cylinder does not require a liner since the piston engages directly with the cylinder wall and the operator to fit the container and cylinder together and fill the cylinder. The combination of the cylinder and container is then slid into the apparatus and the piston is lowered into the cylinder by means of a powered activator means to force the liquid contents of the cylinder into the container.

U.S. Pat. No. 5,505,039 issued to Maier on Apr. 9, 1996 discloses a method for pressurizing an aerosol container. An aerosol container is formed by inserting a flexible liner into the container and holding the closure of the container away from the mouth so that the space between the liner and the container can be pressurized with a gas. The closure is then sealed to the container to close the space and maintain the pressure of gas around the liner which is evacuated to further collapse the liner, by applying suction to a valve on the closure communicating with the interior of the liner. The liner is then filled through the valve with the substance to further pressurize the gas in the surrounding space.

Humm et al. disclose in U.S. Pat. No. 5,645,113 issued Jul. 8, 1997, an aerosol container which has two valves. The first, top, valve is used for distributing the contents and the second, bottom, valve is used for filling the container both with liquid medium and also with pressurized gas. The liquid component is charged first and the pressurizing gas is introduced second. The filling valve independent of the container distributing valve can be adapted to the filling requirements, without simultaneously having to perform another function. Filling through a single valve permits rapid filling and a complication-free link with corresponding filling members.

The filling valve is located on the container bottom. It is appropriately constructed as a pressure valve, which is constructed by mounting the container on a filling connection of a filling device for the delivery of liquid medium and pressurized gas. The upper distributing valve is appropriately undetachably connected to the distributing container. The filling valve is centrally positioned on the container bottom.

Hirz, in U.S. Pat. No. 5,740,841 issued Apr. 21, 1998, discloses an aerosol container charging apparatus. In operating the invention, the container to be filled is loaded into the apparatus after being coupled with a pumping cylinder body by sliding the body and container horizontally into a receiving zone formed by a slot in a support plate that embraces the cylinder body and restricts it against axial movement. The container is supported with a surface that has a predetermined spacing from the cylinder body support plate that accommodates a particular size of container with adequate vertical clearance to ensure proper reception of the container into the apparatus. At the same time, the container support surface and cylinder body support plate assure that the container and cylinder body remain coupled during the pump operation when a piston is manually driven up and down in the pump cylinder.

In the method of filling aerosol containers disclosed by Fasse et al. in U.S. Pat. No. 5,832,965 issued Nov. 11, 1998, the filling apparatus for charging a pressurized aerosol container utilizes a male injector filling device depending from the liquid reservoir in conjunction with a female valve of the container. The filling system uses a support means for the aerosol container, including means for selectively positioning, or raising and lowering, the support means between a container non-filling position and a filling position; a liquid reservoir spaced above the support means; and means for selectively drawing liquid from the reservoir into the container when in a filling position. In accordance with the patent, the improvement utilizes a filling apparatus or filling injector comprising a substantially cylindrical housing, which extends from the reservoir, and has an open-ended, axial bore for liquid communication with the reservoir. Valve control means includes a valve housing disposed in the axial bore of the cylindrical housing, and the valve housing has a central opening in liquid communication with the axial bore.

A hollow injector pin extends longitudinally from the valve housing and is concentrically arranged with the opening of the valve housing, and the injector pin terminates with at least one aperture. Suitable means, such as a locking nut, retains the valve control means in the axial bore of the cylindrical housing. The valve control means is biased to a closed, no-filling position, and establishes liquid communication between the reservoir and the container when the container is in a filling position. The injector pin is adapted to be received by the female valve when the container is in a filling position. Thus, when the container is brought to a filling position, the valve control means is opened so that liquid will flow from the reservoir and through the axial bore of the cylindrical housing, the valve control means, the female valve of the container, the dip tube depending downwardly from the female valve, and into the container.

U.S. Pat. No. 6,283,171 issued to Blake on Sep. 4, 2001 discloses a method of filling an aerosol container which comprises: crimping, in a sealed relation, an aerosol valve to the pedestal portion of a mounting cup; clinching, in a sealed relation, the mounting cup to the bead of an aerosol container, thereby providing a hermetically sealed aerosol container when the aerosol valve is in the closed position; disposing on the valve stem an aerosol actuator which is larger than 15 mm in diameter and which has a means for sealing the actuator on the pedestal and which has propellant filling passages through it; advancing a propellant filling head toward the actuator and thereby sealing the filling head on an outside surface of the actuator and sealing the actuator against the pedestal portion of the mounting cup; and charging propellant through the filling head.

The method of filling an aerosol container with a liquid to be dispensed and a pressurizing gas taught by Runge et al. in U.S. Pat. No. 6,332,482 issued Dec. 25, 2001 involves presenting an open-topped aerosol container having a closed bottom and a piston; deforming the upper end of the cylinder inwardly and flanging the edge; filling the container below the piston with pressurized air through a needle above the container; attaching a mounting cup and valve; and filling the container above the piston with the liquid to be dispensed.

As can be seen, a need exists for improvement in simultaneous pressurized dispensing of multiple viscous materials from a single container. The object of the present invention is to provide improvements in this area. There is also a need for an improved filling of multi-valved containers. This invention addresses that problem. This invention also introduces mounting cups which eliminate a crimping step and, domes which are connected to the actuators, thus eliminating the need for mounting cups.

BRIEF SUMMARY OF THE INVENTION

The storage and dispensing system of the present invention fits the presently standard one-inch (2.54 cm) opening in the top of common aerosol containers or it may fit into containers in which a novel dome covers the entire top of the container. The multi-valve dispensing system of the present invention allows different viscous materials to be simultaneously dispensed in predetermined proportions. As the separate materials are ejected from the multi-valve container, they enter a standard mixing tube or a novel static mixing device of this invention for blending so that the final product is a mixed combination of the separate materials contained in the container. For the purposes of describing and claiming this invention, "viscous" will refer to that property which causes the material to exit the container as a flow rather than as a spray. Materials coming within this definition demonstrate viscosities of 1-1,000,000 centipoises (cp), preferably 10-500,000 cp, and more preferably 100-250,000 cp.

A key feature of the present invention is a multi-valve body. Each multi-valve body contains one or more inlet stems which permit the attachment of different devices for storage of different viscous materials. In one arrangement of the present system, one of the inlet stems permits dispensing of the material without the attachment of any devices. Another arrangement allows the viscous material to pass to the valve through a dip tube. In a further arrangement, the viscous material is contained in a collapsible bag having an outlet which is attached directly to the valve inlet.

The multi-valve components are incorporated into a single valve body. In the valve body are two or more standard spring-loaded valve plungers that, when depressed, open valve ports through which the pressurized viscous materials can flow from the container. The size of the inlet openings of the plunger are varied to obtain the desired rate of flow of the dispensed product. The spring-loaded plungers are depressed by manual pressure applied through the valve actuator that fits on top of the valve. The valve plungers can be of the standard male, female, or tilt type commonly used by the industry. Additionally, the present invention contemplates the use of the inventor's omnidirectional check valve which permits the flow of the viscous materials to the plungers regardless of the position of the container.

A wide variety of storage and delivery methods is possible in carrying out the present invention. Four possible combinations for storage and delivery of multiple pressurized viscous materials are described in detail in combination with the multi-valve of the present invention. These are:

1. A system using two or more collapsible bags;
2. A system using a barrier liner and one or more collapsible bags;
3. A system using a dip tube and one or more collapsible bags; and
4. A system using a dip tube in combination with one or more collapsible bags where an omnidirectional valve is attached to the dip tube.

One important feature of the present invention is a static mixing device which allows the dispensed fluids to be mixed outside of the aerosol container where they should be separated, but before they are applied to a surface where they should be combined.

In spite of the many diverse methods available to fill dispensing containers, the conventional method remains inserting an empty collapsible bag through a one-inch opening in the top of the container, which bag is attached to the mounting cup; crimping the mounting cup to the rim of the container surrounding the opening; charging the bag of the closed container with the substance to be dispensed; and then charging the container with an aerosol pressurizing agent. This overall process takes multiple steps.

One object of this invention is to present a filling machine which will fill the containers in such a way as to eliminate a number of steps used in the conventional filling process.

The conventional dispensing valve, crimped to a mounting cup having a sealing gasket, is normally mounted in a top opening of the container, which opening is defined by a component commonly referred to as the "bead" of the container opening. The mounting cup conventionally used includes a central pedestal portion for crimping the dispensing valve, a profile portion extending outwardly from the pedestal portion, which profile portion merges into an upwardly extending body portion, the body portion merging into a hemispherically shaped channel portion terminating in a skirt portion, which channel is configured to receive the bead portion of the container opening. The sealing gasket normally is disposed within the channel portion and in many gasket configurations extends downward along a part of the body portion.

This conventional arrangement has its strengths and weaknesses. One strength is that the mounting cups are uniform in size in order to fit into the standard one-inch aperture in the top of aerosol containers. Therefore large quantities of the same mounting cup may be produced and may be used interchangeably regardless of the contents of the container.

This strength becomes a weakness when multiple valves are desired to be used. Multiple holes must be made in the mounting cup and the closeness of the valves required by the limited area makes it difficult to operate two or more valves in tandem. This strength becomes a further weakness when it is realized that the small hole of the container will not allow pre-expanded bags to be inserted into the container. Thus, only empty bags which will be filled later can be inserted into the container.

One object of this portion of the invention is to present a mounting cup, valve housing, and gasket combination which allows for a variety of sizes of the mounting cup so that multiple valves can be used with ease.

Another object of this invention is to maintain the excellent seal between the mounting cup and the valve housing while eliminating the need to join these components through a crimping operation. In the normal aerosol container, three crimp connections are required. One is between the mounting cup and the pedestal of the valve. One is between the valve mounting cup and the dome. A third is between the dome and the top edge of the container. The present invention eliminates the need for at least one of these crimps.

Another object of the invention is to present an aerosol container in which the dome and mounting cup are replaced by a dome containing valve housings, which dome fits across the diameter of the container and is crimped to the top of the container.

Another object of this invention is to present aerosol containers having multiple valves. This allows multiple ingredients to be packaged in a single container, which ingredients should be kept separate until the time of use.

Another object of this invention is to present aerosol dispensers which contain one-piece bags wherein the necks are made by injection molding and the bodies are made by blow-molding. Dip tubes may be used wherein the dip tubes are co-molded with the valve bodies or may be independently extruded dip tubes which are easily snapped onto the valve body. When two or more bags are used, the ratios of the bag volumes can be varied to provide for the use of products which should be applied in ratios other than 1:1.

Another object of this invention is to present a filling machine which pressurizes the container, evacuates the bags, and fills multiple flexible collapsible bags with the desired ingredients, thus eliminating several steps of the conventional process.

Another object of the present invention is to present a static mixing device which fits on top of a container having multiple valve outlets. The device has a low profile and results in excellent mixing of the materials, whether they are gas, liquid, or viscous materials.

Further objects will become apparent upon consultation of the Figures and detailed description.

DETAILED DESCRIPTION OF THE INVENTION

Figure 1:
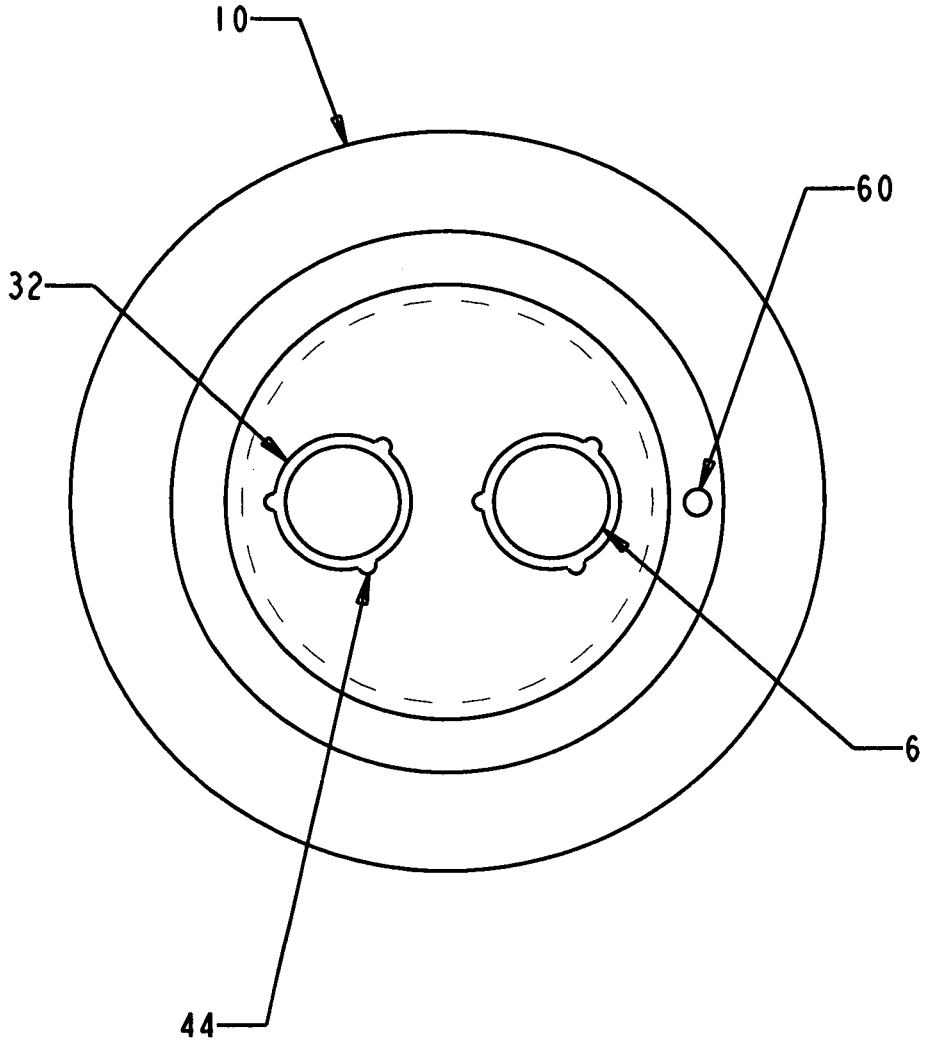
FIG. 1 is a plan view of the multi-valve dispenser utilizing two valves.
Figure 2:
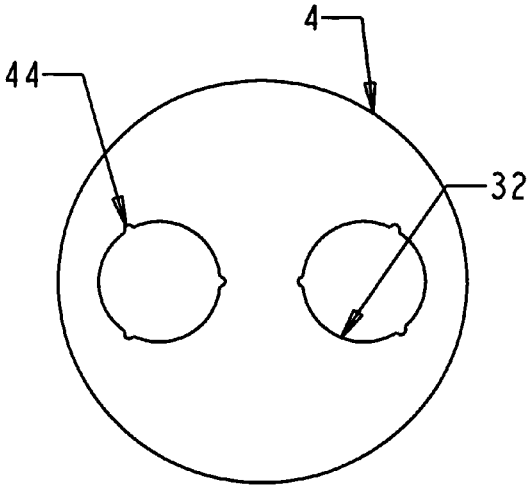
FIG. 2 is a plan view of a valve body containing two valves.

The invention will now be described in detail with reference to the above drawings. Like reference numerals refer to like parts throughout the description.

The first storage and dispensing system 2 of this invention is useful for the storing and dispensing of viscous materials which should be kept separate until the time of application. For the purposes of describing and claiming this invention, "viscous" will refer to that property which causes the material to exit the container as a flow rather than as a spray. Materials coming within this definition demonstrate viscosities of 1-1,000,000 centipoises (cp), preferably 10-500,000 cp, and more preferably 100-250,000 cp. In general, "viscous" may most preferably be considered to be descriptive of any flowable material having a viscosity of at least 10 cp. Examples of such materials are resins, sealing compounds, dental compositions such as toothpastes, adhesives, paints, certain cosmetic hair coloring, and other chemical components that need mixing just prior to application.

Multi-Valve Body

The multi-valve body of this invention will now be described with reference to FIGS. 1-6, 8, and 11-22. FIGS. 1, 6, 8, and 11-22 show details of multi-valve bodies 4 utilizing typical male spring-loaded valve plunger 6, and female spring-loaded valve plungers 8. The multi-valve body 4 is of such a size and shape as to fit into a conventional mounting cup 10 which, in turn, fits into the standard one-inch (2.54 cm) top opening 12 in the conventional dome 14 of the container 16. Alternatively, one of the novel mounting cups 18, 20 or one of the novel domes 22, 24 of this invention to be described in detail below may be used. Therefore the multi-valve body 4 of this invention may be incorporated cheaply and easily into already existing containers 16.

Each type of valve plunger 6, 8 is appropriate for different applications of the multi-valve body 4. The various multi-valve body 4 types can be used with a variety of different types and arrangements of spring-loaded valve plungers 6, 8, conventional static mixing devices 26, novel static mixing devices 28 of this invention to be described below, and sealing caps 30. The common feature of the conventional and novel static mixing devices is that they have a plurality of common passages for the viscous materials after the viscous materials have been brought together.

With reference to FIGS. 1, 6, 8, 11-22, and 34 the multi-valve body 4 comprises a body constructed of suitable thermoplastic resins or Nylon. As shown in FIGS. 2-5, the multi-valve body 4 in plan view is circular in shape and is formed with two or more circular holes 32 to accept multiple spring-loaded valve plungers 6, 8. The plungers 6, 8 extend upward through the holes 32 in the multi-valve body 4 and into the bottom of the static mixing device 26, 28.

Immediately below the opening 34 in the conventional mounting cup 10, a rubber washer or seal 36 is fitted over the plunger 6, 8. The seal 36 covers horizontal openings 38 which pass horizontally through the wall 40 of the passageway 42 of the plunger 6, 8. When the spring-loaded valve plunger 6, 8 is depressed, the rubber seal 36 tilts slightly, thereby exposing the horizontal openings 38 to allow viscous material to pass from the container 16 to the passageway 42 of the plunger 6, 8 and into the static mixing device 26, 28 or directly into the atmosphere.

The viscous material flows past the plunger 6, 8 by way of vertical grooves 44 in the side of the multi-valve body 4 in which the plunger 6, 8 fits. The viscous material is forced by the pressurizing gas up from the container 16 through the valve inlet openings 46 through the spring 48, and into the grooves 44.

The relative proportions of the viscous materials delivered to the plunger 6, 8 is controlled by the relative size of the inlet openings 46.

The plunger 6, 8 is formed of thermoplastic resins, Nylon, or other suitable material with independent passages 50, 52 through which viscous materials can flow without touching each other or mixing until they exit the plunger 6, 8. The plunger 6, 8 is formed with force-fit or screw or a locking ring which receives the static mixing device 26, 28 as it is pushed or screwed or twist-locked into position. After the static mixing device 26, 28 is removed, a sealing cap 30 can be pushed or screwed or twist-locked into position to seal the outlet openings 54.

The multi-valve body 4 is formed with a perimeter ledge 56 to retain the flap seal 58 and keep the seal 58 tight against the bottom of the mounting cup 10, 18. The flap seal 58 is necessary to seal pressurizing gas from escaping after it is injected through a port hole 60 into the container 16.

FIGS. 1-5 show typical plan views of different multi-valve bodies 4 utilizing the multiple spring-loaded valve plungers 6, 8 to deliver at least two viscous materials from the container 16 to the static mixing device 26, 28.

First Storing and Dispensing System

The first storage and dispensing system 2 of the invention is shown in FIGS. 23-27, 41 and 43. This system 2 is made up of the multi-valve body 4 and a conventional aerosol container 16 with a conventional one-inch (2.54 cm) diameter top opening 12 in the conventional dome 14. Alternatively, a dome 22 as described below may be so sized as to cover the entire top of the container 16.

In the first storage and dispensing system 2 of this invention, illustrated in FIGS. 23, 27, 41, and 43, the multi-valve body 4 made up of a first valve 62 and a second valve 64 is secured to a conventional mounting cup 10 by crimping and collapsible bags 66 for containing viscous materials are attached to the valve stems 68 of each valve 62, 64. In order for the bags 66 to pass through the top opening 12, they are folded, coiled, or otherwise collapsed to a small diameter. The entire assembly made up of the mounting cup 10, multi-valve body 4, and bags 66 is inserted into the container 16 through the top opening 12. The assembly is then sealed and secured to the container 16 by crimping the dome 14 around the perimeter of the mounting cup 10. Alternatively, as will be described below, the mounting cup/dome combination may be replaced by a single dome.

The collapsible bags 66 are filled with viscous materials by injecting the materials from the top through the corresponding first 62 and second 64 valves. The pressurizing gas is either injected through a port hole 60 in the mounting cup 10 perimeter or in the bottom 70 of the container 16 or by the "undercup" method. In the "undercup" method a pressurized sleeve fits over the top of the container 16 to force pressurized gas into the container 16 prior to the final sealing of the mounting cup 10 to the dome 14 around the perimeter of the cup 10. Lastly, the plunger 6, 8 is inserted onto the top of the multi-valve body 4.

A static mixing device 26, 28 is attached by the user to the plunger 6, 8 prior to using the delivery system 2. The length and design of the conventional static mixing device 26 is selected from industry standards to provide adequate mixing of the viscous materials. The static mixing device 26, 28 is discarded after each use. A sealing cap 30 is provided to seal the outlets 54 of the plunger 6, 8 after the static mixing device 26, 28 has been removed. The novel static mixing device 28 which is described below may be used in place of the conventional static mixing device 26.

The multi-valve inlet openings 46 deliver the separate viscous materials simultaneously from the collapsible bags 66 to the plunger outlet openings 54. The inlet openings 46 in the spring-loaded valve plungers 6, 8 are sized to deliver, when the plunger 6, 8 is depressed, the proper amounts of each material to the valve outlet openings 54. The viscous materials in the bags 66 are driven out by pressure from the pressurizing gas which surrounds the bags 66. The flow of materials is cut off when the plunger 6, 8 is released. Unmixed materials above the cut-off seal 36 at the plungers 6, 8 remain in the plunger 6, 8 but are prevented from mixing with each other or from being affected by contact with the atmosphere by the installation of the sealing cap 30.

The collapsible bags 66 are preferably constructed of foil-reinforced polyethylene, Nylon, aluminum, or other suitable material that will effectively contain the viscous materials but which is still pliable enough to collapse under pressure, like a toothpaste tube, when the corresponding valve 62, 64 is opened.

Figure 3:
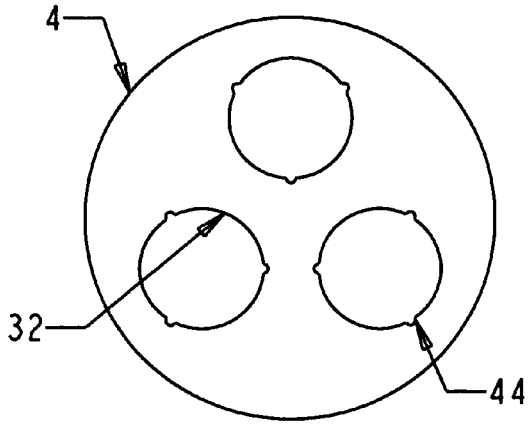
FIG. 3 is a plan view of a valve body containing three valves.
Figure 4:
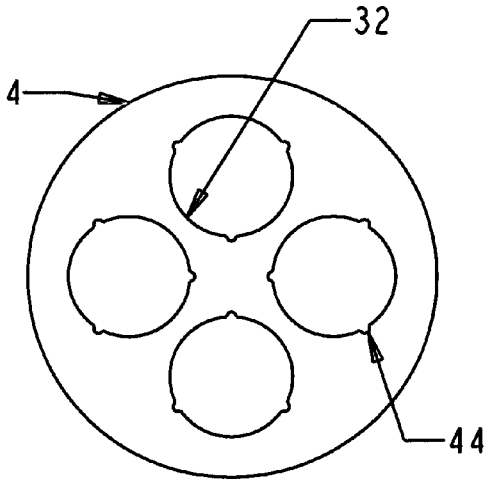
FIG. 4 is a plan view of a valve body containing four valves.
Figure 5:
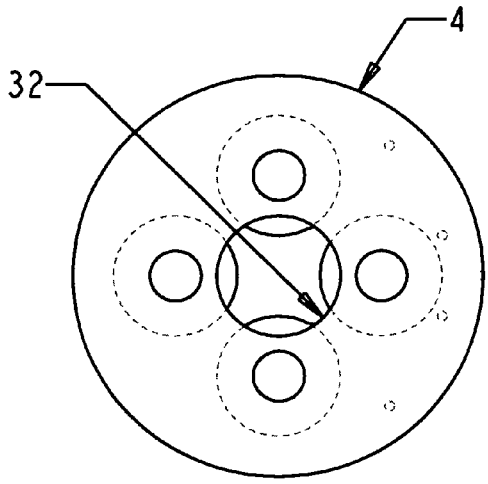
FIG. 5 is a plan view of a valve body containing five valves.
Figure 6:
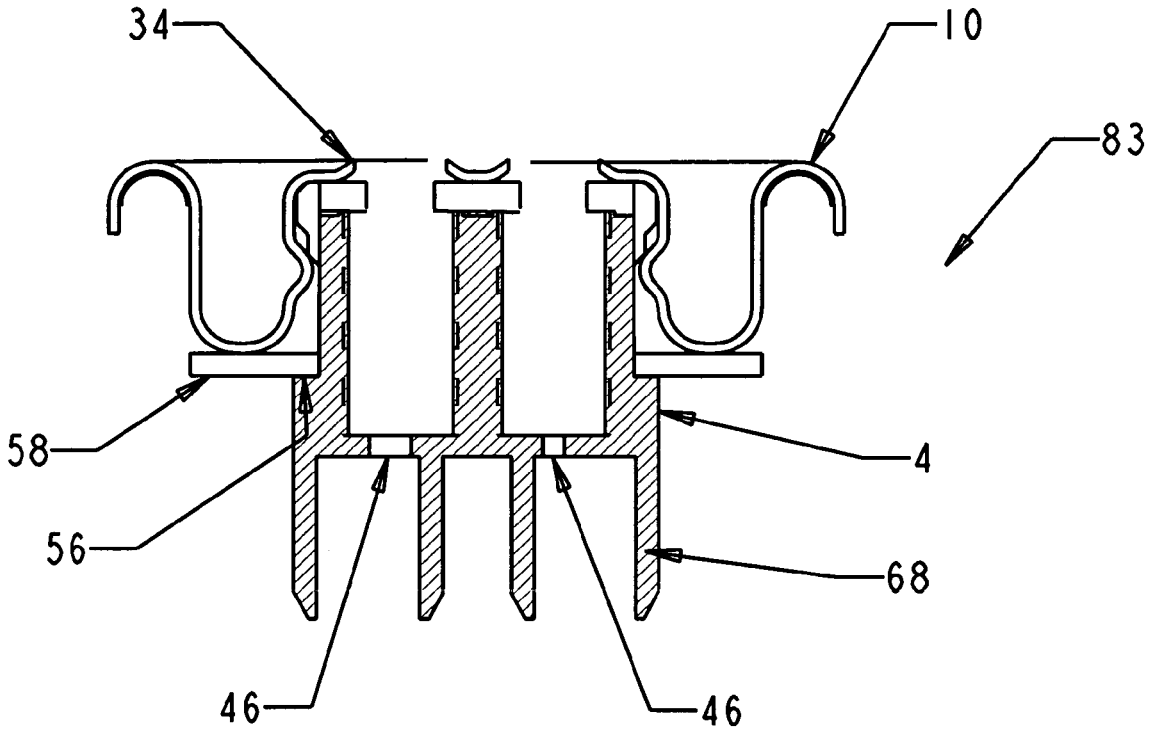
FIG. 6 is an enlarged detailed cross-sectional front view of a combination having a mounting cup and two female valves according to this invention.
Figure 7:
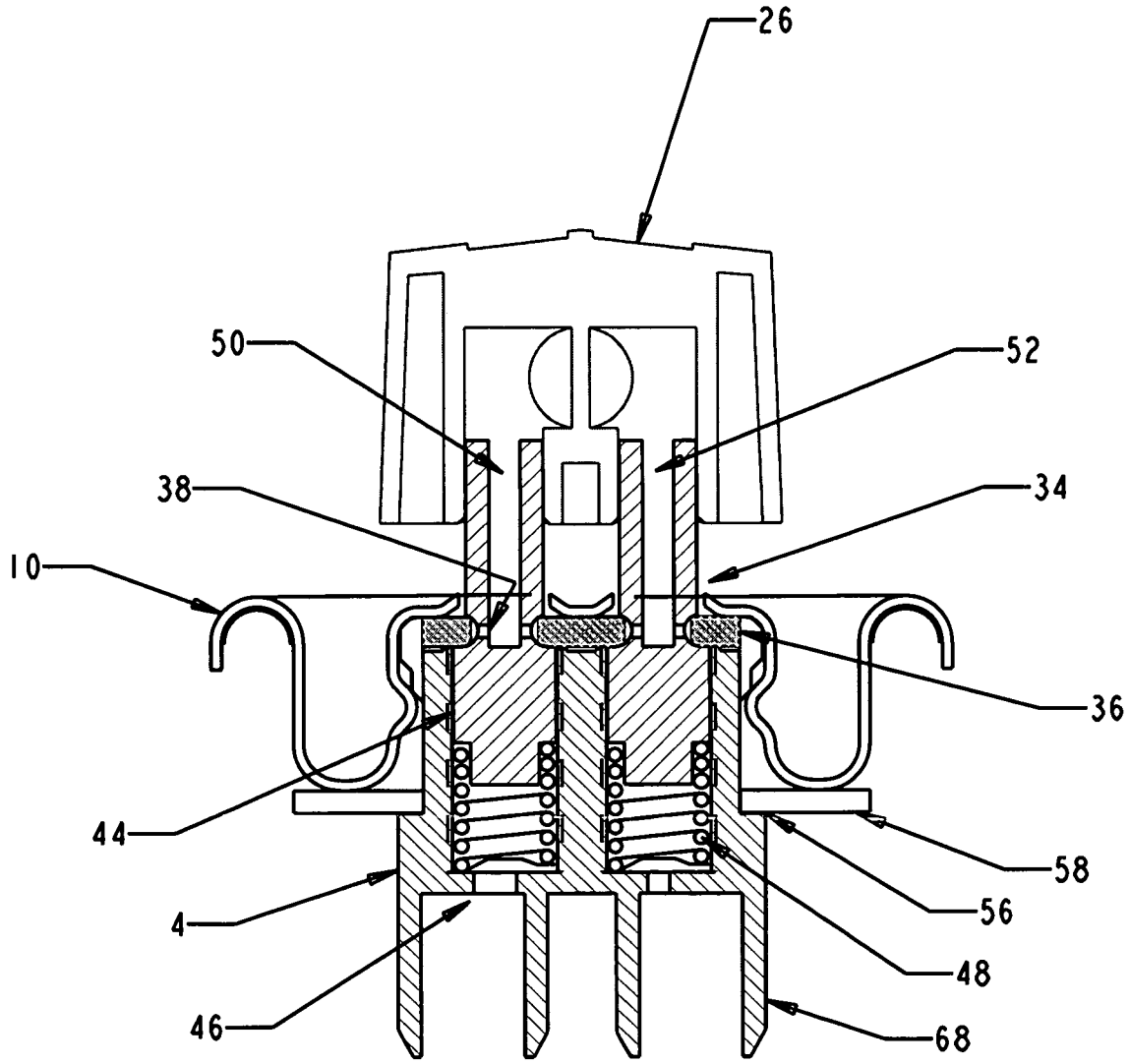
FIG. 7 is a front cross-sectional view of a combination having a mounting cup and two male valves according to this invention in combination with a conventional static mixing device.
Figure 8:
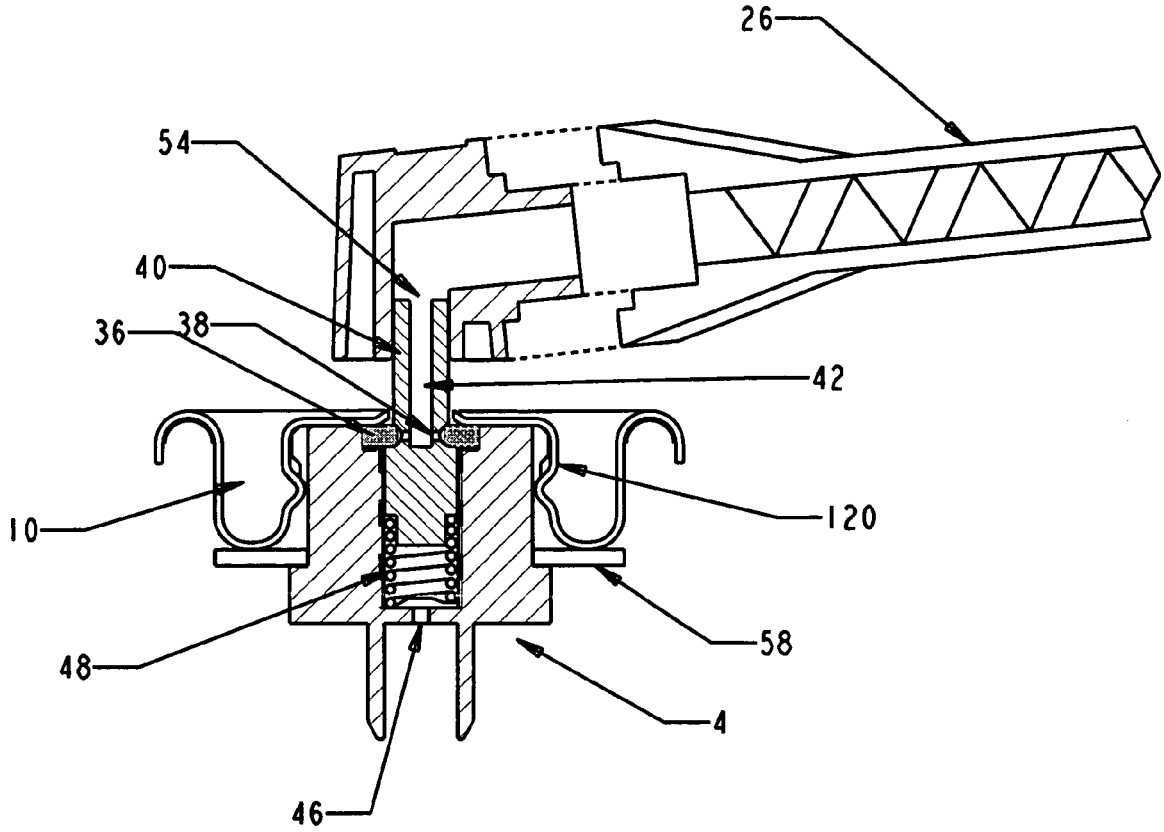
FIG. 8 is a side cross-sectional view of a combination having a mounting cup and two male valves according to this invention in combination with a conventional static mixing device.
Figure 9:
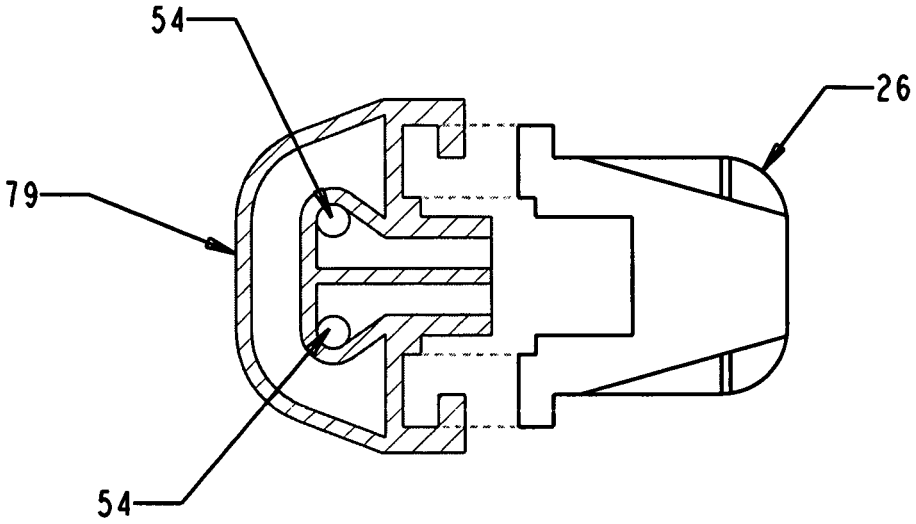
FIG. 9 is an enlarged detailed cross-sectional top view of a combination having two male valves according to this invention.
Figure 10:
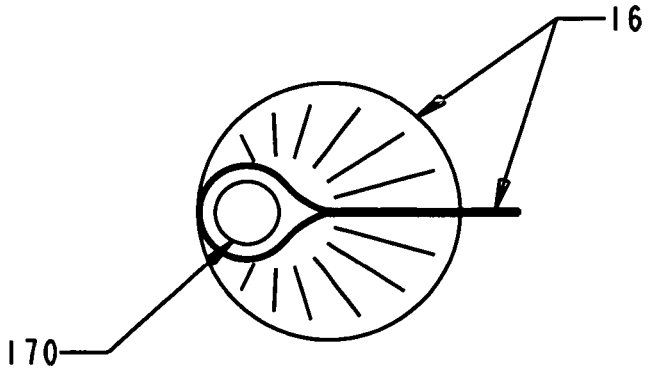
FIG. 10 is a plan view of a bag used for storage of materials in this invention showing the neck being offset from the central axis.
Figure 11:
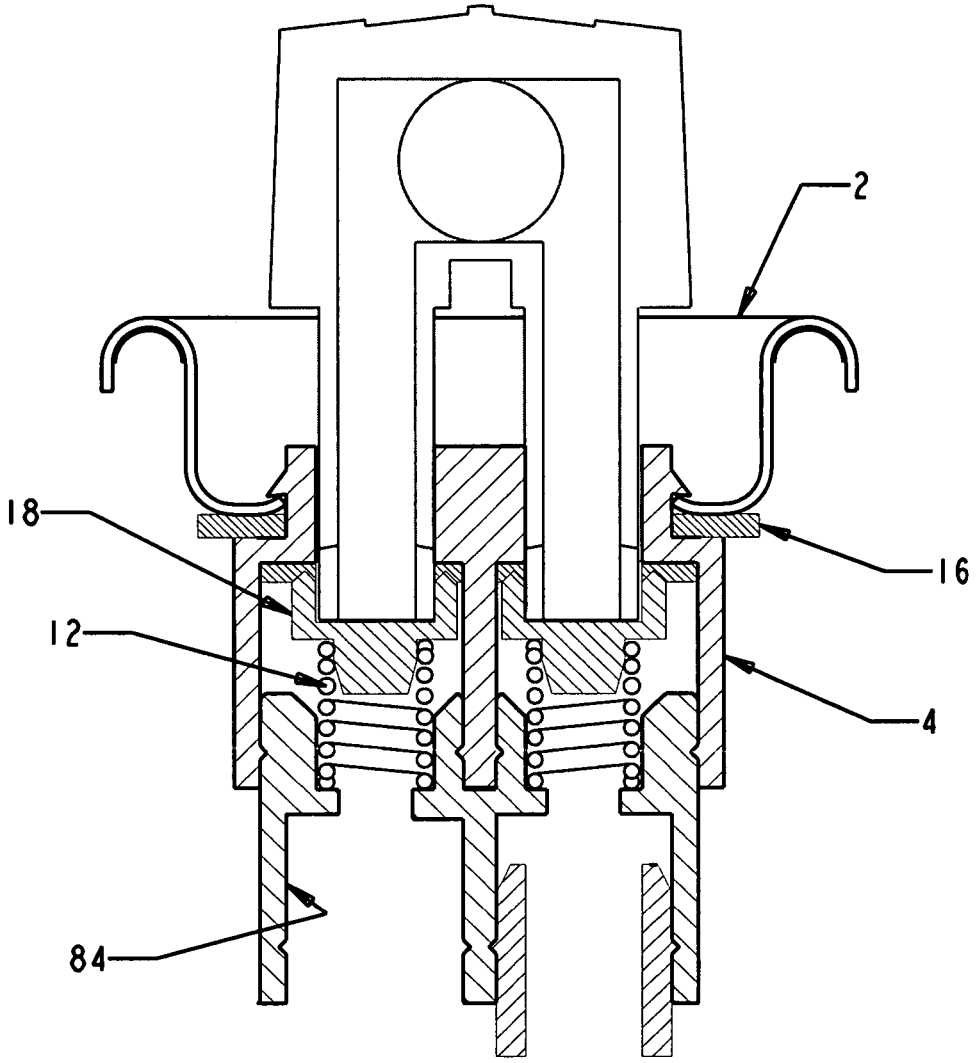
FIG. 11 is a front cross-sectional view of a combination having a mounting cup and two female valves according to this invention in combination with a conventional static mixing device.
Figure 12:
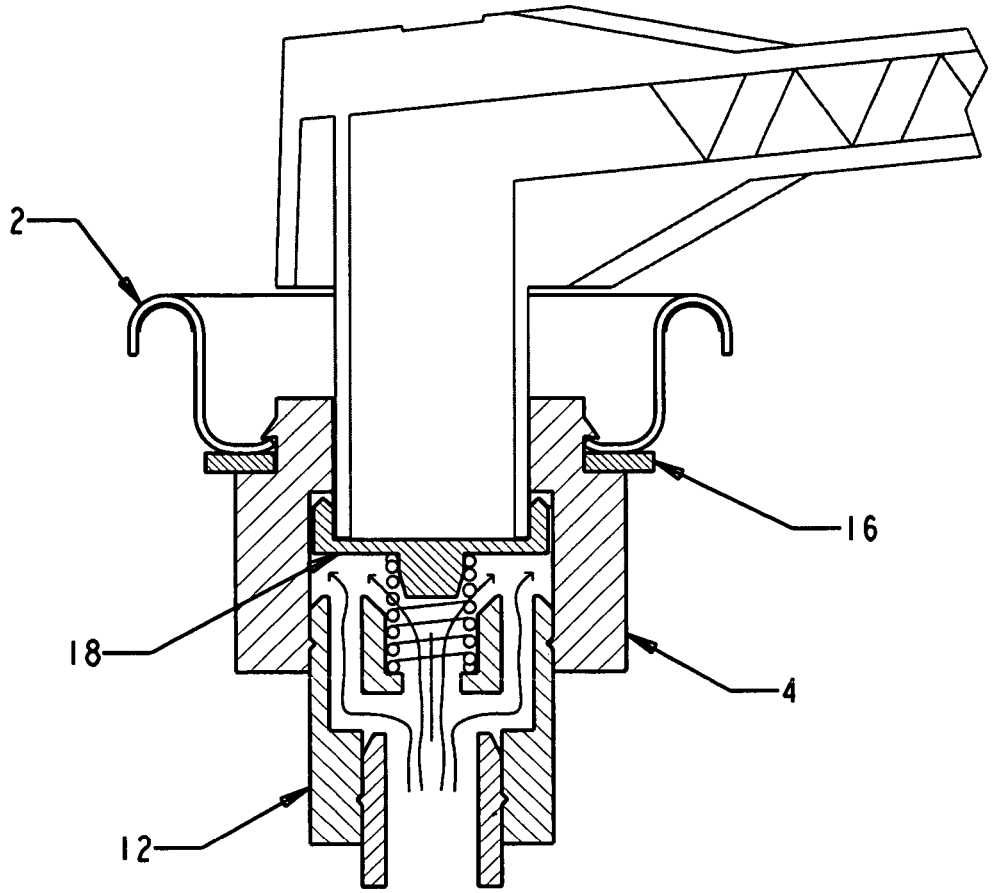
FIG. 12 is a side cross-sectional view of a combination having a mounting cup and two female valves according to this invention in combination with a conventional static mixing device.
Figure 13:
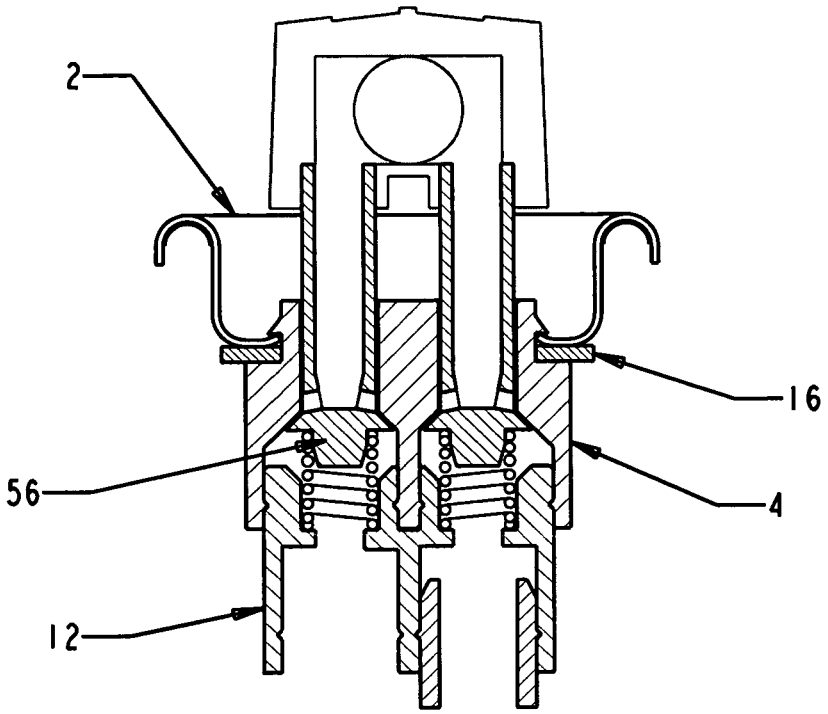
FIG. 13 is a front cross-sectional view of a combination having a mounting cup and two male valves according to this invention in combination with a conventional static mixing device.
Figure 14:
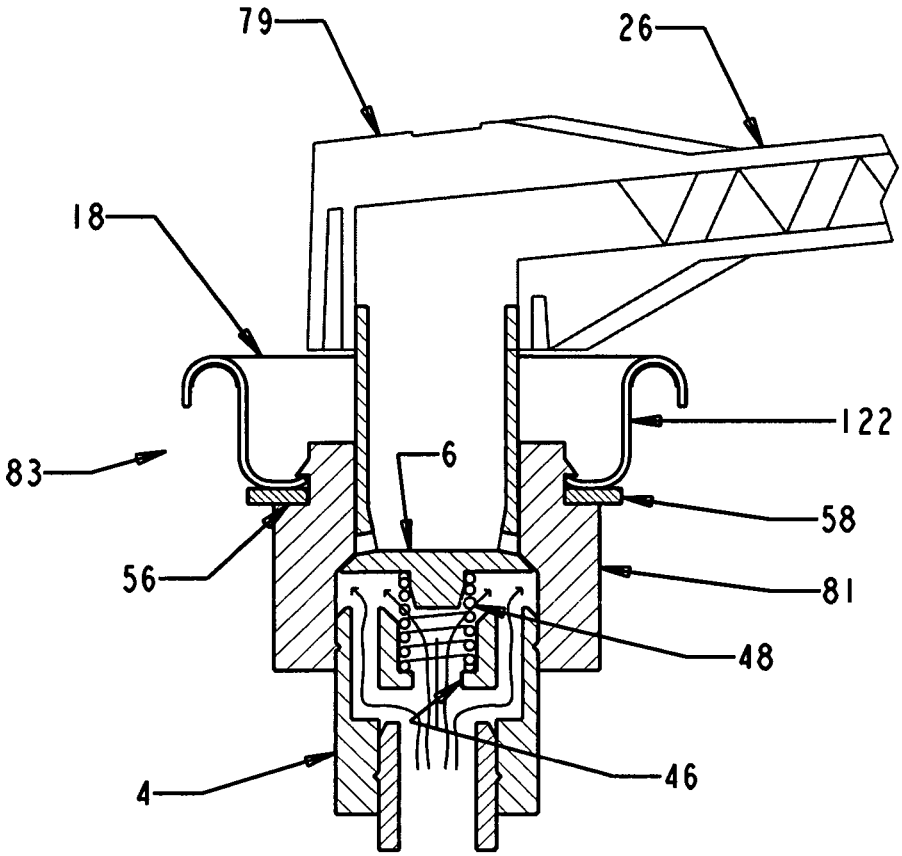
FIG. 14 is a side cross-sectional view of a combination having a mounting cup and two male valves according to this invention in combination with a conventional static mixing device.
Figure 15:
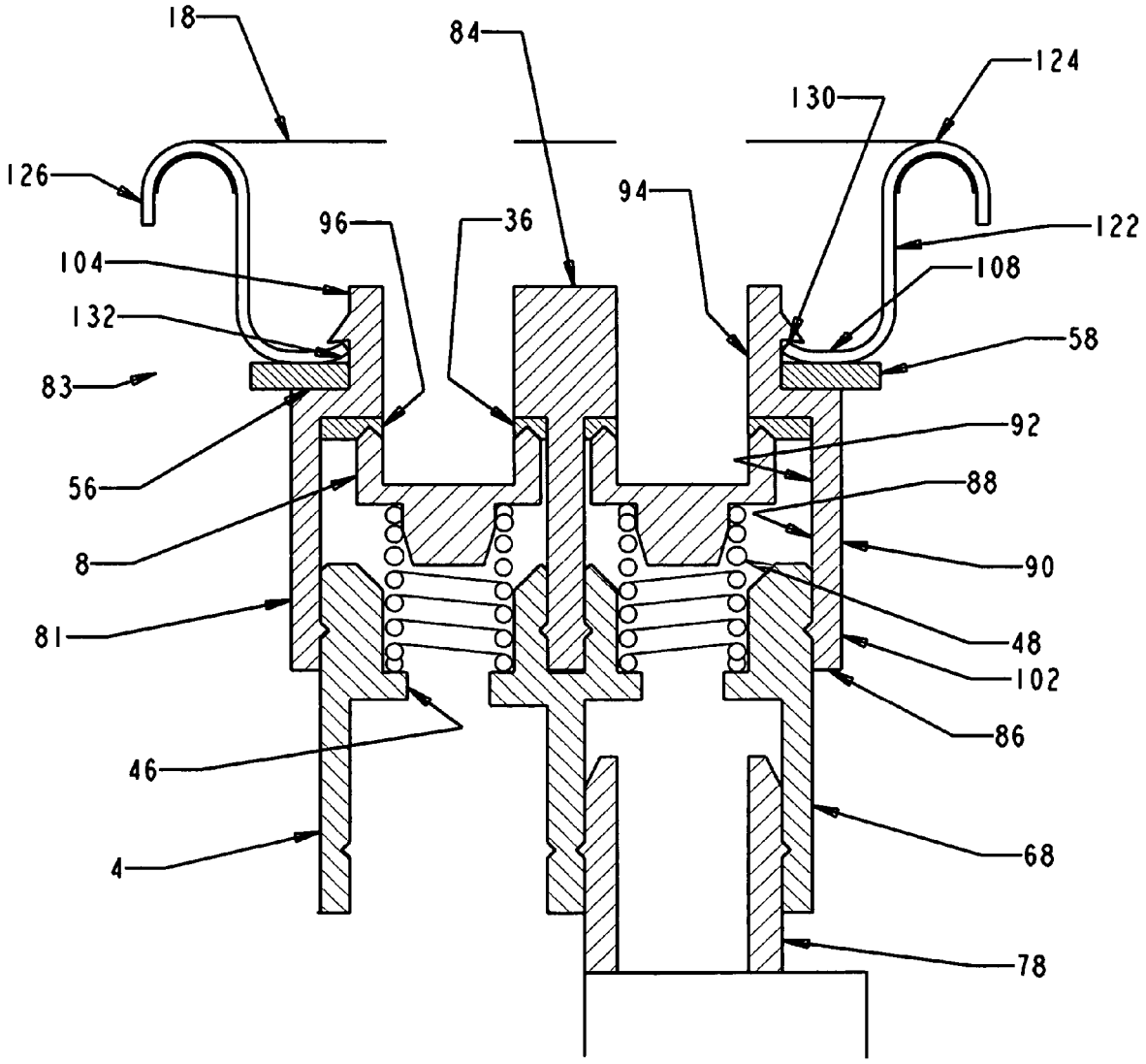
FIG. 15 is an enlarged detailed cross-sectional front view of a combination having a first mounting cup and two female valves according to this invention.
Figure 16:
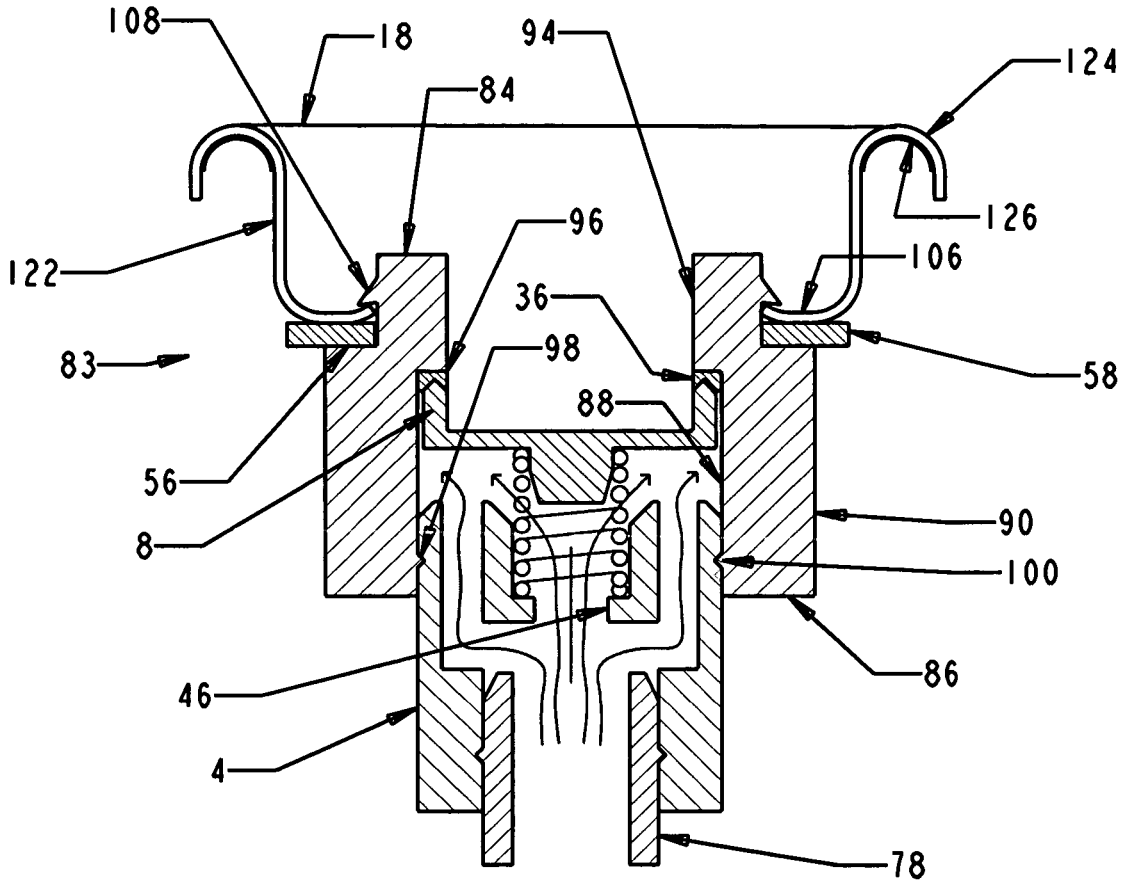
FIG. 16 is an enlarged detailed cross-sectional side view of a combination having a first mounting cup and two female valves according to this invention.
Figure 17:
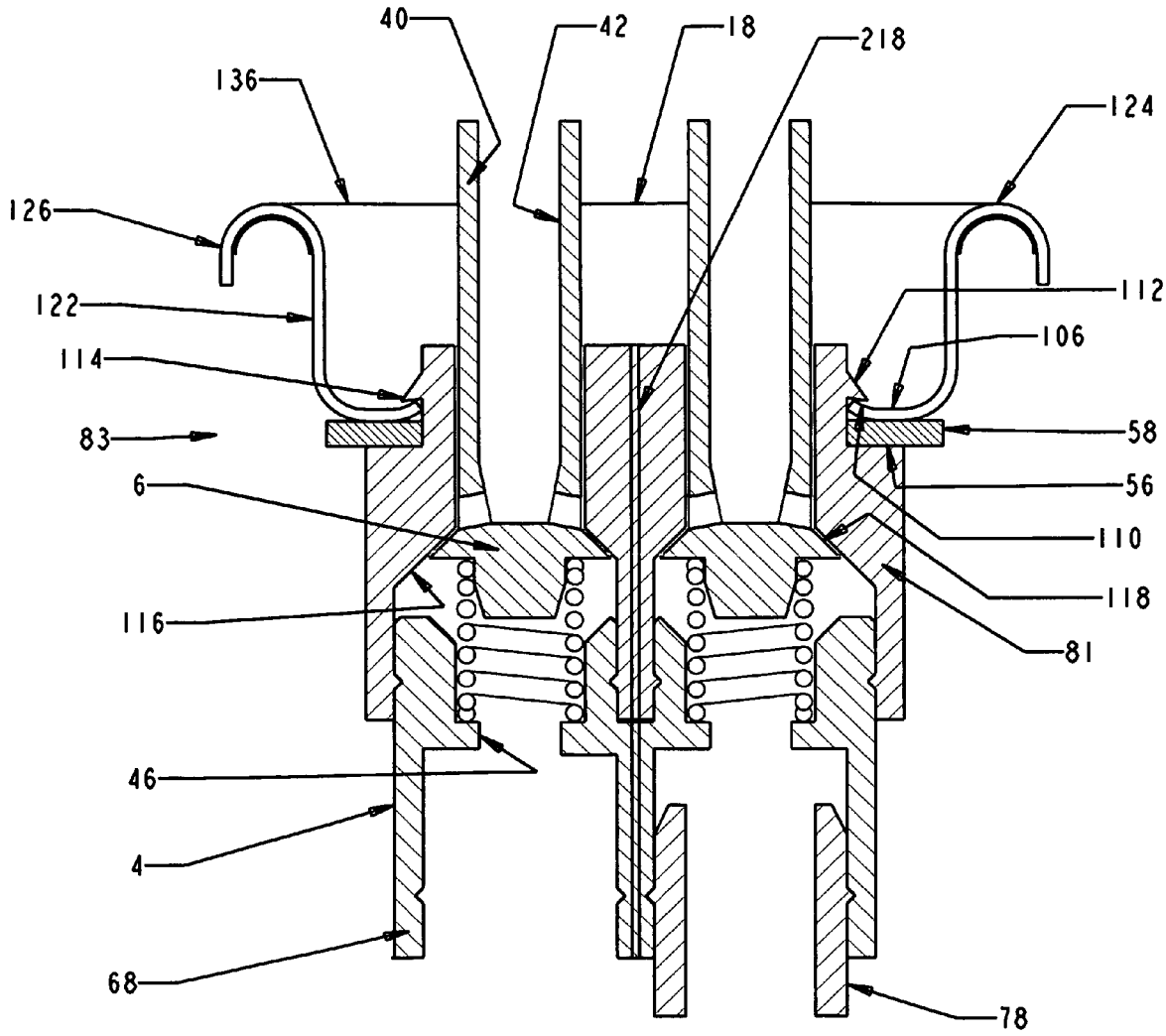
FIG. 17 is an enlarged detailed cross-sectional front view of a combination having a first mounting cup and two male valves according to this invention.
Figure 18:
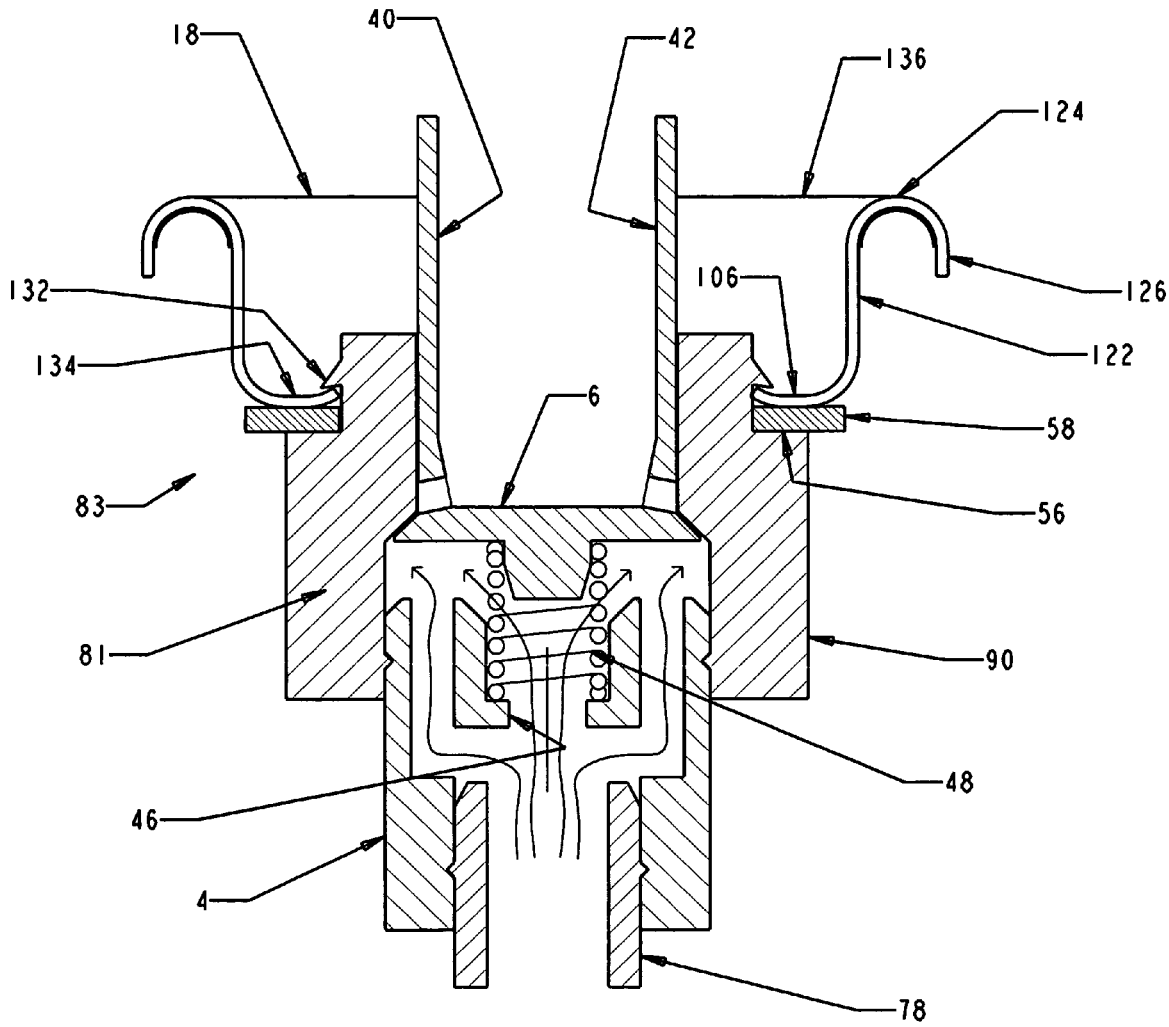
FIG. 18 is an enlarged detailed cross-sectional side view of a combination having a first mounting cup and two male valves according to this invention.

The storage and dispensing system 2 of this embodiment is adaptable to be used with more than two viscous materials by simply adding additional storage bags 66 to the container 16 and extra valve plungers 6, 8 to the unitary multi-valve body 4 as shown in FIGS. 3-5.

The system 2 of this embodiment is most appropriate for products where the viscous material components are equal, or nearly equal, in quantity.

Second Storage and Dispensing System

Figure 24:
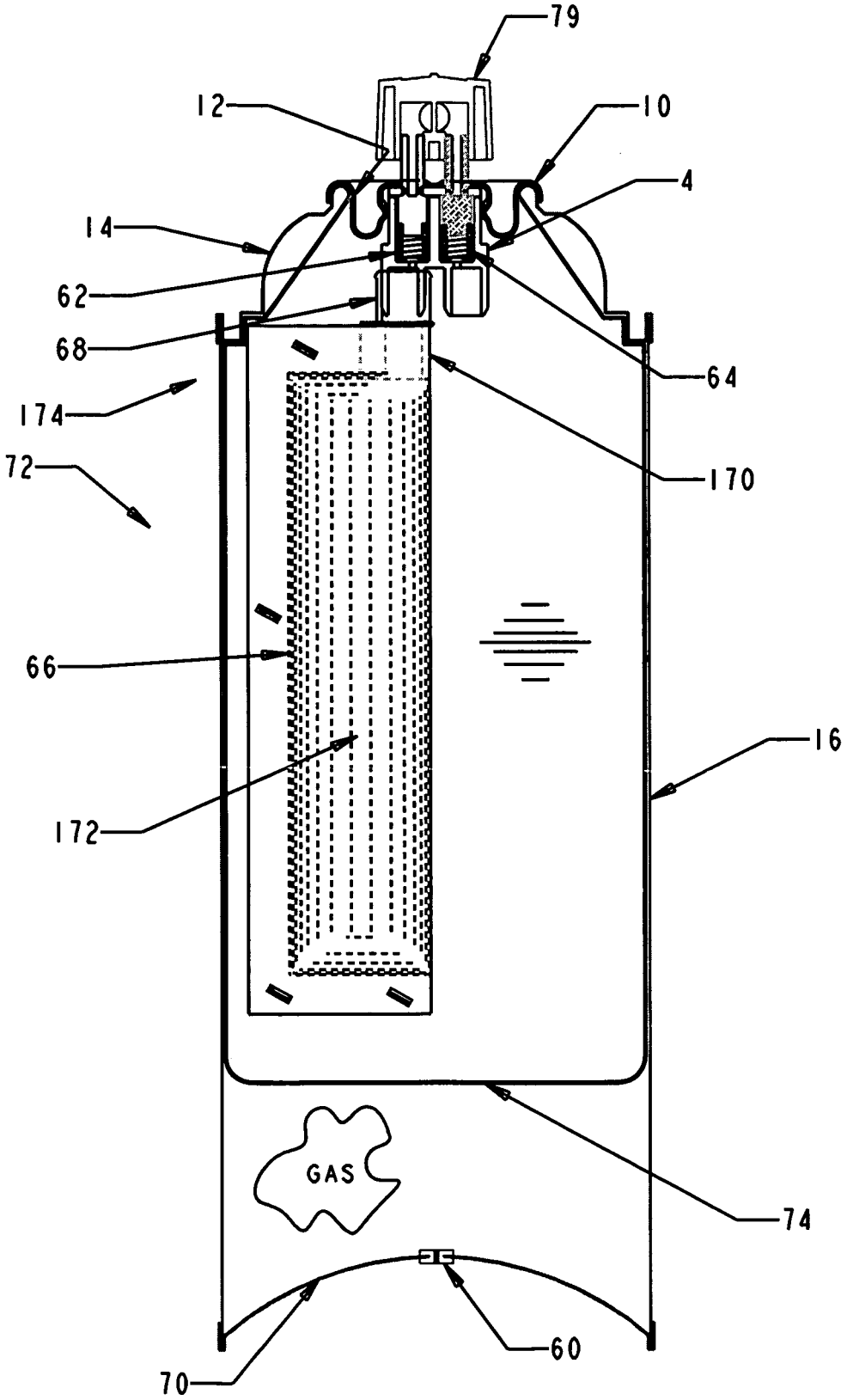
FIG. 24 is a cross-sectional front view of a pressurized aerosol container using the multi-valve dispensing system of this invention in combination with a single bag and barrier liner storage arrangement.

The second storage and dispensing system 72 of the invention shown in FIG. 24 is made up of a standard aerosol container 16 with either a standard dome 14 having a standard one-inch (2.54 cm) diameter top opening 12 or the novel dome 22 covering the entire top of the container 16 and a pre-installed industry-standard barrier liner 74. When a conventional mounting cup 10 is used, the multi-valve body 4 is secured to a mounting cup 10 by crimping and a bag 66 is attached to the valve stem 68. In order for the bag 66 to pass through the top opening 12, it is folded, coiled, or otherwise collapsed to a small diameter. The mounting cup 10 which holds the multi-valve body 4 and bag 66 is mounted onto the top opening 12 of the dome 8 of the container 16 which contains a pre-installed barrier liner 74. The mounting cup 10 is then secured to the container 16 by crimping to the dome 14 around the perimeter of the mounting cup 10.

After the cup 10 is installed and sealed by crimping, the barrier liner 74, in effect, forms a larger bag which completely encloses the smaller collapsible bag 66. The collapsible bag 66 and the barrier liner 74 are both filled by injecting the viscous materials from the top through the corresponding first 62 and second 64 valves. The pressurizing gas is injected through a port hole 60 in the bottom 70 of the container 16 or by the "undercup" method. Finally, the plunger 6, 8 is inserted onto the top of the multi-valve body 4.

As described with reference to the first storage and dispensing system 2, a static mixing device 26, 28 is attached by the user to the plunger 6, 8 prior to using the delivery system 72. A sealing cap 30 is provided to seal the outlet openings 54 of the plunger 6, 8 after the static mixing device 26, 28 is removed.

The multi-valve body 4 of the second storage and dispensing system 72 delivers two or more viscous materials simultaneously from the collapsible bag 66 and from within the barrier liner 74. The multi-valve inlet openings 46 in the valve body 4 are sized to deliver, when the plunger 6, 8 is depressed, the proper proportions of each material to the valve plungers 6, 8. The viscous materials in the bag 66 and within the barrier liner 74 are driven out of the container 16 by pressure from the pressurizing gas which surrounds them. The flow of viscous materials is stopped when the plungers 6, 8 are released. Unmixed materials above the cut-off seal 36 of the plungers 6, 8 remain in the plunger 6, 8, but are prevented from mixing with each other or from being affected by contact with the atmosphere by the installation of the cap 30.

The collapsible bag 66 is preferably constructed of foil-reinforced polyethylene, Nylon, aluminum, or other suitable material that will effectively contain the viscous material but which is still pliable enough to collapse under pressure, like a toothpaste tube, when the valve 64 is opened.

The second storage and dispensing system 72 of the invention is adaptable to be used with more than two viscous materials by simply adding additional collapsible bags 66 inside the barrier liner 74 and additional valve plungers 6, 8 to the multi-valve body 4, as shown in FIGS. 2-5.

The second storage and dispensing system 72 appropriate for products where two or more viscous material components, such as epoxy resin and its catalyst(s), are mixed in significantly unequal proportions. The smaller amount of the viscous material is stored in the interior collapsible bag(s) 66. The larger amount of viscous material is stored in the space bounded by the barrier liner 74.

Third Storage and Dispensing System

Figure 25:
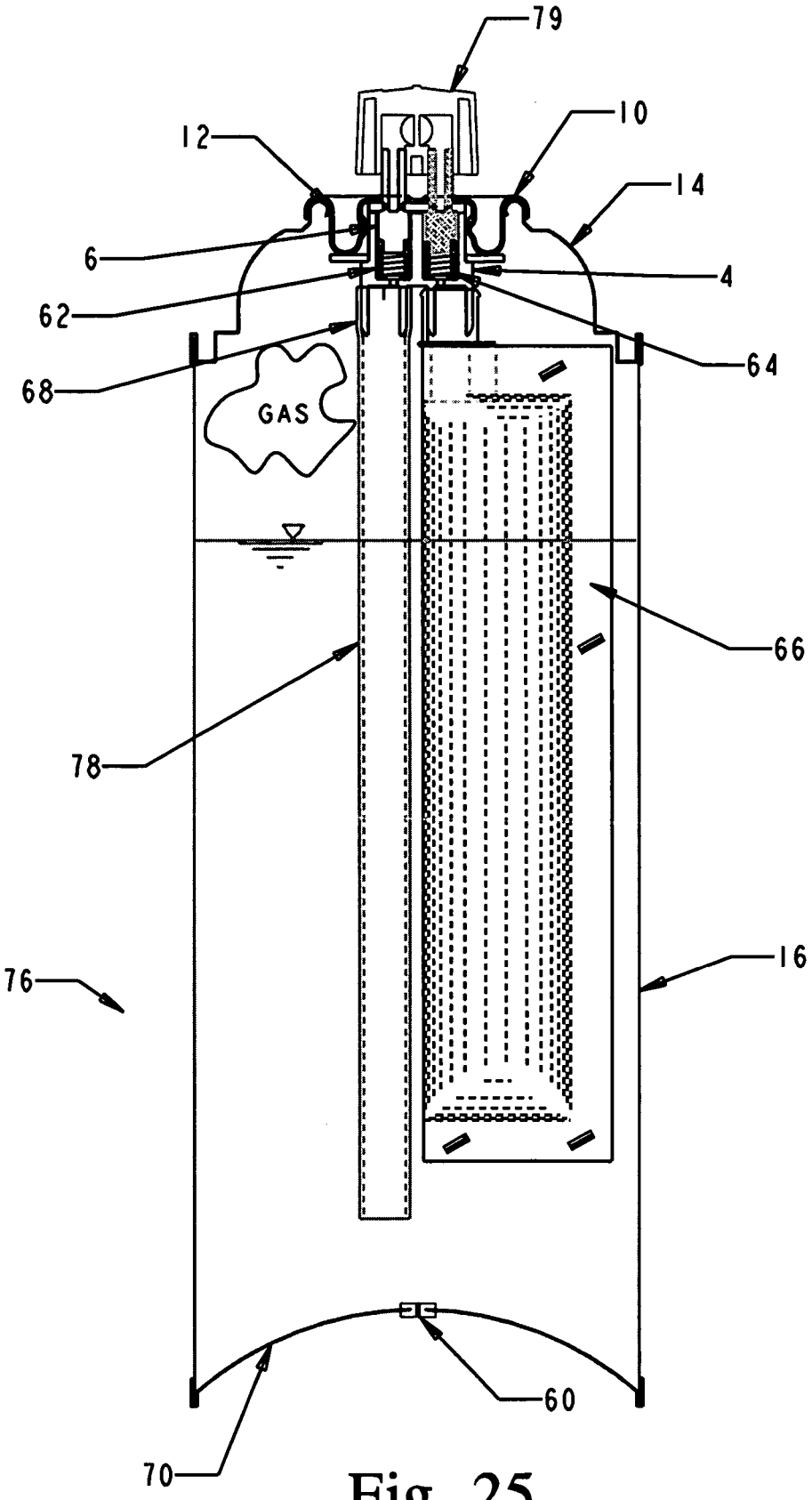
FIG. 25 is a cross-sectional front view of an upright pressurized aerosol container using the multi-valve dispensing system of this invention in combination with a single bag and dip tube arrangement. The dip tube reclaims material from the bottom of the container.

The third storage and dispensing system 76 of the invention as shown in FIG. 25 is made up of a standard aerosol container 16 having a standard one-inch (2.54 cm) diameter top opening 12. The multi-valve body 4 is secured to a mounting cup 10 by crimping, and a collapsible bag 66 and an industry-standard dip tube 78 are attached to the first 62 and second 64 valve stems 68. The dip tube 78 may be made by co-molding the dip tube 78 and valve body 4. Alternatively, the container may have the novel dome 22 of this invention and avoid the use of the mounting cup. When the mounting cup 10, 18 is used, the collapsible bag 66 is folded, coiled, or otherwise collapsed to a small diameter in order to allow it to pass through the top opening 12. The mounting cup 10 holding the multi-valve body 4, collapsible bag 66, and dip tube 78 is mounted onto the dome 14, 22 of the container 16. The assembly is then sealed and secured to the container 16 by crimping around the perimeter of the cup 10, 18.

The collapsible bag 66 and the space surrounding the dip tube 78 are then filled by injecting the viscous materials through the corresponding valves 62, 64 in the multi-valve body 4. The pressurizing gas is injected through the port hole 60 in the perimeter of the cup 10 or in the bottom 70 of the container 16 or by the "undercup" method. Lastly, the actuator 79 is mounted on the plungers 6, 8 on the top of the multi-valve body 4.

A static mixing device 26, 28 is attached by the user to the actuator 79 or the plungers 6, 8 prior to using the delivery system 76. When a conventional static mixing device 26 is used, the length and design of the static mixing device 26 is selected from industry standards to provide adequate mixing of the viscous materials. The static mixing device 26 is discarded after each use. Alternatively, the novel static mixing device 28 of this invention as described below may be attached to the plunger 6, 8. A sealing cap 30 is provided to seal the outlet passageway 54 of the plunger 6, 8 after the static mixing device 26, 28 has been removed.

The multi-valve inlet openings 46 deliver two or more viscous materials simultaneously from the collapsible bag 66 and dip tube 78 which reaches from the bottom 70 of the container 16 to the multi-valve stems 68.

The multi-valve inlet openings 46 in the valve bodies 4 are sized to deliver, when the actuator 79 is depressed, the proper proportions of each material to valve plungers 6, 8. The viscous materials in the bag 66 and at the bottom 70 of the container 16 are driven out of the container 16 by pressure from the pressurizing gas which acts upon them. The flow of viscous materials is stopped when the actuator 79 is released. Unmixed materials above the cut-off seal 36 of the plungers 6, 8 remain in the plunger 6, 8, but are prevented from mixing with each other or from being affected by contact with the atmosphere by the installation of the cap sealing 30.

The collapsible bag 66 is preferably constructed of foil-reinforced polyethylene, Nylon, aluminum, or other suitable material that will effectively contain the viscous materials but which is still pliable enough to collapse under pressure, like a toothpaste tube, when the associated valve 62 is opened.

The third storage and dispensing system 76 of this invention is adaptable to be used with more than two viscous materials by simply adding additional storage bags 66 to the container 16 and extra valve plungers 6, 8 to the multi-valve body 4, is shown in FIGS. 2-5.

The third storage and dispensing system 76 of this invention is most appropriate for products like sputter paint where a thinner viscous material needs to be mixed with one or more thicker, but smaller quantity, viscous material as it is delivered.

Fourth Storage and Dispensing system

The fourth storage and dispensing system 80 of the invention will now be described with reference to FIG. 23-27, 41, and 43. The fourth storage and dispensing system 80 is made up of a standard aerosol container 16 with a standard one-inch (2.54 cm) diameter top opening 12. In this embodiment, a bag 66 is attached to one valve inlet opening 46 of the multi-valve body 4 and an omnidirectional valve and dip tube 78 is attached to the other valve inlet opening 46. If the valve(s) incorporated in the multi-valve body 4 are female valves, the standard omnidirectional valve is appropriately replaced with the inventor's omnidirectional valve 82 described in U.S. Pat. No. 6,736,288. The multi-valve body 4 is secured to a cup 10, 18, 20 by crimping and a collapsible bag 66 and dip tube 78 are attached to the multi-valve body 4. In order for the collapsible bag 66 to pass through the top opening 12, it is folded, coiled, or otherwise collapsed to a small diameter. The mounting cup 10, 18, 20, holding the multi-valve body 4 which is attached to the collapsible bag 66 and dip tube 78, is mounted onto the top opening 12 of the container 16. The mounting cup 10, 18, 20 is then secured to the container 16 by crimping around the outside perimeter of the cup 10. A combination of a mounting cup 10, 18, 20 and dome 14 may be replaced by a novel dome 22, 24 of the present invention. The dome 22, 24 may be sealed to the container 16 and the bags 66 may be pre-inflated.

The collapsible bag 66 and the space surrounding the dip tube 78 are then filled by injecting the viscous materials through the top opening 12 through the corresponding valves 62, 64 and the pressurizing gas is injected through the port hole 60 in the perimeter of the cup 10 or in the bottom 70 of the container 16 or by the "undercup" method.

Figure 26:
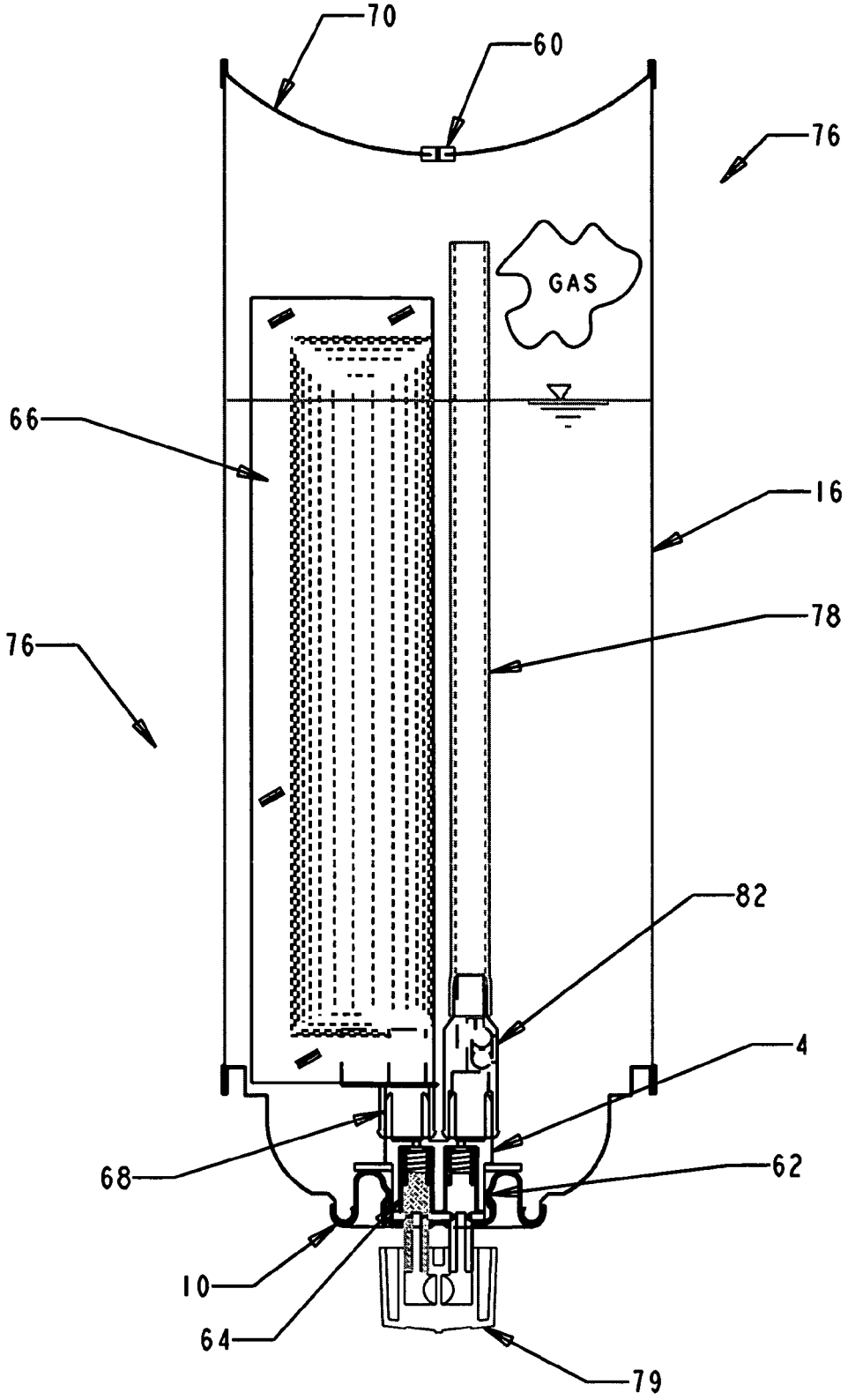
FIG. 26 is a cross-sectional front view of an inverted pressurized aerosol container using the multi-valve dispensing system of this invention with a single bag and dip tube arrangement in combination with an omnidirectional check valve.
Figure 27:
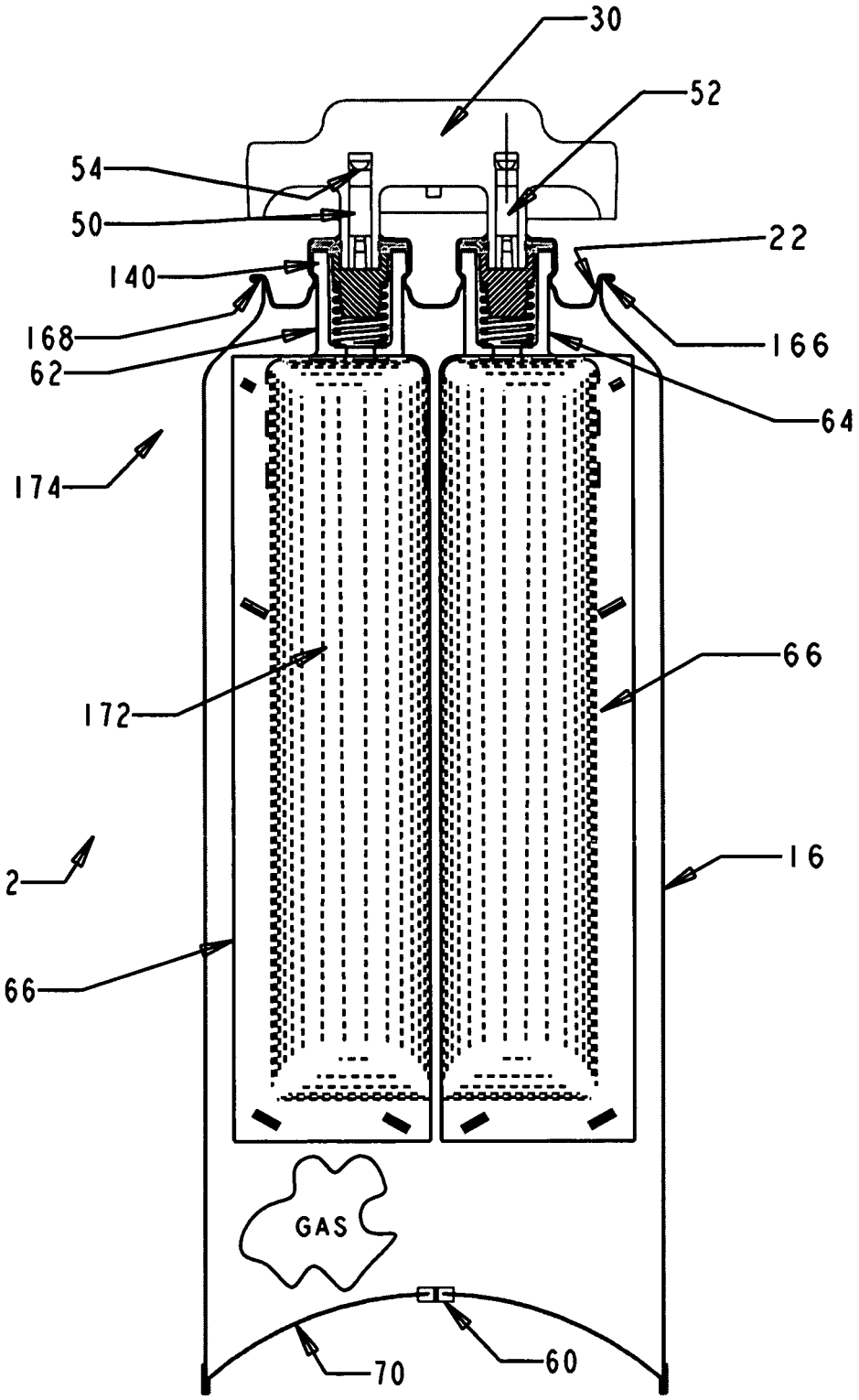
FIG. 27 is a cross-sectional front view of a pressurized container using the multi-valve dispensing system of this invention with two bags, a dome of the present invention, and a static mixing device of the present invention.
Figure 28:
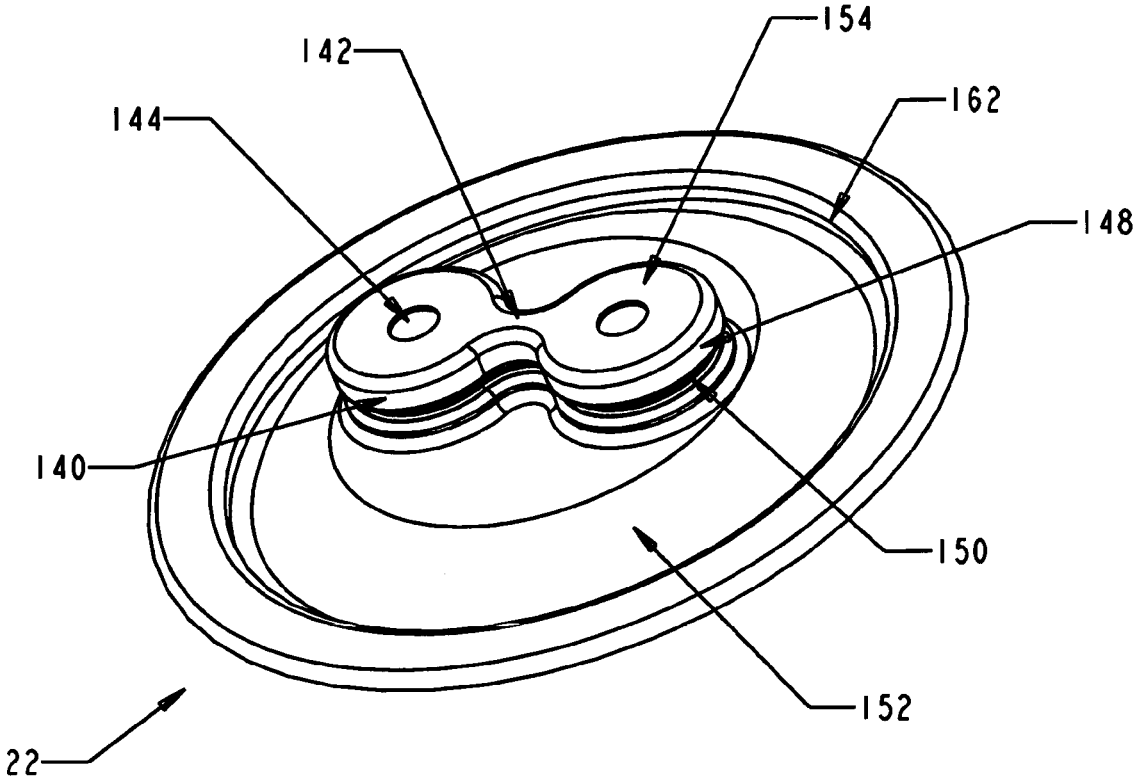
FIG. 28 is a top elevational perspective view of the multi-valve dome of the present invention.
Figure 29:
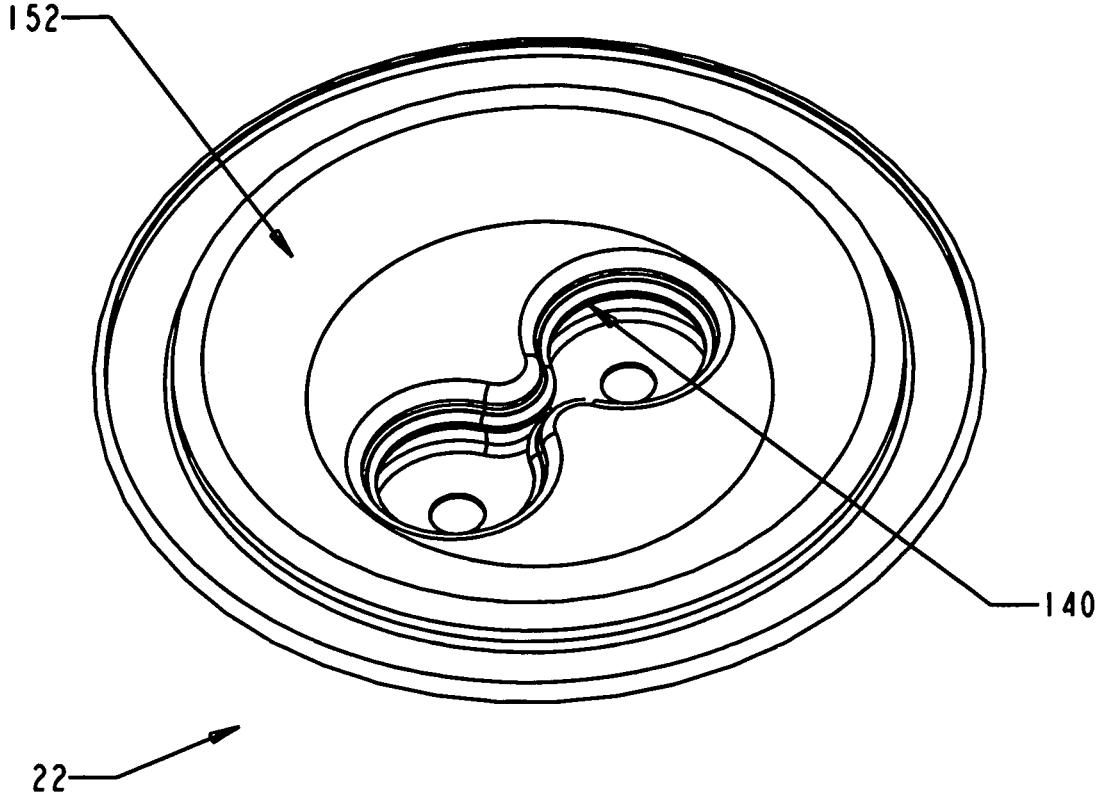
FIG. 29 is a bottom elevational perspective view of the multi-valve dome of the present invention.
Figure 30:
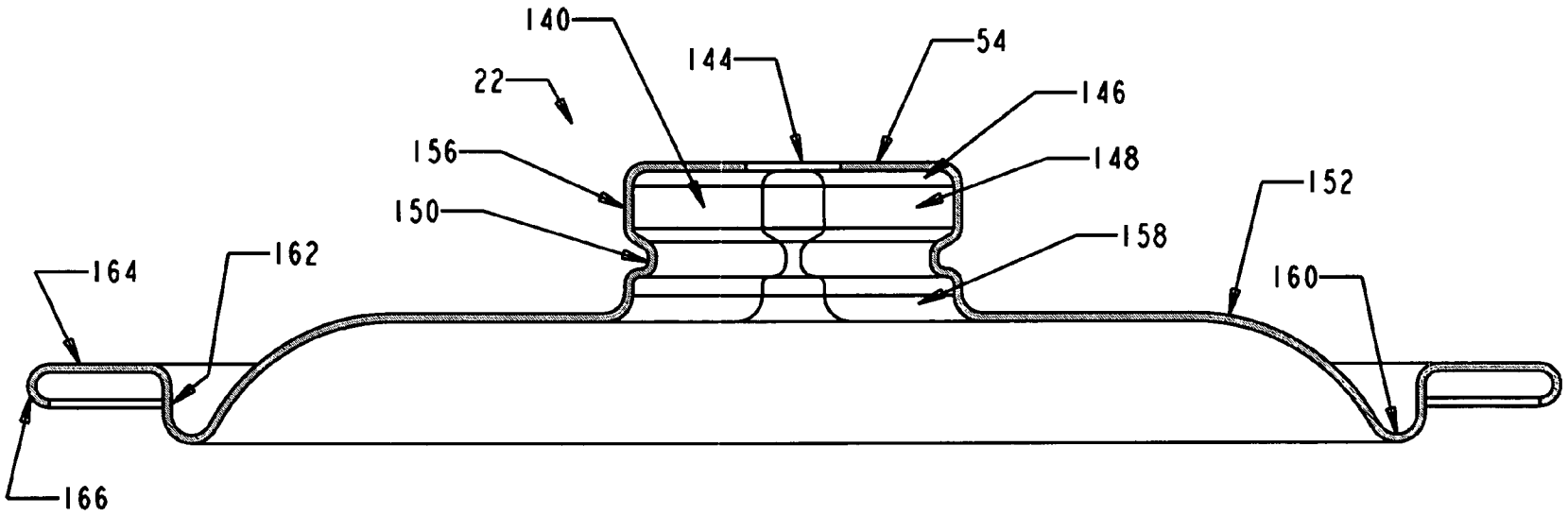
FIG. 30 is a cross-sectional side view of the dome of the present invention.
Figure 31:
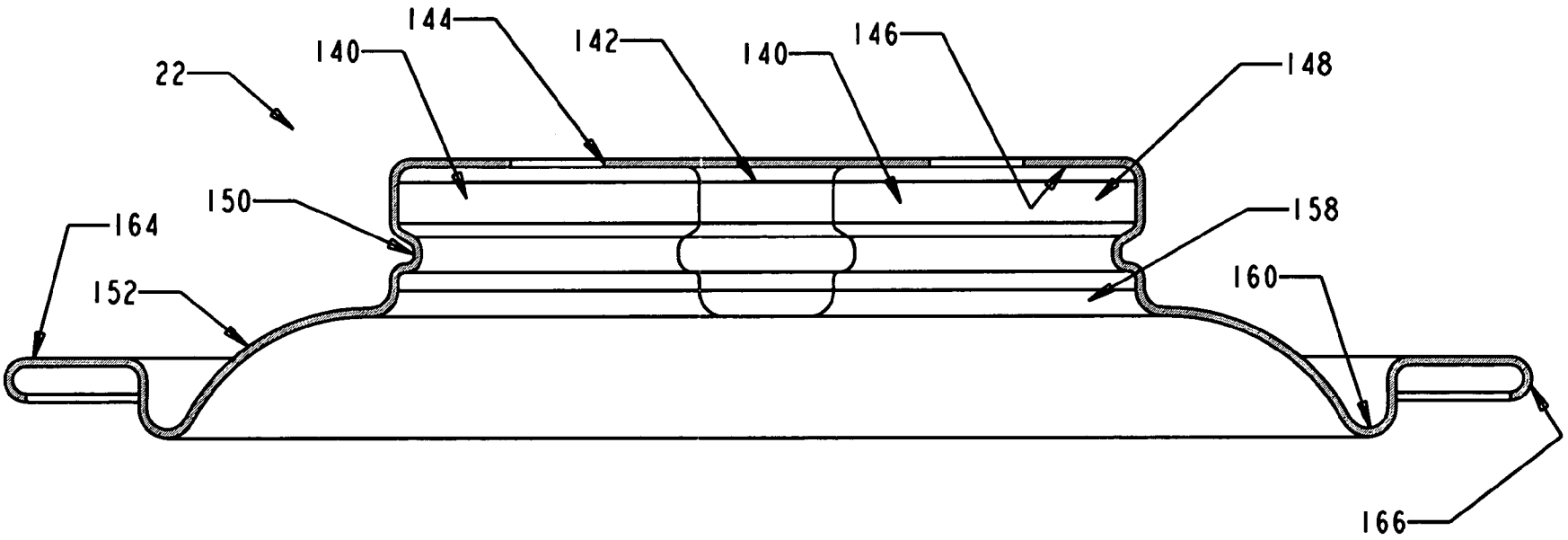
FIG. 31 is a cross-sectional front view of the dome of the present invention.
Figure 32:
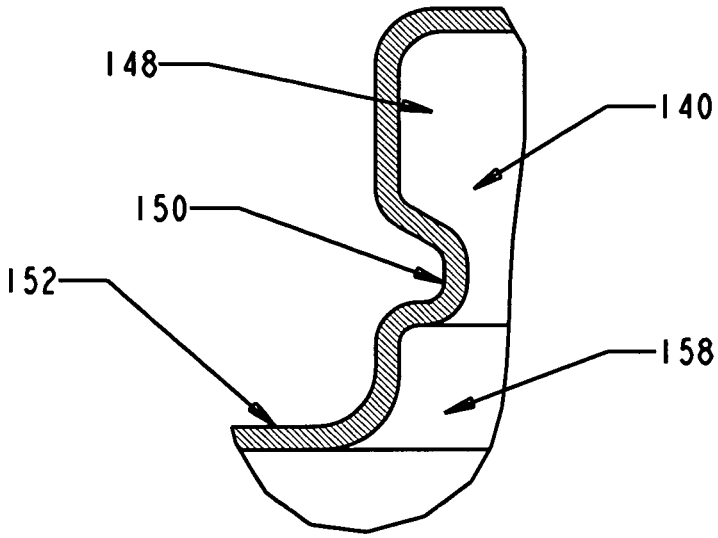
FIG. 32 is an enlarged detailed cross-sectional view of the section of the dome having a crimp.
Figure 33:
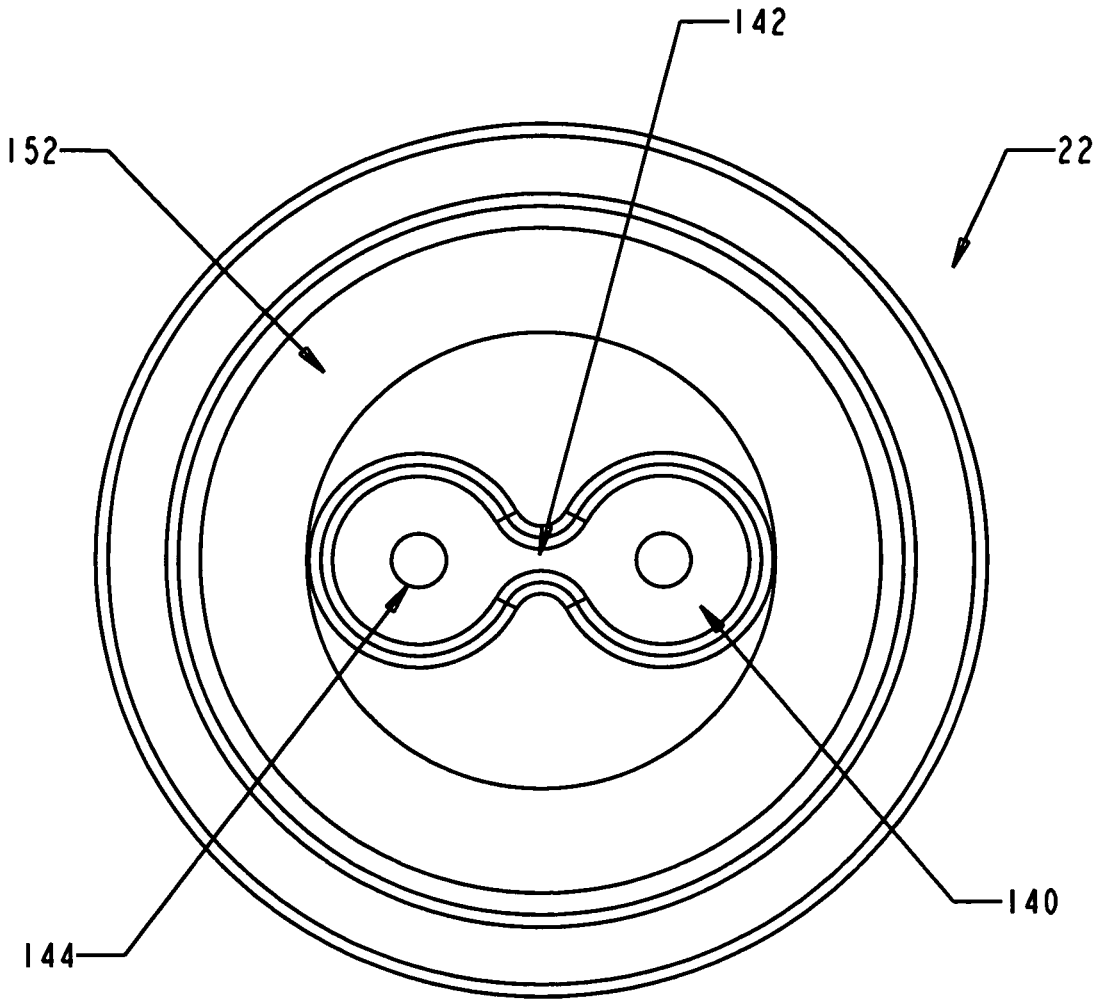
FIG. 33 is a plan view of the dome.

When the container 16 is inverted as shown in FIG. 26, the multi-valve body 4 delivers viscous materials simultaneously from the collapsible bag 66 and the omnidirectional valve 82 which is now submerged in viscous material. The viscous fluid in the omnidirectional valve 82 prevents pressurizing gas from entering the omnidirectional valve 82 when the container 16 is inverted so that pressurizing gas cannot escape through the dip tube 78.

The relative size of the central inlet orifices 46 of the multi-valve body 4 is sized to deliver the proper proportions of the viscous material to the valve plungers 6, 8. The viscous material in the bag 66 and in the container 16 is driven out by pressure from the pressurizing gas which acts upon them. The flow of materials is cut off when the actuator 79 is released.

The collapsible bag 66 is preferably constructed of foil-reinforced polyethylene, Nylon, aluminum, or other suitable material that will effectively contain the viscous materials but which is still pliable enough to collapse under pressure, like a toothpaste tube, when the first valve 62 in the multi-valve body 4 is opened.

The fourth storage and dispensing system 80 of this invention is adaptable to be used with more than two viscous materials by simply adding additional collapsible bags 66 to the container 16 and a comparable number of additional valves 62 to the multi-valve body 4.

The fourth storage and dispensing system 80 of the invention is appropriate for products where the aerosol container 16 must be operable from either the normal or inverted position and a thinner viscous material needs to be mixed with a thicker, but smaller quantity, of viscous material as it is delivered.

First Combination of Mounting Cup and Valve Housing

The novel combined mounting cup 10, 18, 20 and valve housing 81 assembly 83 to be used in the dispensing containers 16 will now be described with reference to FIGS. 11-22. A first novel mounting cup 18 of this invention is shown in FIGS. 15-22. This mounting cup 18 can be used in the mounting cup/valve housing assembly 83 to be described. The assembly 83 is intended for use with a sealed container 16. The assembly 83 comprises a conventional dome 14, mounting cup 10, 18, a valve housing 81, a multi-valve body 4, associated bags 66 or dip tubes 78 and an outer gasket (flap seal) 58 between the valve housing 81 and the mounting cup 10, 18.

As shown in FIGS. 11, 12, 15, 16, 19, and 20 for use with a female valve plunger 8, the valve housing 81 of this invention comprises a top surface 84, a bottom surface 86, an inner surface 88, and an outer surface 90.

The top 84 and bottom 86 surfaces are straight.

When the valve housing 81 is to be used with a female plunger 8, the inner surface 88 contains a lower section 92 and an upper section 94 with a right-angle shoulder 96 at the junction of these two sections 92, 94. The upper section 94 extends further inward than does the lower section 92. The shoulder 96 is separated from the plunger 6 by means of a washer or seal 36. The lower section 92 contains an annular notch 98 or protrusion 100 which mates with a corresponding annular protrusion 100 or notch 98 present in the multi-valve body 4 for maintaining the valve housing 81 and the multi-valve body 4 in contact. The upper section 94 has a straight surface.

The outer surface 90 contains a lower section 102 and an upper section 104 with a perimeter ledge 56 at the junction of these two sections 102, 104. The upper section 104 extends further inward than does the lower section 102. The perimeter ledge 56 serves as a support for the outer flap seal 58, which separates the perimeter ledge 56 from the profile portion 106 of the mounting cup 10, 18. The lower section 102 has a straight outer surface. The upper section 104 contains an annular protrusion 108 spaced above the perimeter ledge 56, which protrusion 108 contains a lower surface 110 and an upper surface 112 meeting at an apex 114. The lower surface 110 of the protrusion 108 is perpendicular to the outer surface 90 and the upper surface 112 of the protrusion 108 slants upwardly and inwardly from the apex 114 to meet with the outer surface 90.

As shown in FIGS. 13, 14, 17, 18, 21, and 22 for use with a male valve plunger 6, the valve housing 81 of this invention is the same as that for use with a female plunger 8 except that the shoulder 116 on the inner surface 88 slants downwardly and outwardly instead of being a right-angled shoulder. This slanted shoulder 116 abuts with the top surface 118 of the plunger 6 inside the housing 81.

First Mounting Cup

The first mounting cup of this invention will now be described with reference to FIGS. 11-18. According to the present invention, the central pedestal portion 120 of the conventional mounting cup is not employed. Thus, the first mounting cup 18 of the present invention includes a profile portion 106 extending outwardly from the valve housing 81, which profile portion 106 merges into an upwardly extending body portion 122, the body portion 122 merging into a hemispherically-shaped channel portion 124 terminating in a skirt portion 126, which channel portion 124 is configured to receive the bead portion 128 of the opening 12 of the conventional dome 14.

As noted above, the conventional mounting cup 10 includes a central pedestal portion 120 for crimping the dispensing valve 62, 64, a profile portion 106, which lacks a terminal, extending outwardly from the pedestal portion 120, which profile portion 106 merges into an upwardly extending body portion 122, the body portion 122 merging into a hemispherically-shaped channel portion 124 terminating in a skirt portion 126, which channel 124 is configured to receive the bead portion 128 of a conventional dome 14.

The first mounting cup 18 of the present invention does not contain a central pedestal portion. The mounting cup 18 has at least one inward terminal 130. Beginning at the inward terminal 130, a section 132 of the profile portion 106 contains a slight downward and outward slant between the inward terminal 130 and the flat section 134 of the profile portion 106 which extends outwardly. The profile portion 106 extends outwardly and curves upwardly to merge with the body portion 122 of the mounting cup 18. The body portion 122 extends upwardly to merge with a hemispherically-shaped channel portion 124 at the top edge 136 of the mounting cup 18. The channel portion 124 continues around to terminate in a downwardly directed skirt portion 126.

The annular flap seal 58 is held by the perimeter ledge 56 on the outer surface 90 of the valve housing 81. The flap seal 58 is made of compressible, resilient material which is resistant to deterioration by chemicals. Preferred materials are SBR, EPDM, Nylon, Teflon, and polypropylene. Each of these materials is well known in the aerosol gasket art.

The slight upward bend in the profile portion 106 of the mounting cup 18 coupled with the resilient property of the flap seal 58 forces the mounting cup 18 against the annular protrusion 108 on the outer surface 90 of the valve housing 81 and keeps the mounting cup 18 in place. The mounting cup 18 may be made in sizes of the standard one-inch diameter to fit the standard one-inch aperture 12 of conventional aerosol containers 16 or it may take the form of a dome 22 and cover the entire opening of a dispensing container 16 as is preferred in the present invention.

Second Mounting Cup

The second novel mounting cup 20 of this invention will now be discussed with reference to FIGS. 19-22.

With reference to FIGS. 19-22, a second mounting cup 20 of the present invention is preferably used in combination with a female 8 or male 6 plunger, a multi-valve body 4, and a valve housing 81. The specific improvement presented by this embodiment of the invention over the prior art is an improved combination of a valve housing 81 and a mounting cup 20 which does not require a separate gasket.

Figure 19:
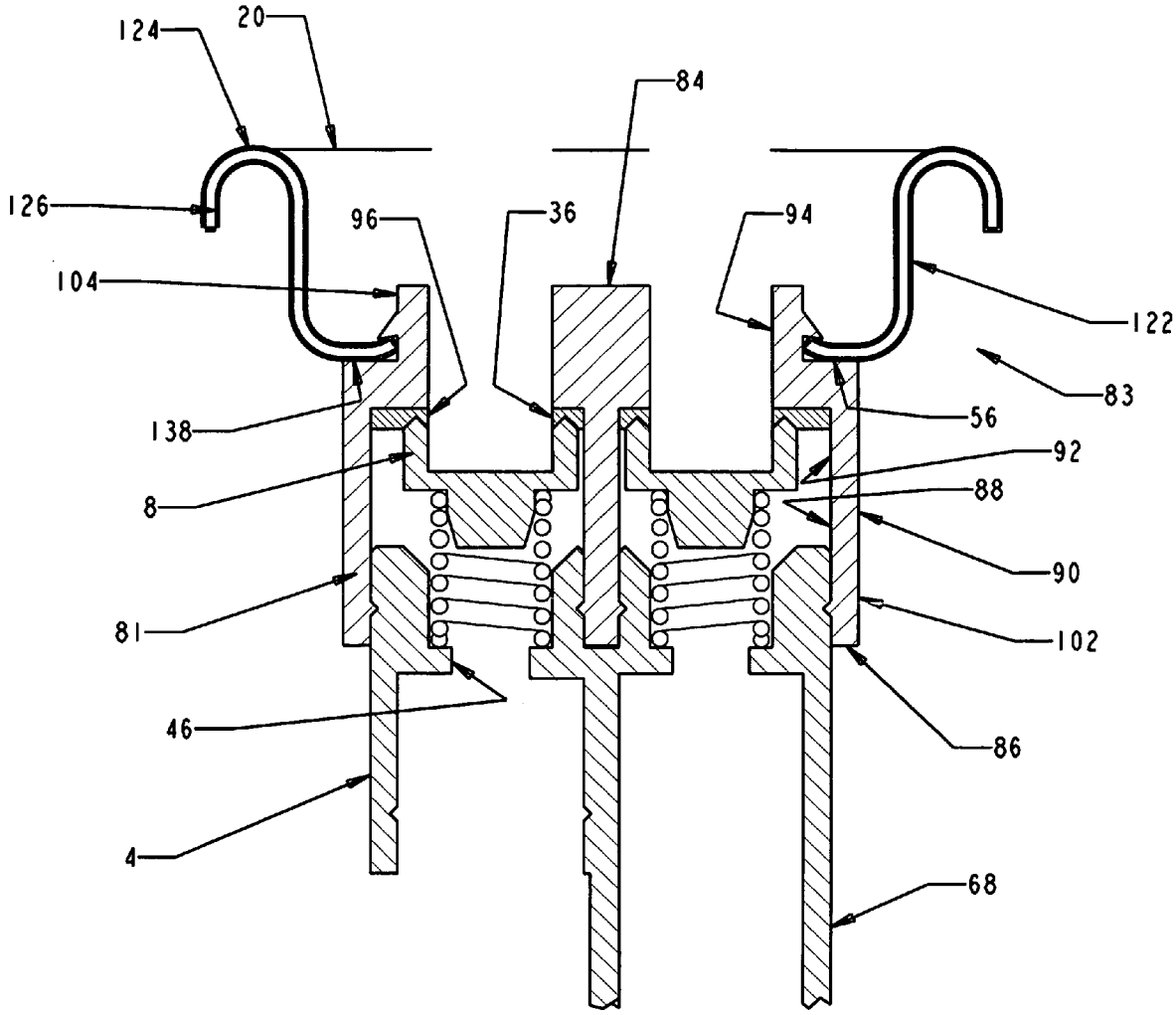
FIG. 19 is an enlarged detailed cross-sectional front view of a combination having a second mounting cup and two female valves according to this invention.
Figure 20:
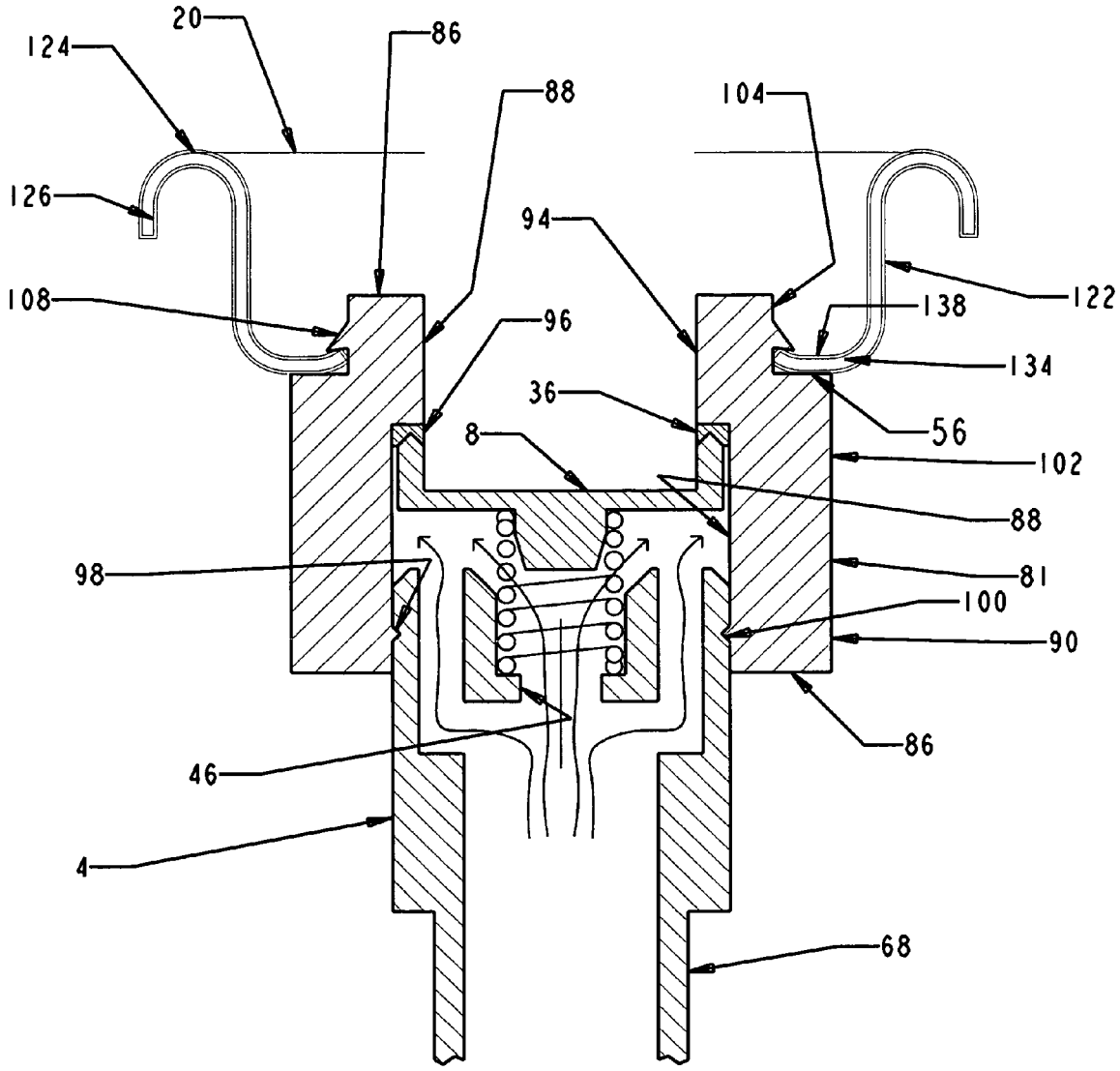
FIG. 20 is an enlarged detailed cross-sectional side view of a combination having a second mounting cup and two female valves according to this invention.

For use with a female valve plunger 8, shown in FIGS. 19 and 20, the valve housing 81 of this embodiment of the invention comprises a top surface 84, a bottom surface 86, an inner surface 88, and an outer surface 90.

The top 84 and bottom 86 surfaces are straight.

As in the first novel mounting cup 18, the inner surface 88 of the valve housing 81 contains a lower section 92 and an upper section 94 with a right-angle shoulder 96 at the junction of these two sections 92, 94. The upper section 94 extends further inward than does the lower section 92. The shoulder 96 is separated from the plunger 8 by means of a washer or seal 36. The lower section 92 contains an annular notch 98 or protrusion 100 which mates with a corresponding annular protrusion 100 or notch 98 present in the multi-valve body 4 for maintaining the valve housing 81 and the multi-valve body 4 in contact. The upper section 94 has a straight surface.

In this embodiment, the outer surface 90 contains a lower section 102 and an upper section 104 with a right-angle perimeter ledge 56 at the junction of these two sections 102, 104. The upper section 104 extends further inward than does the lower section 102. The perimeter ledge 56 serves as a support for the profile portion 106 of the mounting cup 20. The lower section 102 has a straight outer surface 90. The upper section 104 contains an annular protrusion 108 spaced above the perimeter ledge 56, which protrusion 108 contains a lower surface 110 and an upper surface 112 meeting at an apex 114. The lower surface 110 of the protrusion 108 is perpendicular to the outer surface 90 and the upper surface 112 of the protrusion 108 slants upwardly and inwardly from the apex 114 to meet with the outer surface 90.

Figure 21:
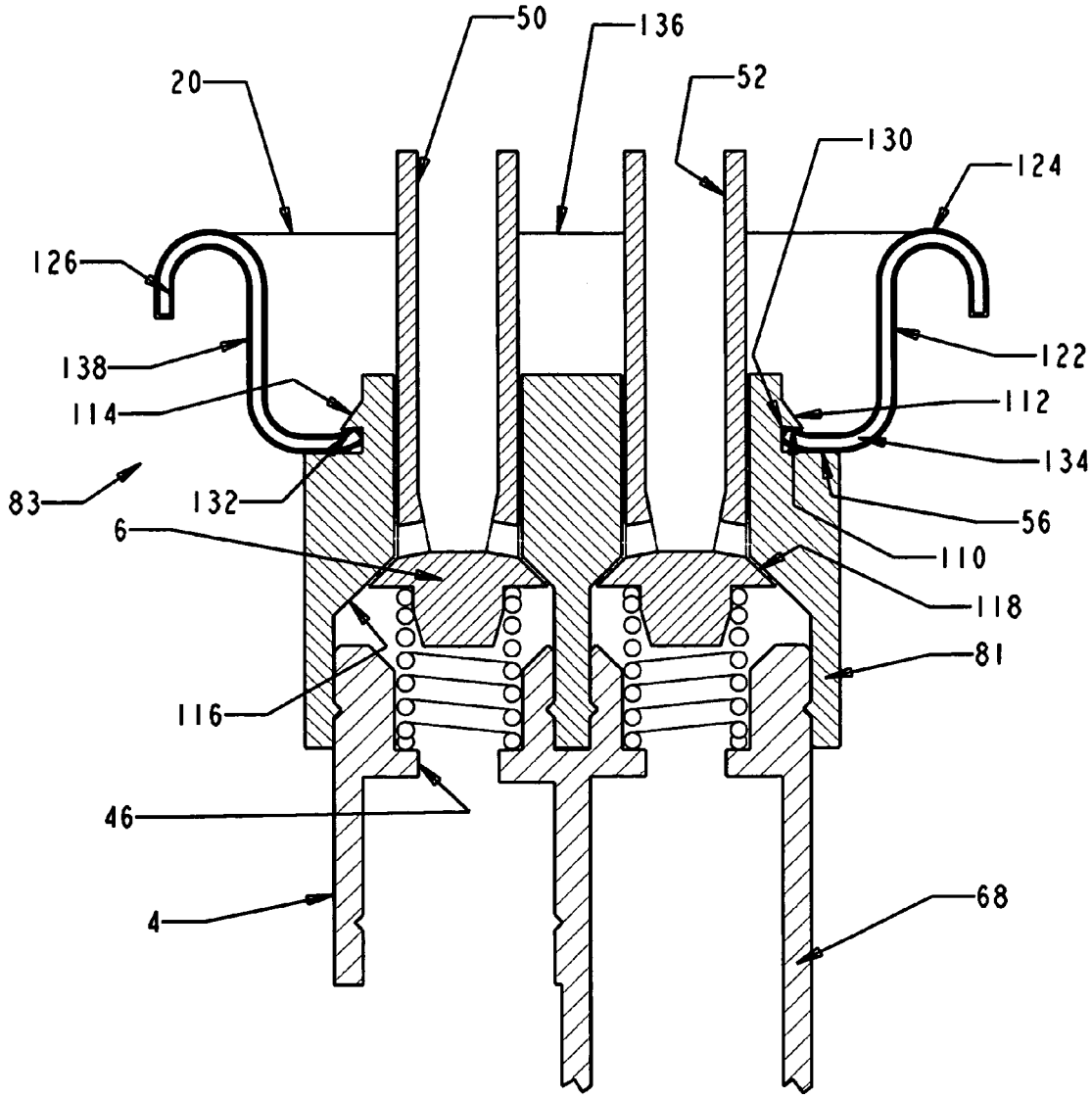
FIG. 21 is an enlarged detailed cross-sectional front view of a combination having a second mounting cup and two male valves according to this invention.
Figure 22:
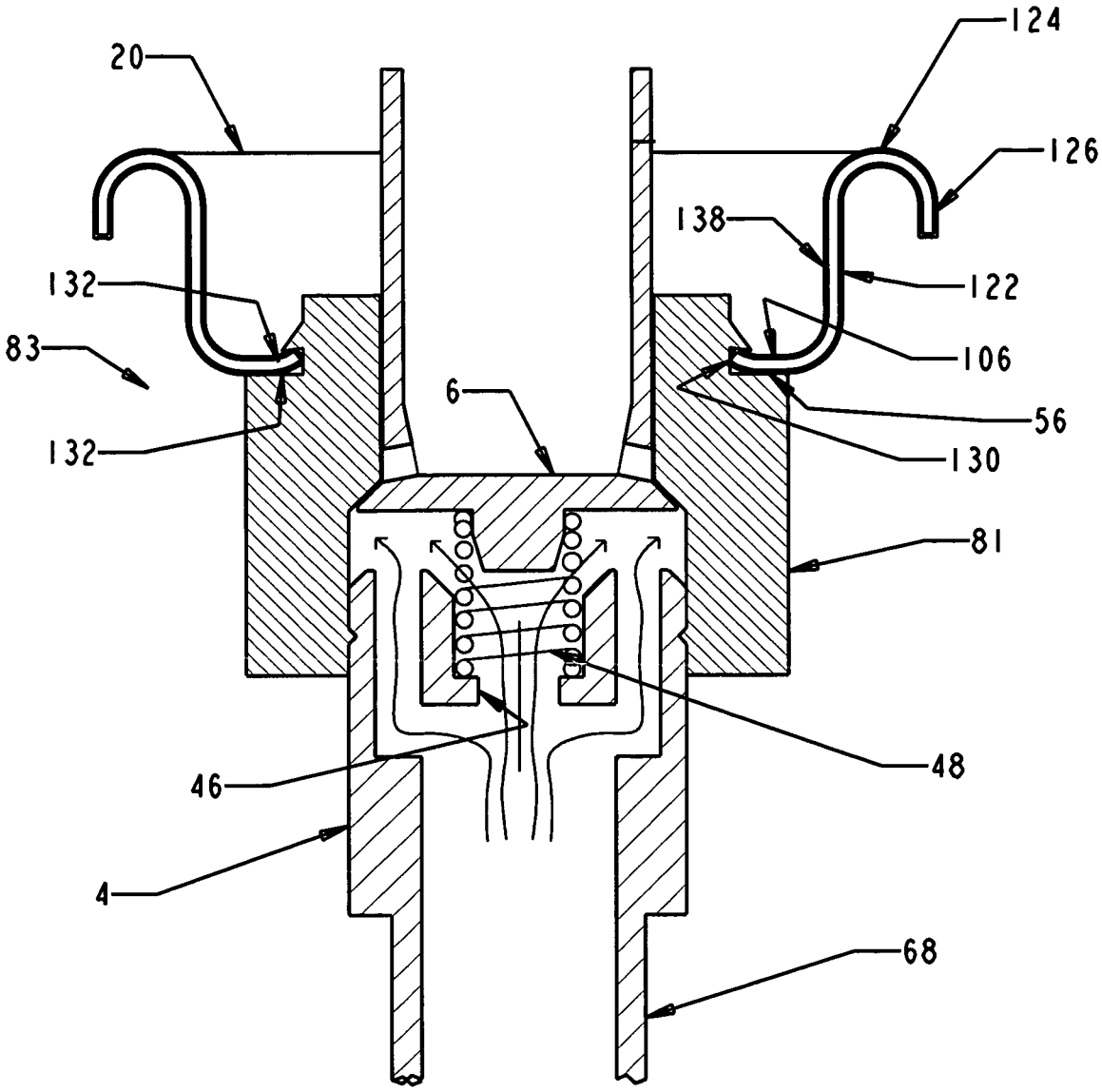
FIG. 22 is an enlarged detailed cross-sectional side view of a combination having a second mounting cup and two male valves according to this invention.
Figure 23:
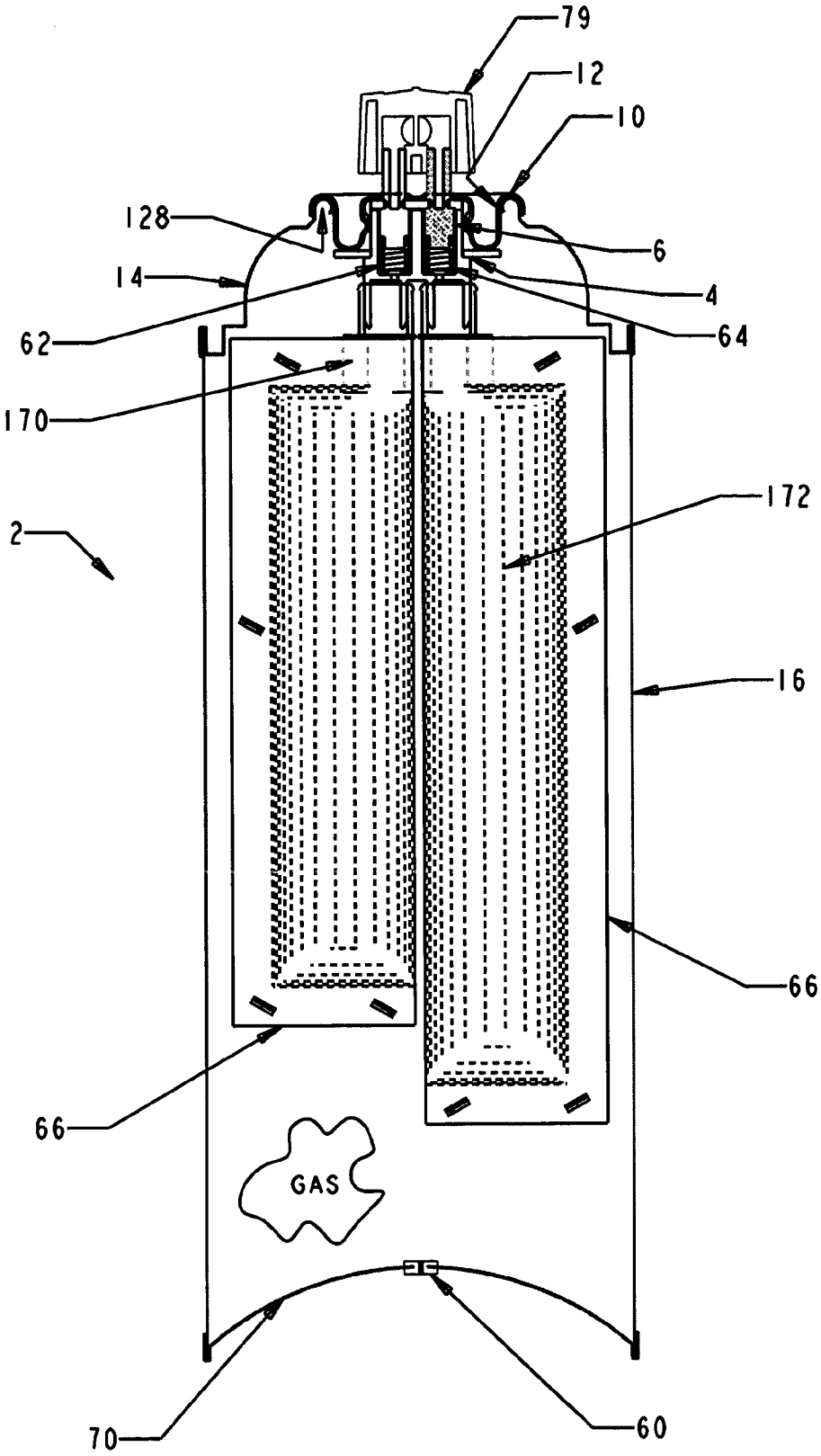
FIG. 23 is a cross-sectional front view of a pressurized aerosol container using the multi-valve dispensing system of this invention in combination with a two-bag storage arrangement.

With reference to FIGS. 21 and 22, when the valve housing 81 of this embodiment is used with a male valve plunger 6, the valve housing 81 of this embodiment of the invention is the same as that for use with a female plunger 8 except that the shoulder 96 on the inner surface 88 slants downwardly and outwardly instead of being a right-angled shoulder. This slanted shoulder 96 abuts with the top surface 118 of the plunger 6 inside the housing 81.

The second novel mounting cup 20 of this invention is essentially the same in appearance as that of the first novel mounting cup and does not contain a conventional central pedestal portion. The mounting cup 20 has an inward terminal 130. Beginning at the inward terminal 130, a section 132 of the profile portion 106 contains a slight downward and outward slant between the inward terminal 130 and the flat section 134 of the profile portion 106 which extends outwardly. The profile portion 106 extends outwardly and curves upwardly to merge with the body portion 122 of the mounting cup 20. The body portion 122 extends upwardly to merge with a hemispherically-shaped channel portion 124 at the top edge 136 of the mounting cup 20. The channel portion 124 continues around to terminate in a downwardly directed skirt portion 126.

The second novel mounting cup 20 of this invention is encased in a film 138 which performs the function of a gasket. The film 138 is made of compressible plastic such as Nylon or polypropylene.

According to the present invention, the mounting cup 10, 18, 20 may be of such a size as to fit into the conventional one-inch aperture 12 in the dome 14 of the container 16 as shown in FIGS. 11-26.

In any of the embodiments, the combination of the mounting cup 10, 18, 20, multi-valve body 4, valve housing 81, and the bags 66 (or bag 66 and dip tube 78) may be pre-assembled prior to insertion into the container 16 as a single unit.

In assembling the novel mounting cup 18, 20 and the valve housing 81, crimping is not necessary. The inward terminal 130 of the mounting cup 18, 20 simply clicks into place. Accordingly, in either situation, the valve housing 81 may partially enclose the multi-valve body 4 and a dip tube 78 may easily snap-fit with the appropriate valve inlet opening 46 of the multi-valve body 4. Thus, it may be seen that when the mounting cup 18, 20 is used in the standard one-inch hole 12 of a dome 14 the use of this invention allows a multi-valve body 4 in a single container 16, allows the elimination of the crimping process, and allows for the elimination of a gasket. The multi-valve body 4 may carry pre-expanded bags 66 or a pre-expanded bag 66 and a dip tube 78.

First Dome

A first new multi-pedestal dome 22 is part of the present invention. This dome 22 is shown in FIGS. 27-33. The dome 22 features at least one, preferably two, raised pedestals 140 which are connected to each other by a raised bridge 142. Each pedestal 140 contains a centrally located orifice 144 for receiving a valve plunger 6, 8. The tops 146 of the raised pedestals 140 are flat. The raised pedestals 140 have substantially vertical side portions 148 interrupted by a centrally directed indentation 150 for crimping with the dome cover 152. The pedestals 140 are tightly covered by a dome cover 152, the top 154 of which extends across tops 146 of the pedestals 140 and the bridge 142. The vertical sides 156 of the dome cover 152 extend downwardly from the top 146 and are crimped to the sides 148 of the pedestals 140. From the bottom 158 of the raised pedestals 140, the dome cover 152 follows a downward and outward path to end in an exterior depression 160. From the outside edge of the depression 160, the dome cover 152 rises vertically forming an exterior wall 162, turns sharply outwardly forming a ledge 164, and curves downwardly and inwardly forming a skirt 166. The dome cover 152 is of such a size as to be capable of covering the top opening of the container 16. The skirt 166 is crimped to the bead 168 of the container 16. Using this double-crimp dome 22, the need for a mounting cup is avoided and the bags 66 for the viscous materials can be pre-inflated prior to being placed into the container 16 as the bags 66 no longer have to pass through a one-inch hole for a mounting cup.

Second Dome

Figure 41:
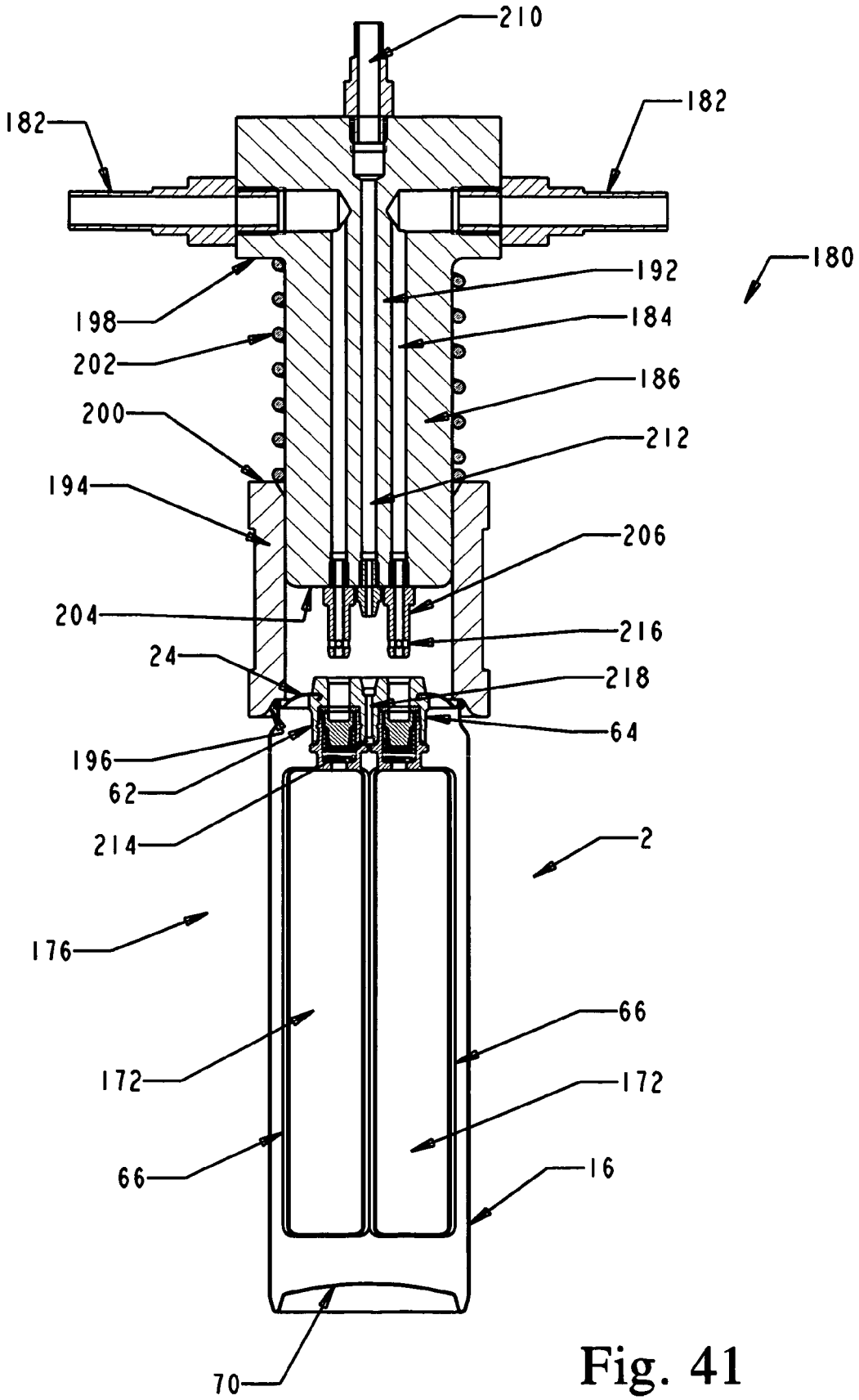
FIG. 41 is a front cross-sectional view of the filling machine in combination with a container of the present invention wherein the container is covered by a dome according to the present invention wherein the filling head is separated from the valves.
Figure 42:
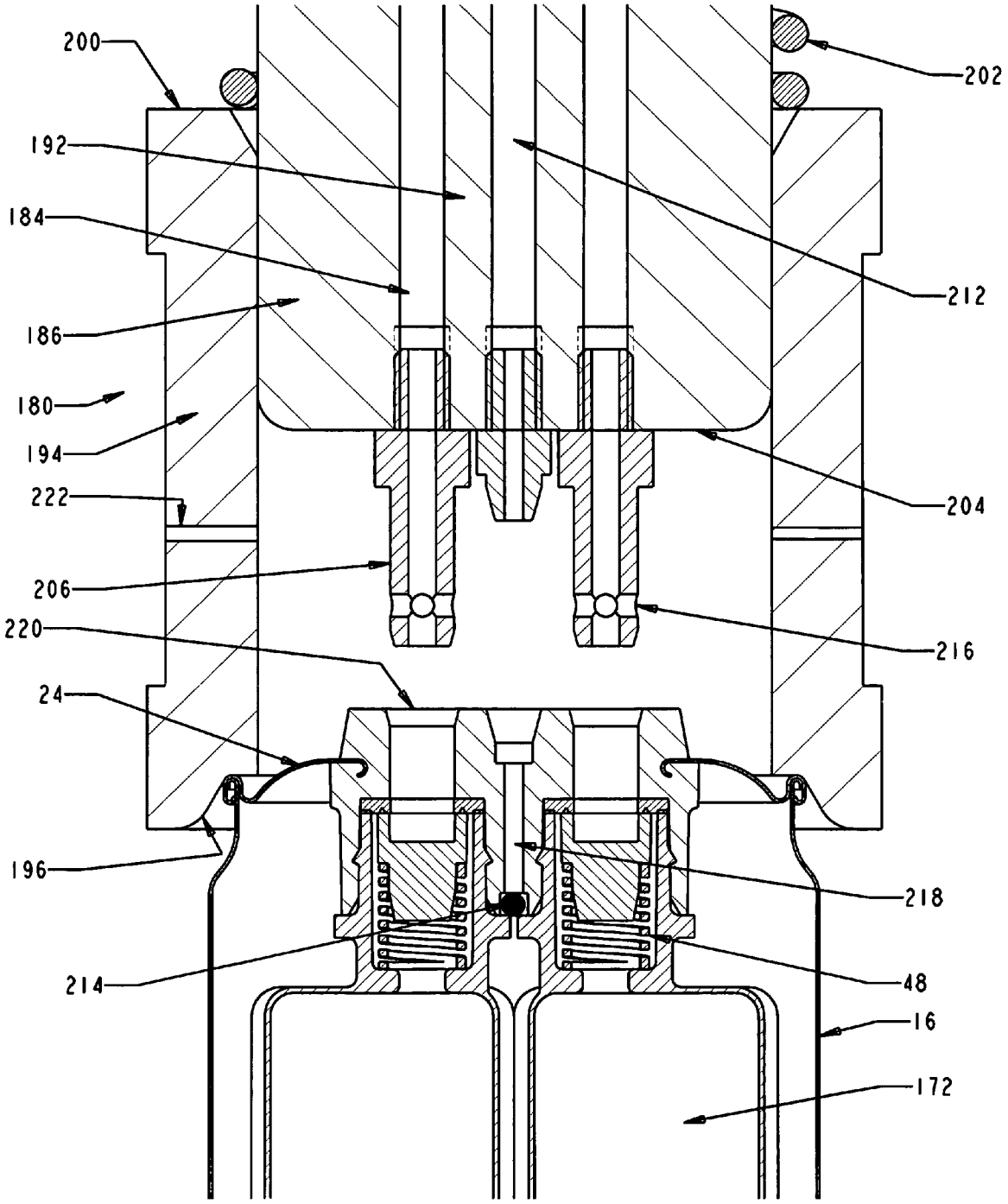
FIG. 42 is a front cross-sectional view of the filling machine of this invention in combination with a container of this invention which is enlarged to show details of fluid control means.
Figure 43:
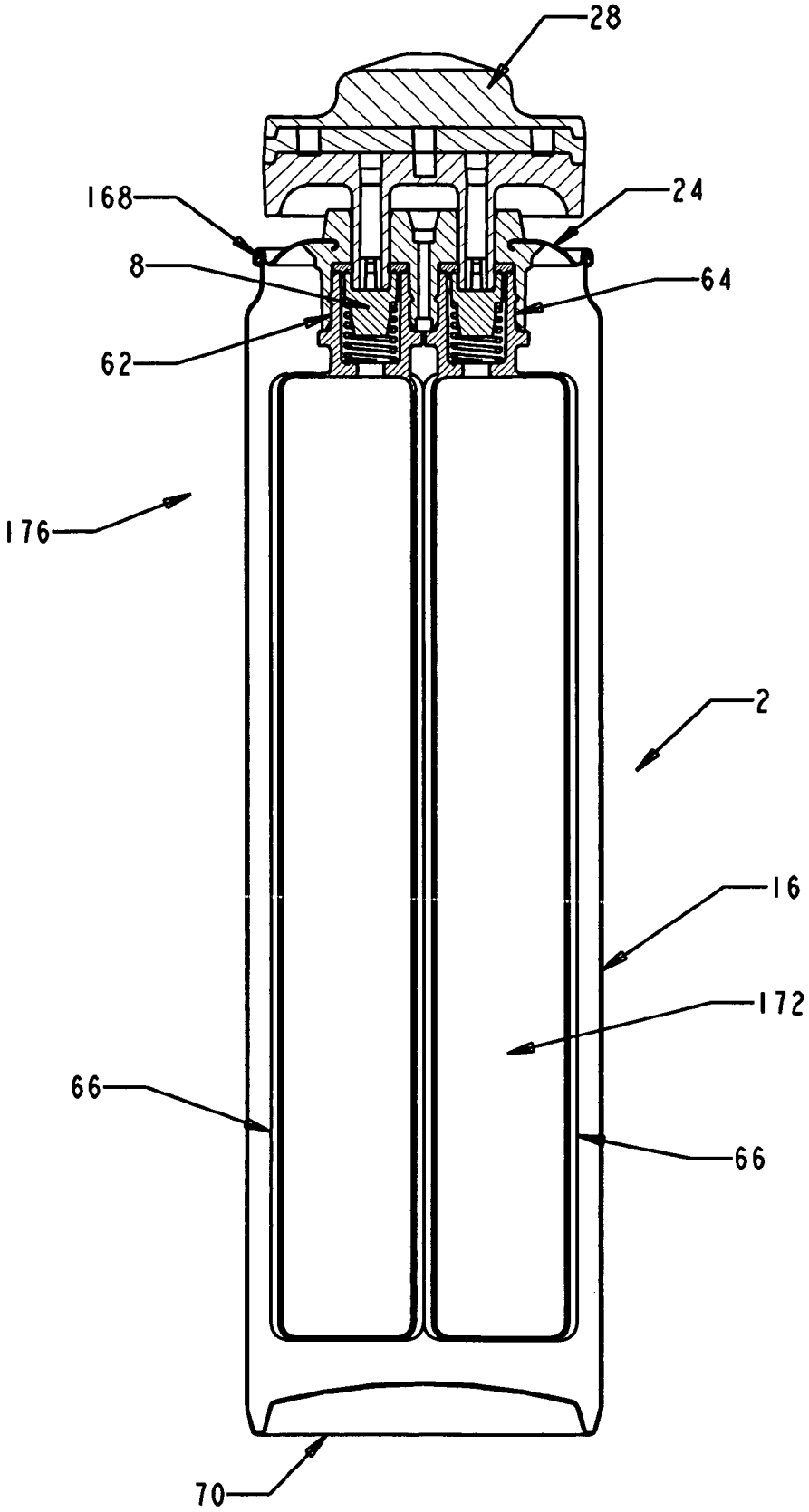
FIG. 43 is a front cross-sectional view of a container of the present invention in combination with a static mixing device of the present invention.
Figure 44:
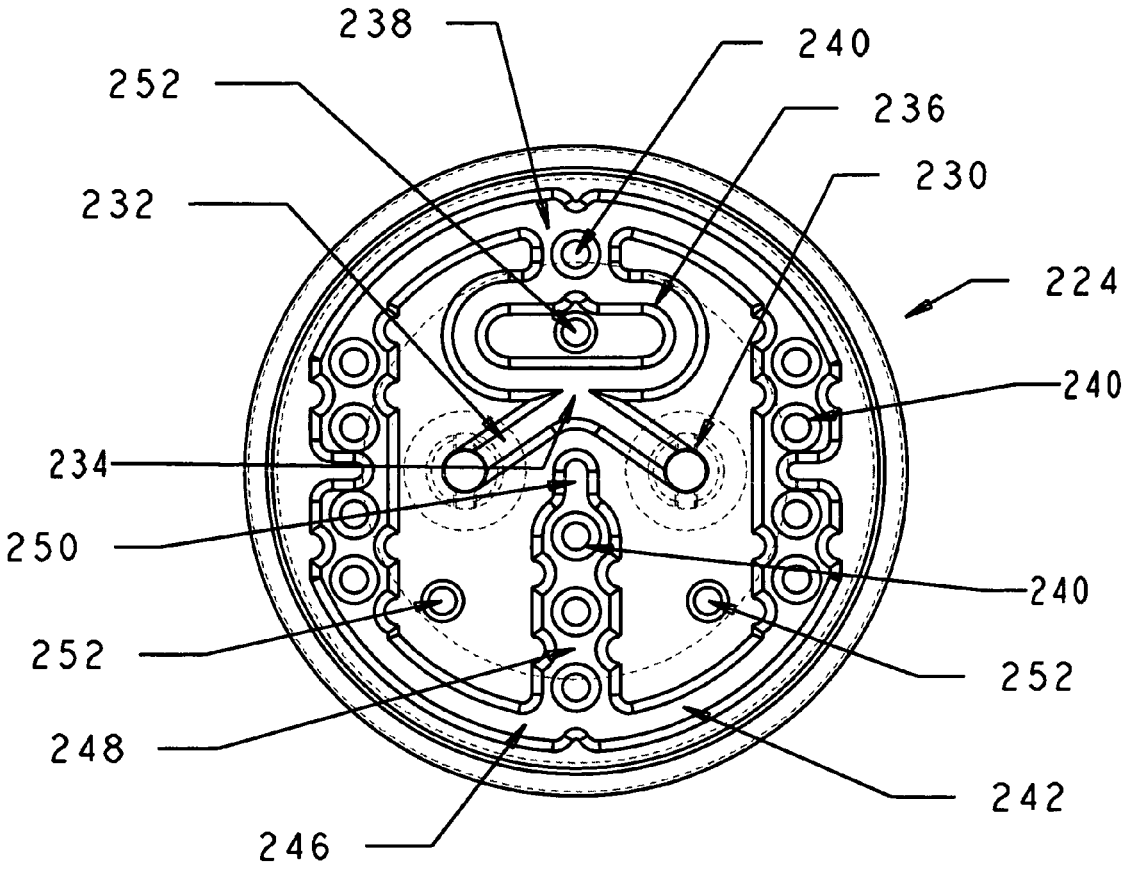
FIG. 44 is a plan view of a first static mixing component of the static mixing device of this invention.
Figure 45:
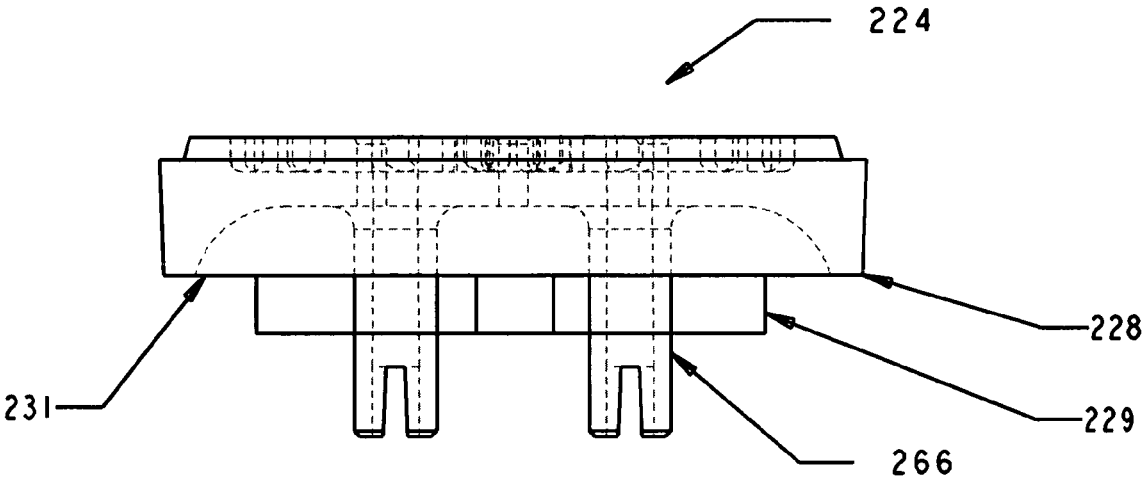
FIG. 45 is a front elevational view of a first static mixing component of the static mixing device of this invention.
Figure 46:
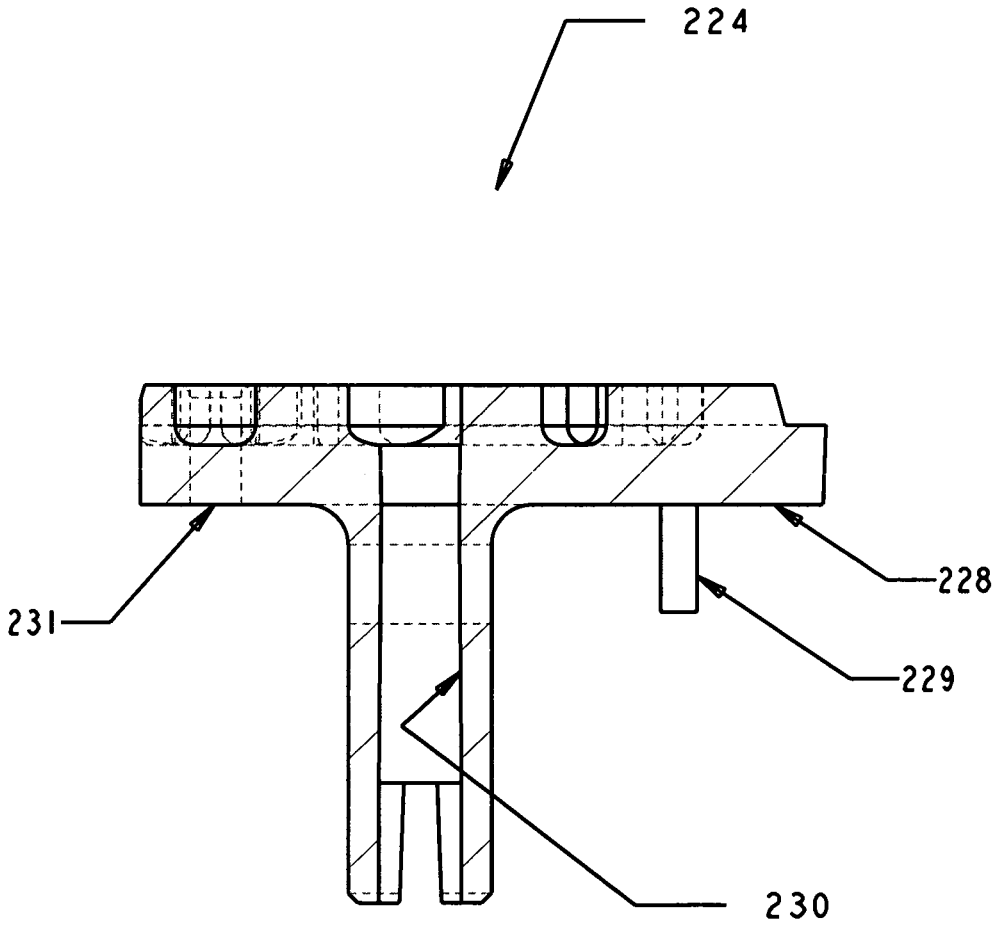
FIG. 46 is a vertical cross-sectional side view, in detail, of a portion of the first static mixing component of the static mixing device of this invention.
Figure 47:
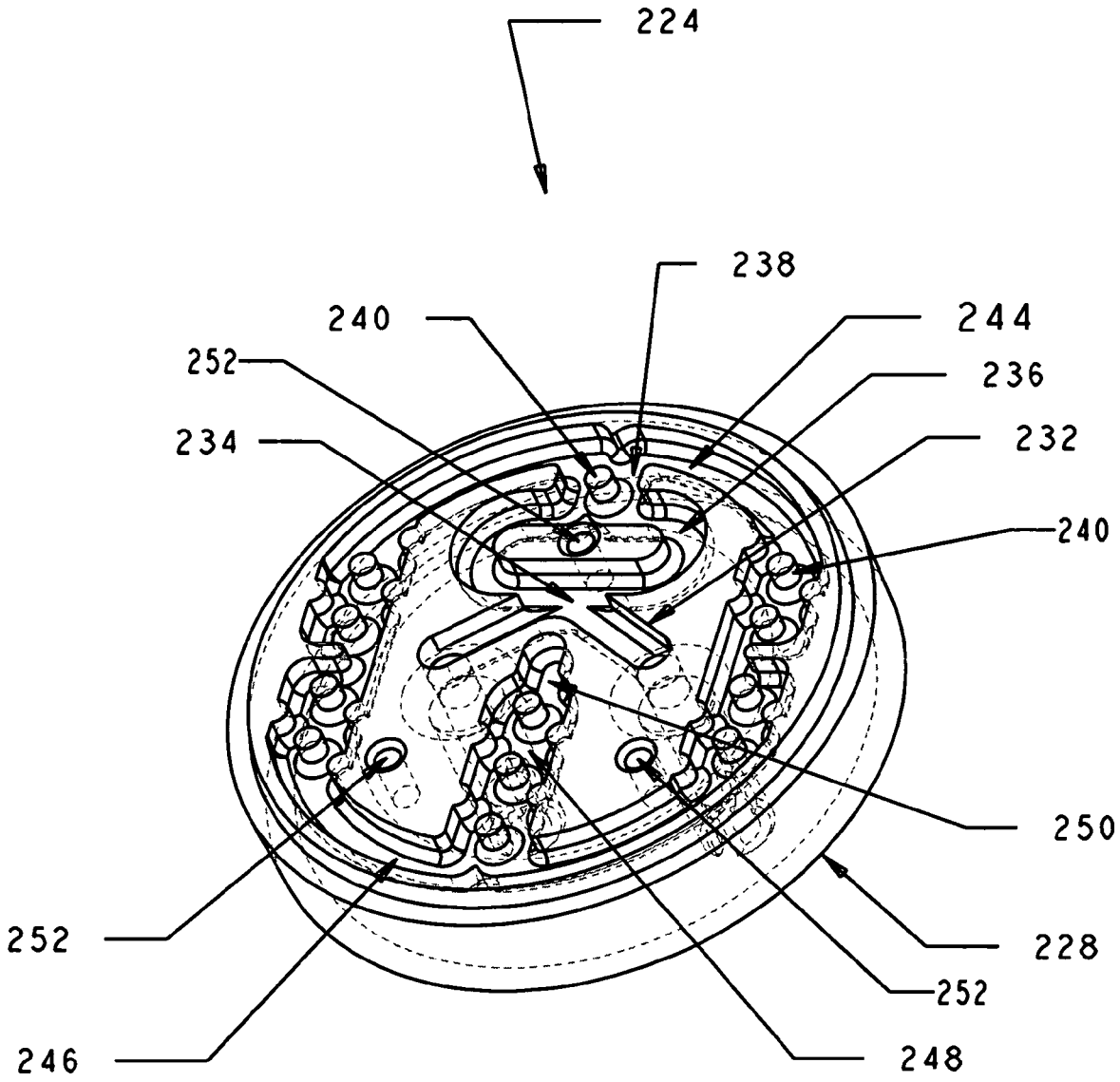
FIG. 47 is a top elevational perspective view of a first static mixing component of the static mixing device of the present invention.
Figure 48:
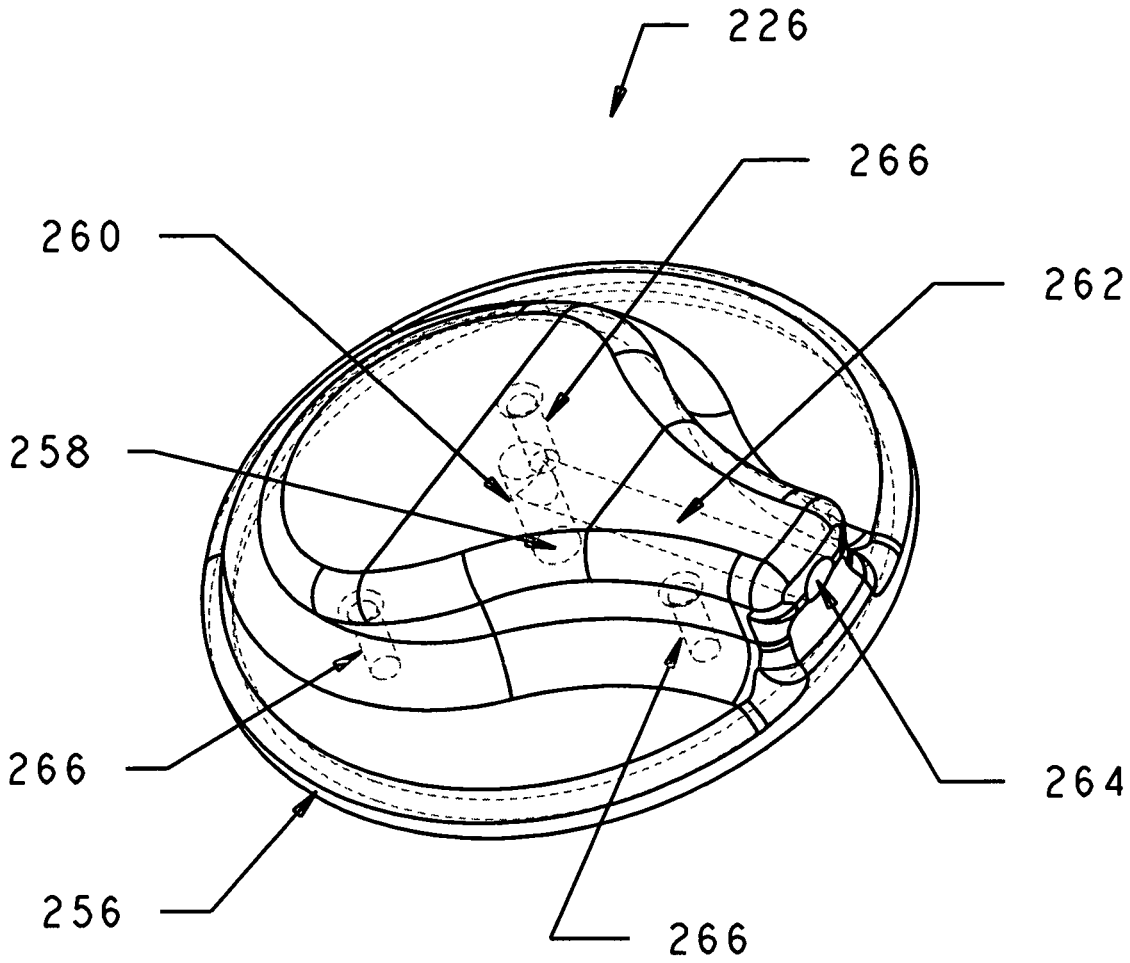
FIG. 48 is a top elevational perspective view of the dispensing component of the static mixing device of the present invention.
Figure 49:
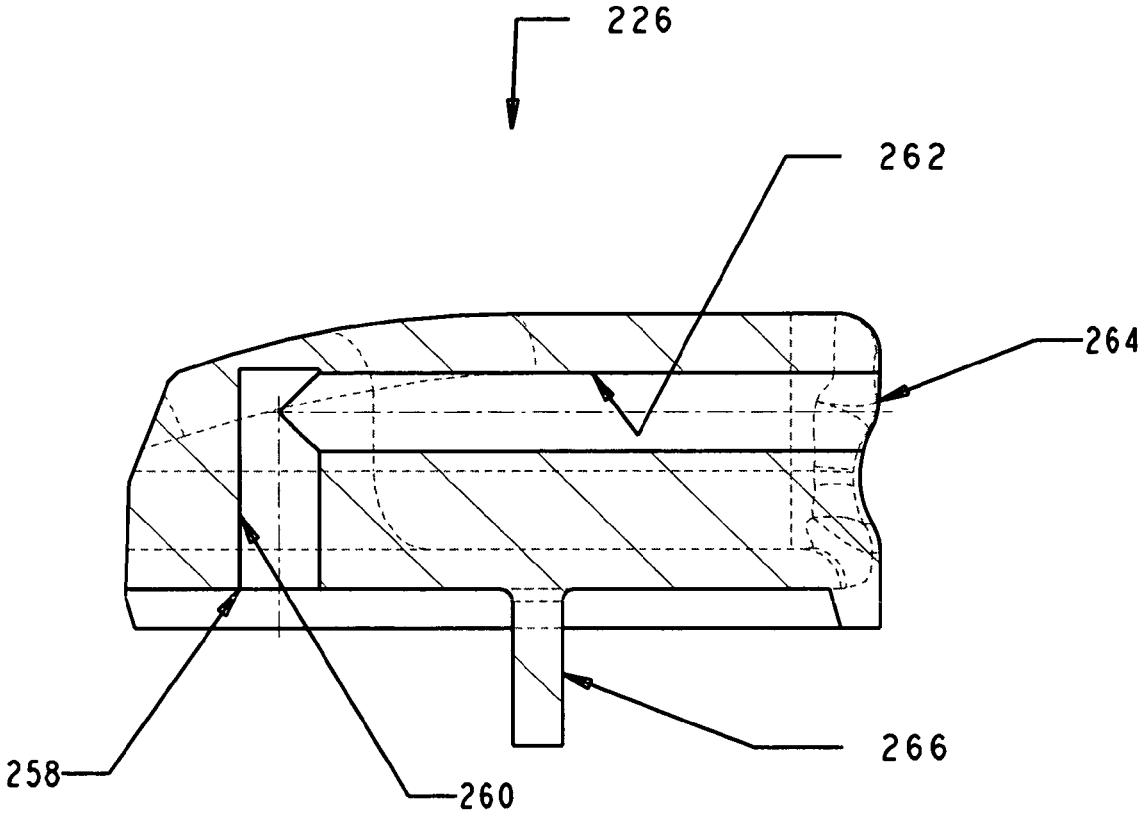
FIG. 49 is a vertical cross-sectional side view, in detail, of a portion of the dispensing component of the static mixing device of the present invention.
Figure 50:
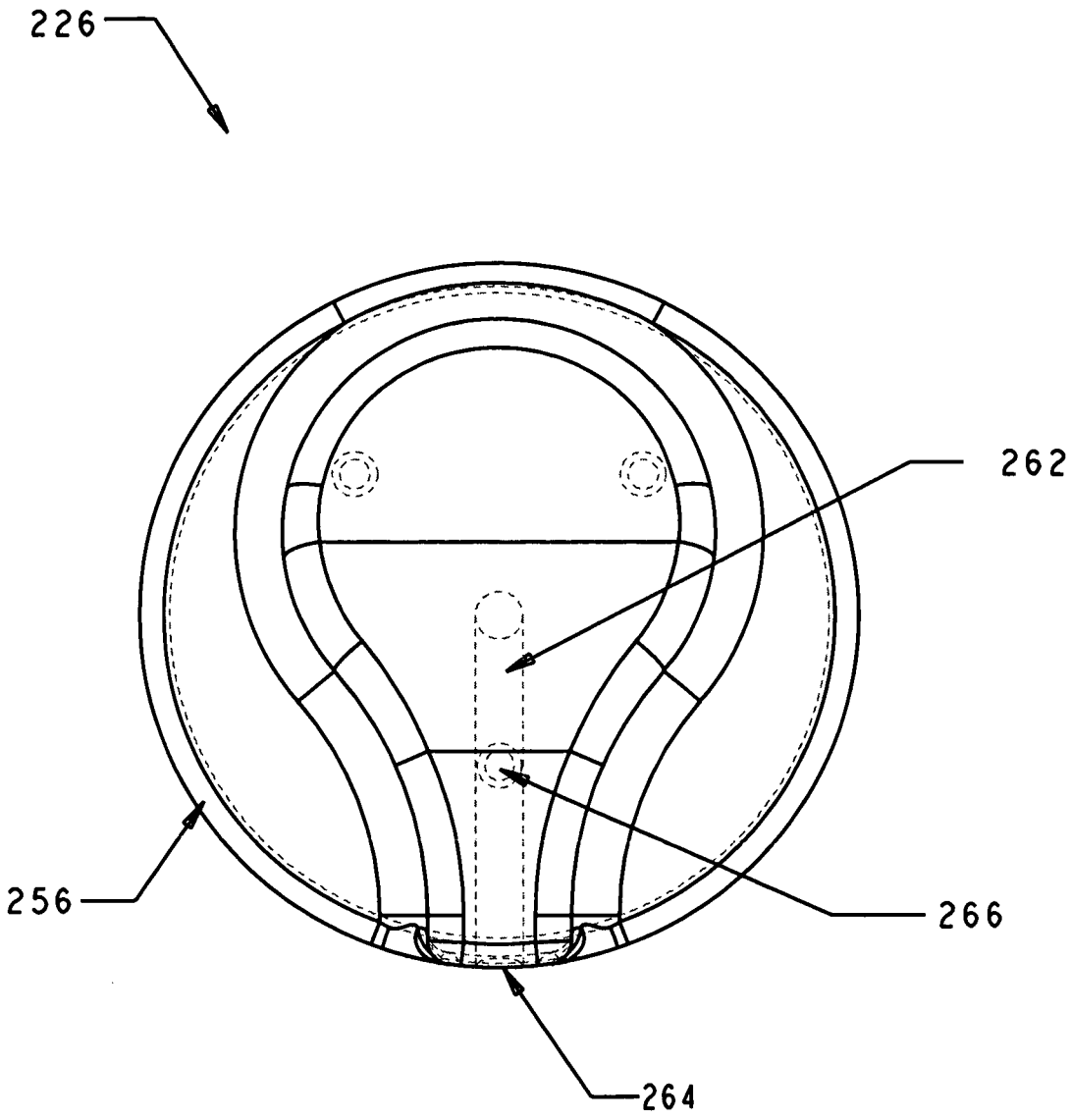
FIG. 50 is a plan view of the dispensing component of the static mixing device of the present invention.
Figure 51:
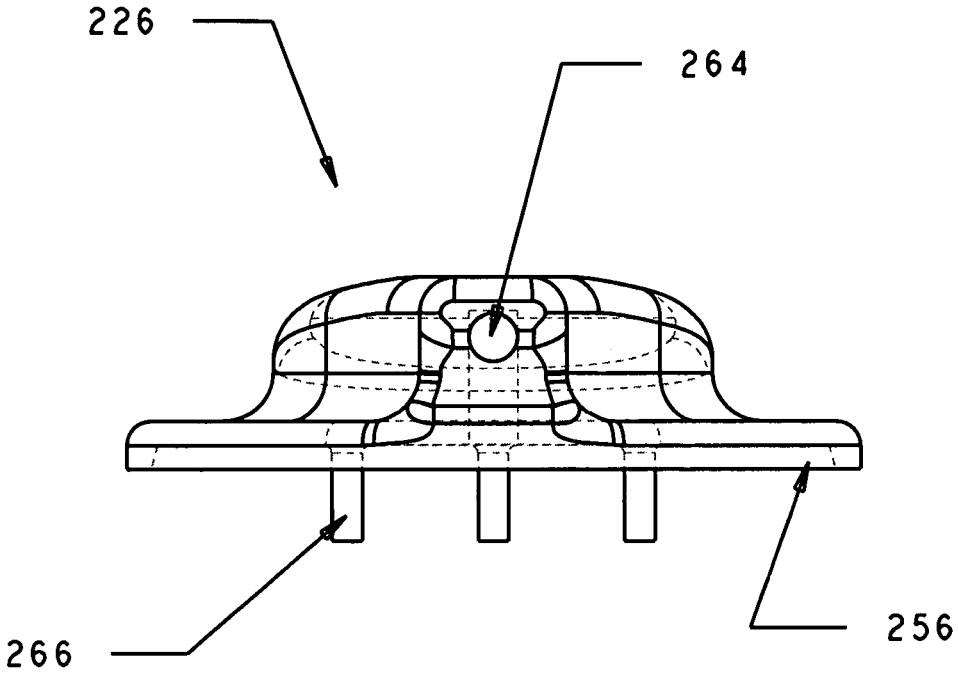
FIG. 51 is a front elevational view of the dispensing component of the static mixing device of the present invention.
Figure 52:
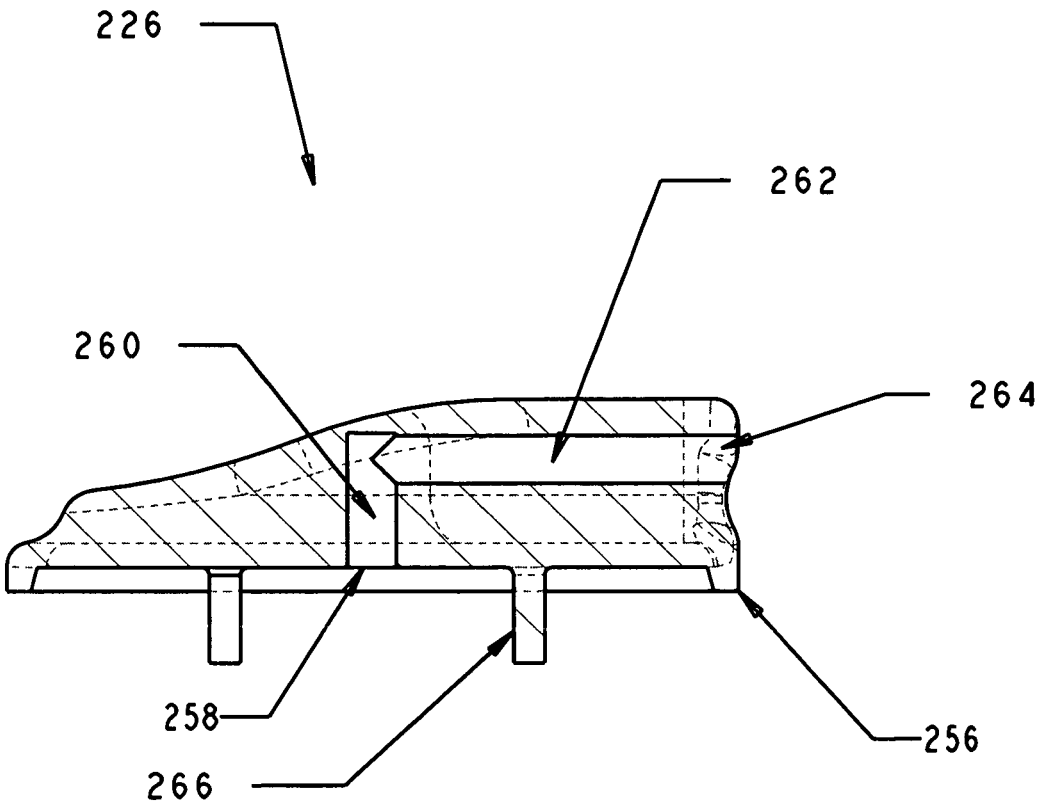
FIG. 52 is a vertical cross-sectional side view of the dispensing component of the static mixing device of this invention.
Figure 53:
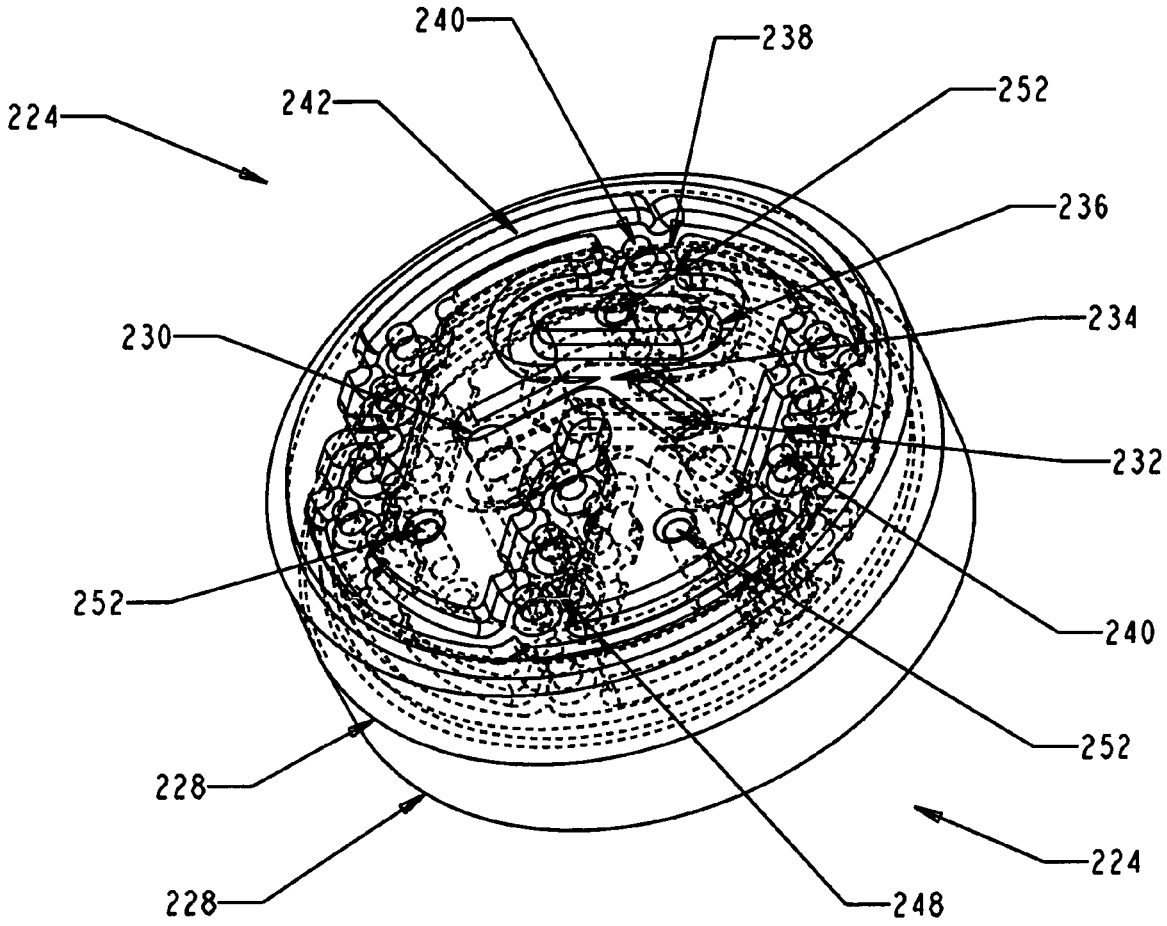
FIG. 53 is a top elevational perspective view of the second mixing component of the static mixing device of the present invention in stacked arrangement with the first mixing component.
Figure 54:
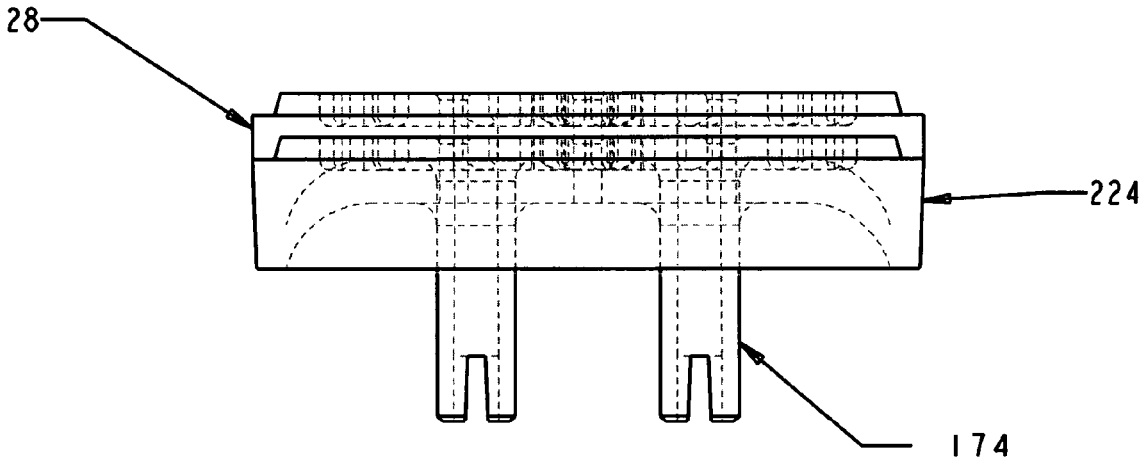
FIG. 54 is a front cross-sectional view of the dispensing component of the static mixing device of the present invention in stacked arrangement with the first mixing component.

A second new dome 24 is shown in FIGS. 41-43. In the second new dome 24 of this invention, the dome 24 is made of metal and the valve housing 81 is made of plastic. The combination of the dome 24 and the valve housing 81 is prepared by an overmolding process so that the inner edge of the dome 24 is embedded in the valve housing 81 and the dome 24 curves downwardly and outwardly to end in an exterior depression 160. The process of overmolding is well known, and is shown in U.S. Pat. No. 4,113,627 granted to Leason on Sep. 12, 1978. From the outside edge of the depression 160, the dome 24 rises vertically forming an exterior wall 162, turns sharply outwardly forming a ledge 164 and curves downwardly and inwardly forming a skirt 166. The dome 24 is of such a size as to be capable of covering the top opening 148 of the container 16. The skirt 166 is crimped to the bead 168 of the container 16. Using this overmolded dome 24, the need for a mounting cup is avoided and the bags 66 for the viscous materials can be pre-inflated prior to being placed into the container 16 as the bags 66 no longer have to pass through a one-inch hole for a mounting cup.

First Pre-Assembly

In preparing the one-piece assembly made up of the dome 22, 24, the valve housing 81, the multi-valve body 4 and the bag(s) 66, the bags 66 are prepared in such a way that the necks 170 of the bags 66 are injection molded in a die and the bodies 172 of the bags 66 are blow-molded and the necks 170 of bags 66 are attached to the valve stems 68 of the multi-valve body 4. Preferably, the neck 170 of a bag 66 is offset from the central axis of the bag 66. The springs 48 are then inserted onto the valve body 4. A washer or seal 36 is then placed onto the top part of a female valve 8, if used and the valve housing 81 is applied. The first new dome 22 may be combined by crimping. This process results in a combination of the dome 24, the valve housing 81, the multi-valve body 4, and the bag(s) 66. The resulting combination is referred to as the first pre-assembly 174. The bags 66 are then pre-inflated and the resulting unit is inserted into the open container 16 and the skirt 166 of the dome 24 is mechanically sealed to the bead 168 of the container 16 by rolling.

Second Pre-Assembly

A second pre-assembly 176 will now be described. The second novel dome 24 of the present invention is prepared by overmolding the plastic valve housing 81 and the metal portion of the dome 24. The process of overmolding is known in the art. In this method, a single piece of thermoplastic material is presented, a portion of the thermoplastic material is injection molded to form a bag neck 170 and the remainder of the piece is blow molded to form a bag body 172. The necks 170 of the bags 66 which are injection molded in a die, the bodies 172 of the bags 66 which are blow-molded and the compression springs 48 are inserted onto the valve body 4. A washer or seal 36 is placed onto the top part of a female valve 8, if used. The bags 66 are attached to the valve stems 68 of the valve body 4 and the valve housing 81 is applied along with the remainder of the second new dome 24. This process results in a combination of the dome 24, the valve housing 81, the multi-valve body 4, and the bag(s) 66. The resulting combination is referred to as the second pre-assembly 176. The bags 66 are then pre-inflated and the resulting unit is inserted into the open container 16 and the skirt 166 of the dome 24 is mechanically sealed to the bead 168 of the container 16 by rolling.

Second Combination of Mounting Cup and Valve Housing

An additional embodiment of the present invention may use any of the combinations of bags 66 and dip tubes 78 as set forth in the above description. It will be recalled that in accordance with the above description, the bags 66 and dip tubes 78 could be attached to the valve body 4. The valve body 4 was combined with the valve housing 81 and the mounting cup 10, 18, 20. The mounting cup 10, 18, 20 was then fitted onto the 1-inch hole 12 in the conventional dome 14. In the embodiment to be described, there is a one-piece assembly made up of the novel dome 24, the valve housing 81, the multi-valve body 4 and the bag(s) 66. The dome 24 fits across the entire top opening of the container 16. There is no mounting cup. With the use of this unique combination, an additional crimping step is eliminated and expanded bags 66 are capable of being installed into the container 16. According to this embodiment of the invention, the above assembly is presented as a single unit and allows pre-inflated bags 66 to be inserted into the container 16. This is not possible with the other embodiments or with prior art assemblies.

In preparing the one-piece assembly made up of the dome 24, the valve housing 81, the multi-valve body 4 and the bag(s) 66, the bags 66 are prepared in such a way that the necks 170 of the bags 66 are injection molded in a die and the bodies 172 of the bags 66 are blow-molded. The plastic valve housing 81 is overmolded onto the metal dome 24. The compression spring 48 is then inserted onto the valve body 4, and the neck(s) 170 of the bag(s) 66 is (are) attached to the valve stems 68 of the multi-valve body 4. This process results in a combination of the dome 24, the valve housing 81, the multi-valve body 4, and the bag(s) 66. The bags 66 may be pre-inflated and the valve assembly may be inserted into the container 16 and the dome 24 may be sealed to the bead of the container 16 by rolling.

Omnidirectional Valve

Figure 34:
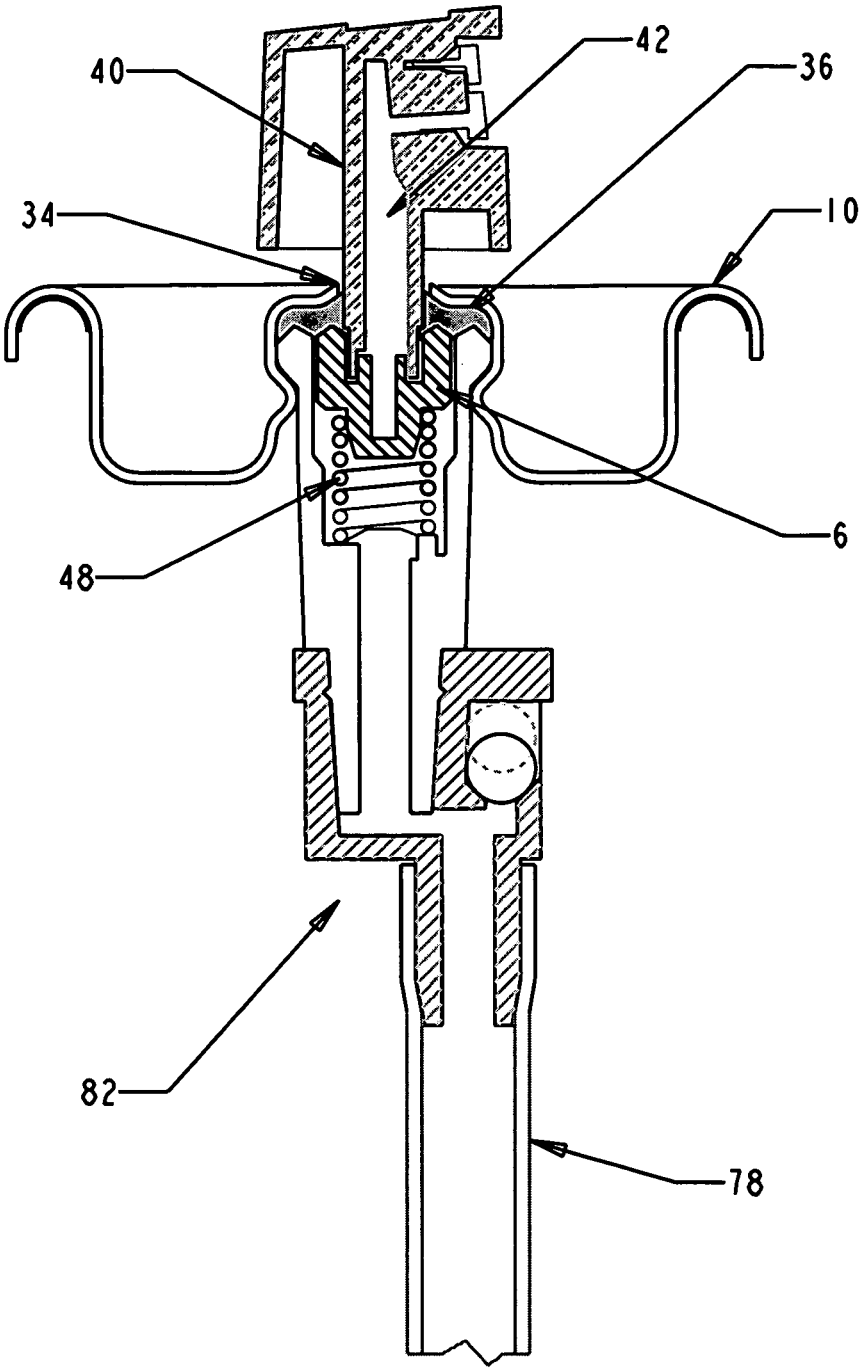
FIG. 34 is a side cross-sectional view of the omnidirectional valve of the present invention attached to the multi-valve and to a dip tube.
Figure 35:
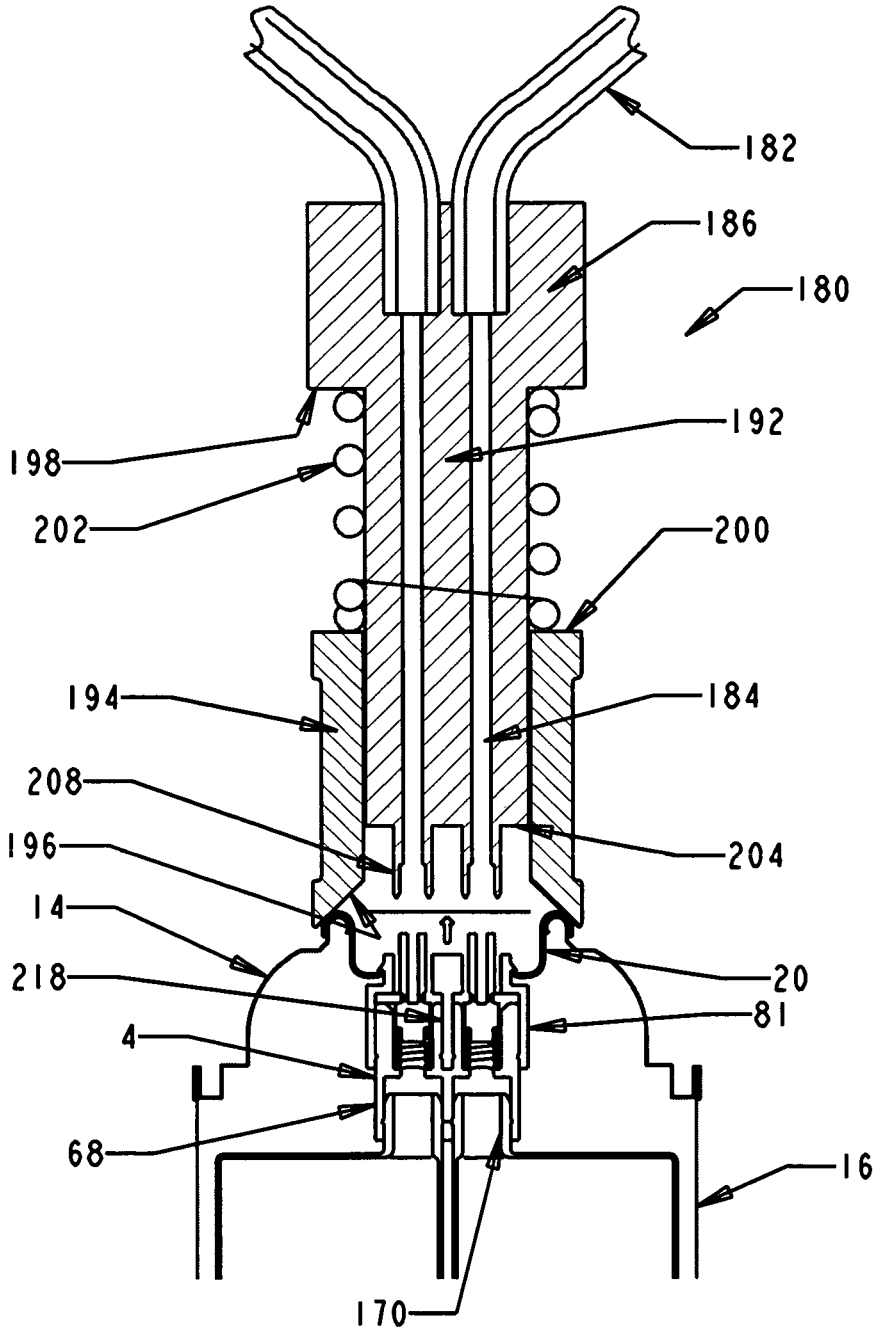
FIG. 35 is a longitudinal cross-sectional front view of the head of the filling machine of the present invention in combination with a container having two male valves wherein the filling head is separated from the valves.
Figure 36:
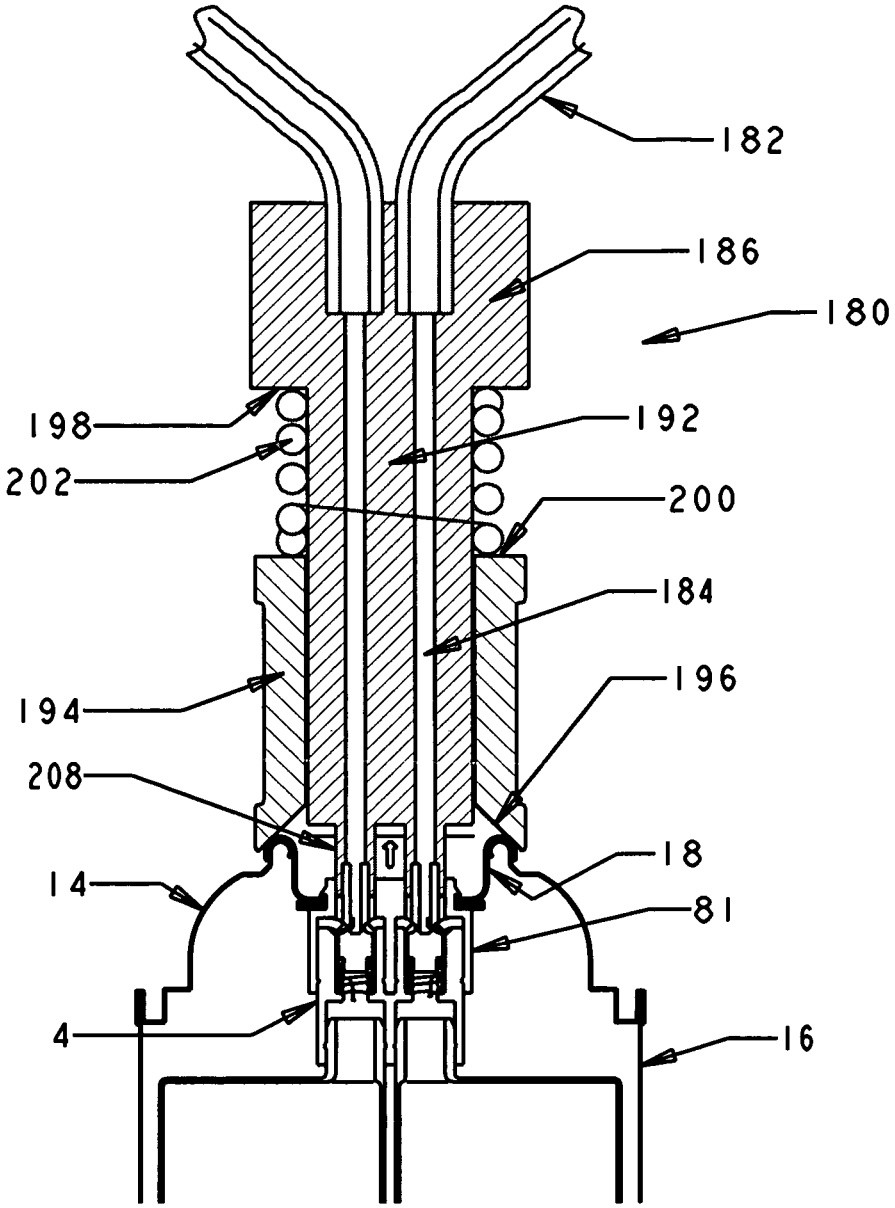
FIG. 36 is a longitudinal cross-sectional front view of the head of the filling machine of the present invention in combination with a container having two male valves wherein the filling head is in contact with the valves.
Figure 37:
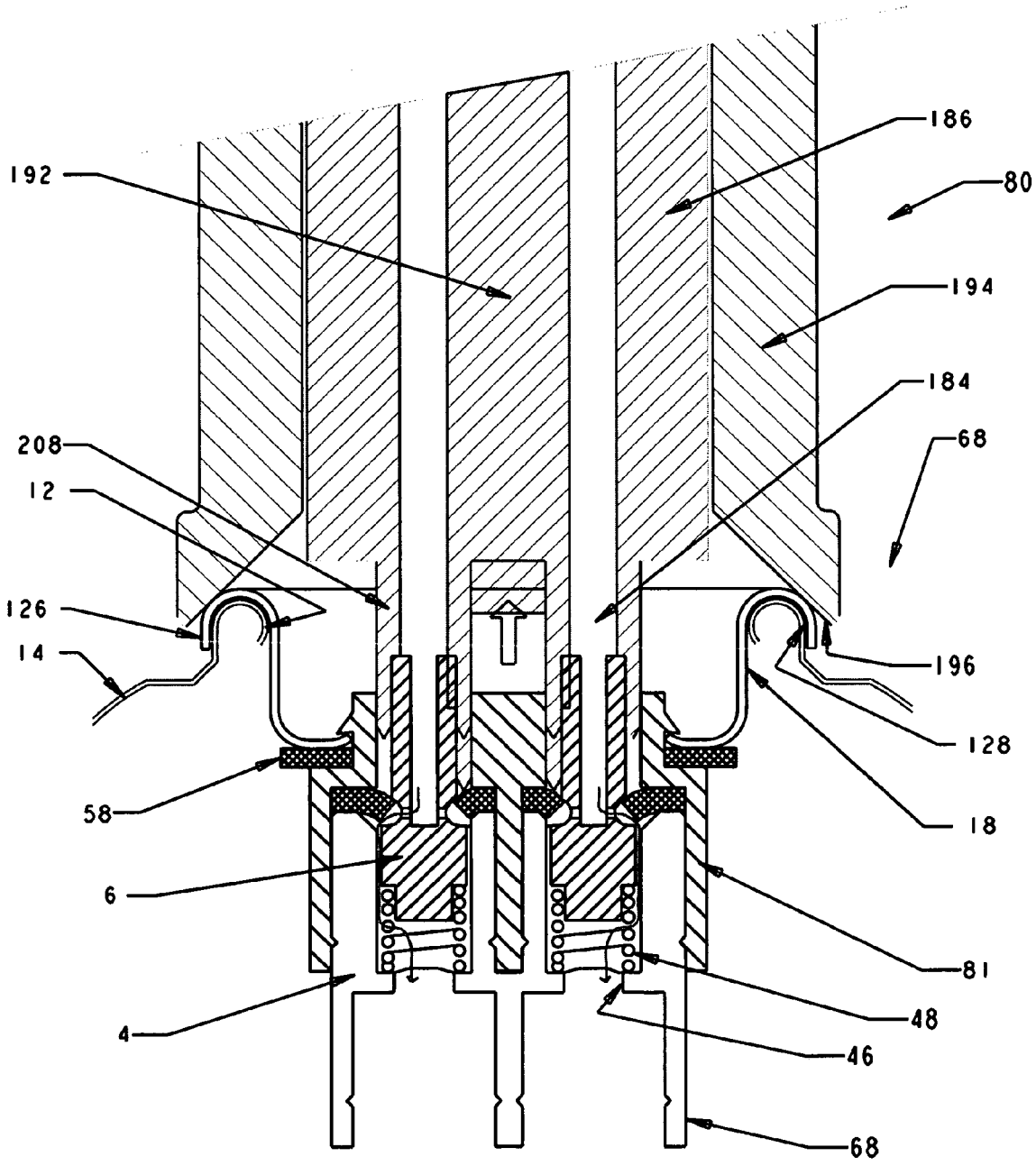
FIG. 37 is an enlarged detailed longitudinal cross-sectional front view of the head of the filling machine of the present invention in combination with a container having two male valves wherein the filling head is in contact with the valves.
Figure 38:
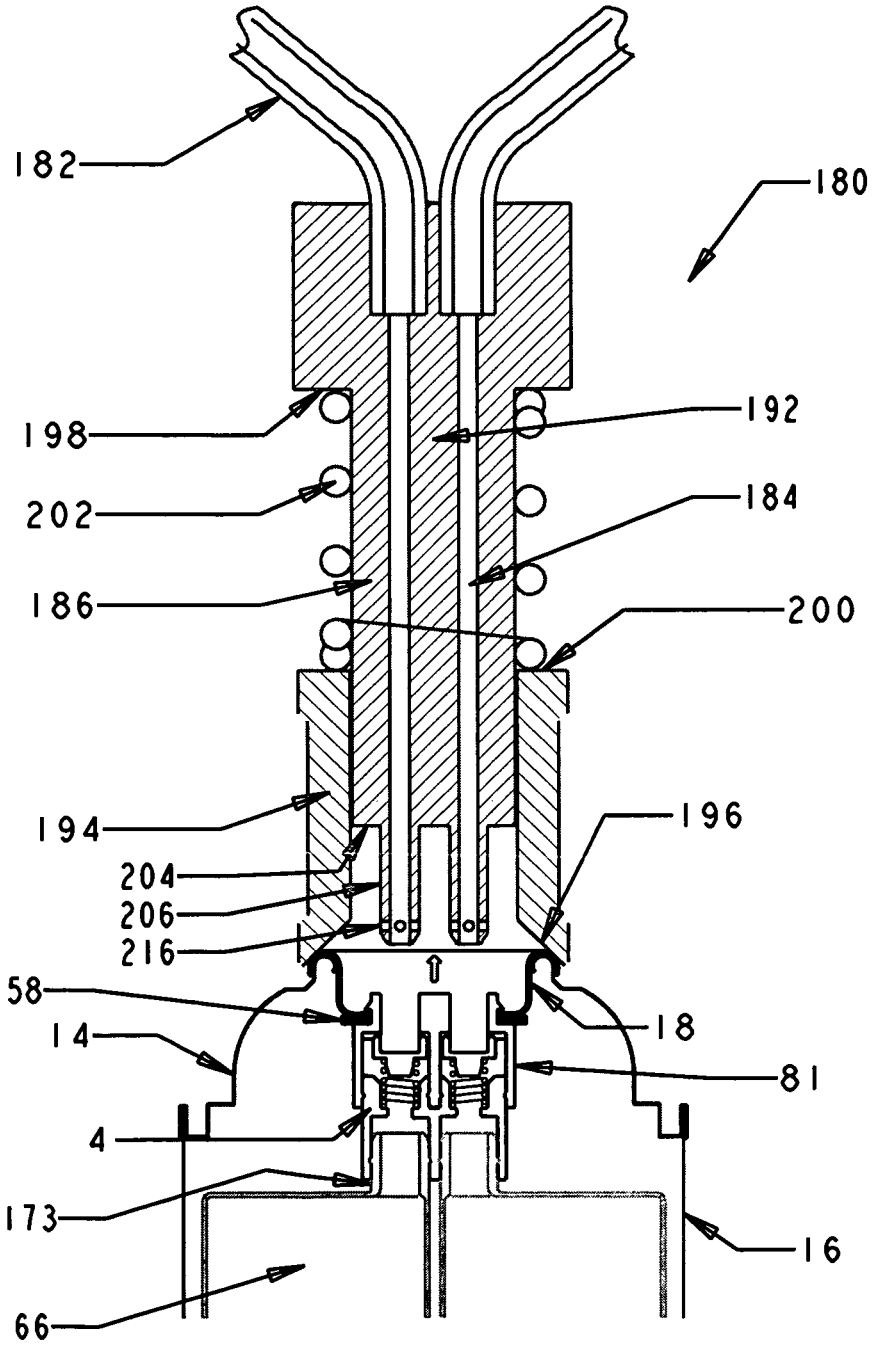
FIG. 38 is a longitudinal cross-sectional front view of the head of the filling machine of the present invention in combination with a container having two female valves wherein the filling head is separated from the valve.
Figure 39:
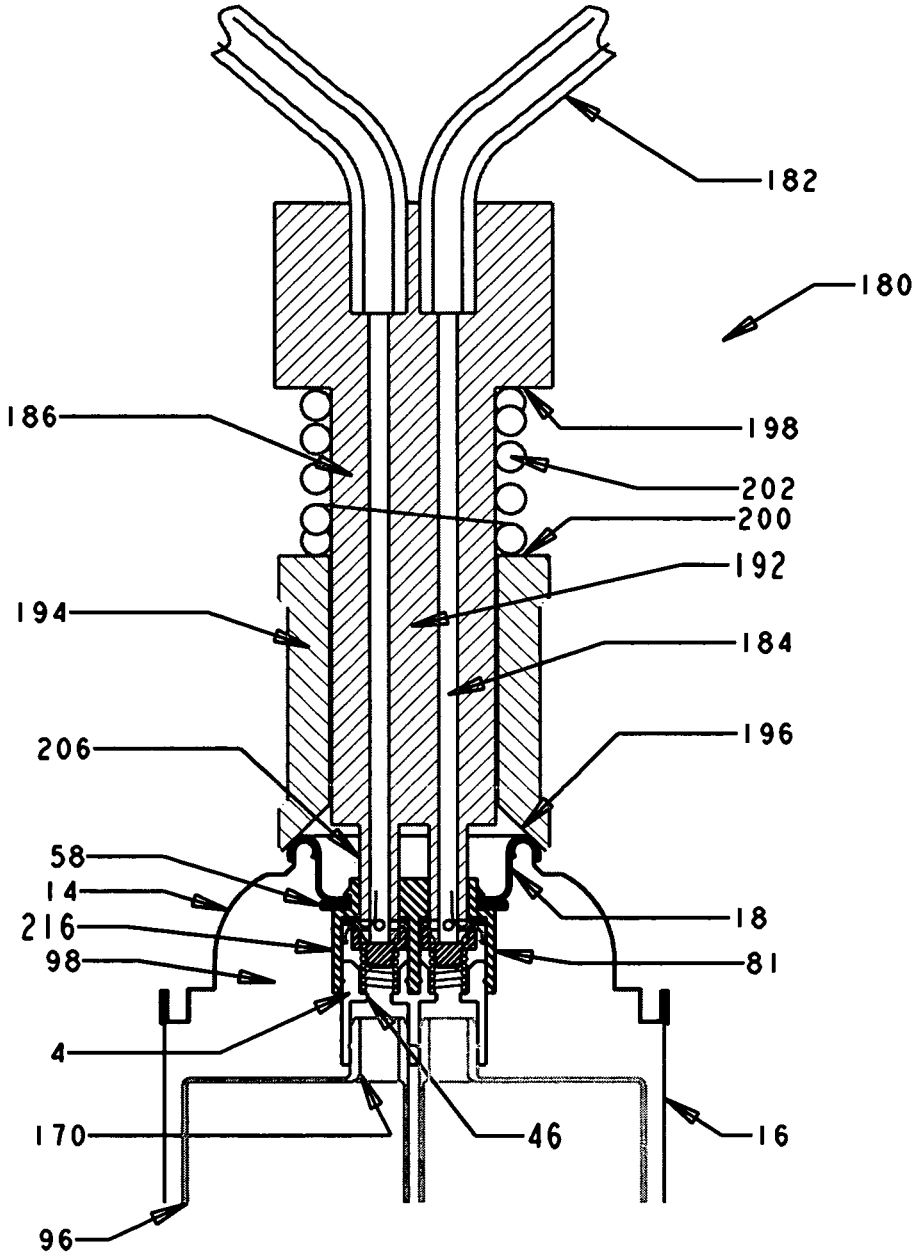
FIG. 39 is a longitudinal cross-sectional front view of the head of the filling machine of the present invention in combination with a container having two female valves wherein the filling head is in contact with the valves.
Figure 40:
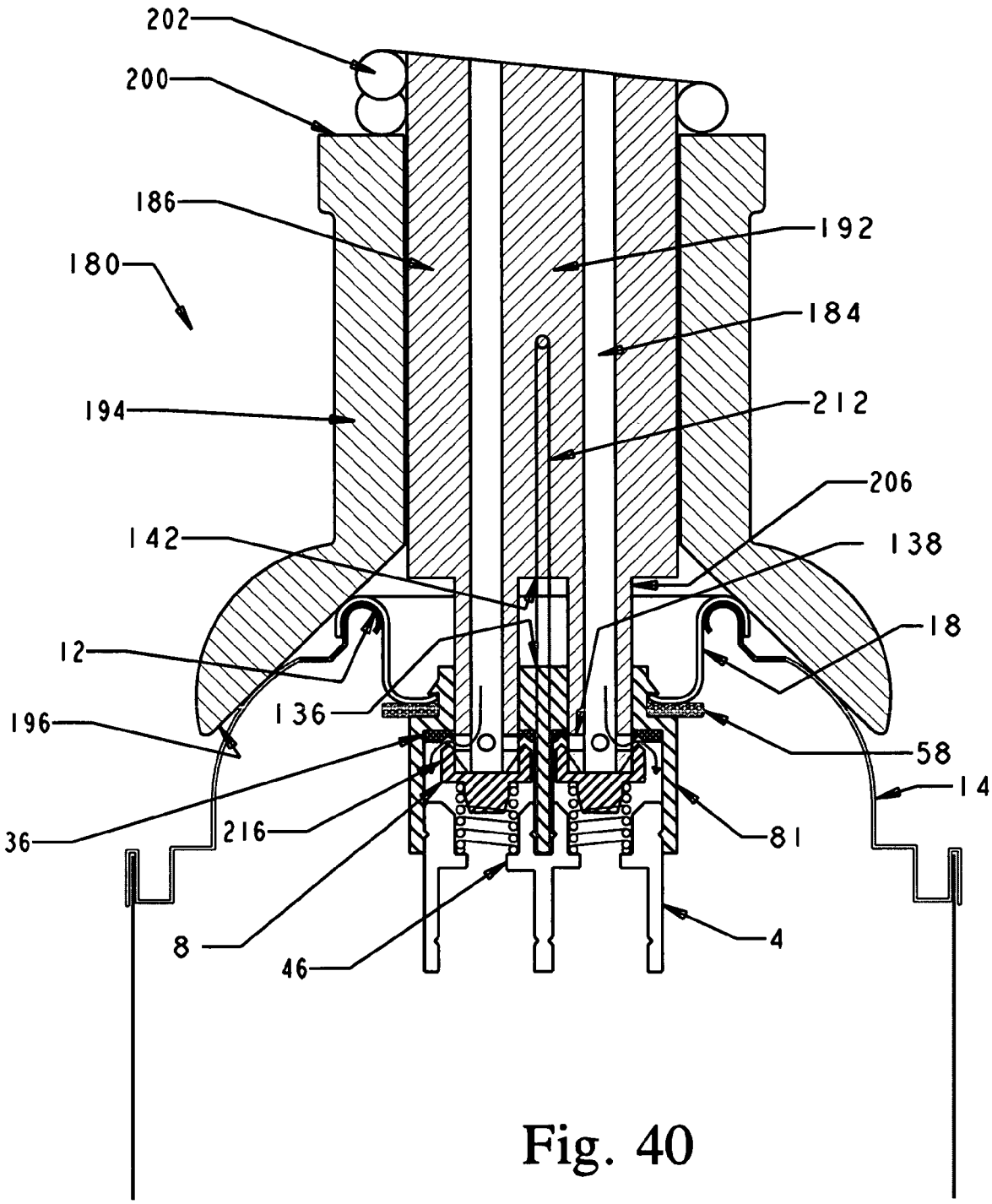
FIG. 40 is an enlarged detailed longitudinal cross-sectional front view of the head of the filling machine of the present invention in combination with a container having two female valves wherein the filling head is in contact with the valves.

It has been determined that in the spraying of paint, adhesives, and undercoatings from pressurized aerosol containers, the use of a male valve is inappropriate as male valves demonstrate a tendency to clog or plug, thereby rendering the aerosol container inoperative. The use of female valves for polymers has been limited to containers which are held upright. Such valves are less than ideal for the task of connecting plastic pipe, for instance, as this task requires the aerosol container to be usable in the inverted position in tight quarters. In the inventor's earlier application Ser. No. 10/168,121, now U.S. Pat. No. 6,736,288, incorporated herein by reference there is disclosed an omnidirectional check valve 82 as is shown in FIG. 34 of the present disclosure suitable for spraying viscous materials.

Filling Machine

The filling machine 180 of this invention will now be described with reference to FIGS. 35-42.

The containers 16 to be filled are placed on conventional assembly lines and are transferred to and away from the filling machine 180 of this invention in ways which are conventional in the art.

The filling machines 180 are joined to flexible conduits 182 which carry the materials to be dispensed and mixed from storage compartments (not shown) to conduits 184 within the filling head 186. The conduits 184 pass through either male 188 or female 190 lower filling stems. The conduits 184 within the filling heads 186 are thus separated by a center section 192. The filling heads 186 pass through collars 194. The collars 194 contain slanted lower edges 196 which contact the top edge 136 of a mounting cup 10, 18, 20. As an alternative, the slanted lower edges 196 may be so sized and shaped as to contact a dome 14, 22, 24. The purpose of the slanted edges 196 of the collars 194 is to apply a downward holding pressure to the container 16. The filling heads 186 have an overhang 198 above the upper edge 200 of the collar 194. Between the overhang 198 of the filling head 186 and the collar 194, there is a spring 202 which biases the collar 194 downwardly so as to put holding pressure on the containers 16.

The lower end 204 of the filling head 186 carries either a male 206 or female 208 filling stem for connecting with the top surface 118 of the female 8 or male 6 plunger, respectively.

There is preferably an additional flexible conduit 210 entering the filling head 186. This flexible conduit 210 carries the pressurizing fluid. Upon entering the filling head 186 the flexible conduit 210 connects with a conduit 212 which passes downwardly through the center section 192 and opens at or near the lower end 202 of the center section 192. This conduit 212 will abut with a valved inlet opening 214 in the mounting cup 10, 18, 20. Thus, the pressurizing fluid can pass into the container 16, but not in the reverse direction.

The drawings depict filling heads 186 to be used for containers 16 having two valves 62, 64. It is to be understood that filling heads 186 coming within the scope of this invention may be used to fill containers 16 having any reasonable number of valves.

Filling the Containers

The slanted lower edge 196 of the collar 194 of the filling head 186 is brought in contact with the top edge 136 of the mounting cup 10, 18, 20 or dome 14, 22, 24 such that the outlet openings 216 of the conduits 184 within the lower filling stems 206, 208 of the filling head 186 are aligned with the appropriate valved inlet openings 214 in the mounting cup 10, 18, 20 and the conduit 212 for the pressurizing fluid is above the pressurizing conduit 218 of the container 16. The filling head 186 is brought downwardly so that the openings 216 of the lower filling stems 206, 208 of the filling head 186 connect in an air-tight manner with the inlet openings 214 of the valves 62, 64 of the container 16 and the conduit 212 for the pressurizing fluid is in contact with the pressurizing conduit 218 of the container 16.

Preferably, the containers 16 are pre-pressurized before coming to the filling head 186. Alternatively, the containers 16 are pressurized with the pressurizing fluid coming from the conduit 212 for the pressurizing fluid and entering the container 16 through the pressurizing conduit 218 of the container 16. Less preferably, the containers 16 may be pressurized in more conventional ways.

The air used for pre-expanding the bags 66 is then evacuated from the bags 66 by pressure of the female 208 or male 206 filling stems of the filling head 186 on the container's 16 male 6 or female 8 plungers, respectively. This tends to lower the pressure of the pressurizing fluid in the container 16 so that when the bags 66 are filled with materials to be dispensed, the pressure of the pressurizing fluid will be greater. Pressurized fluid from the pre-pressurized bags 66 is bled out of the system via vents 220 in the collar 194. Metered amounts of the materials to be dispensed are then introduced into the bags 66 (or bag 66 and open space) of the container 16 through the conduits 184 in the filling stems 206, 208 which are pressing down on the plungers 6, 8 and pressurized materials to be dispensed are forced into the bags 66. The filling head 186 is then lifted, closing the valve 88.

Static Mixing Device

This invention contemplates the use of static mixing devices. The novel static mixing devices 28 of the present invention will be described with reference to FIGS. 44-54. The static mixing devices 28 are fitted to the plungers 6, 8 of the containers 16 of this invention to enable mixing of the viscous ingredients at the time of dispensing. The static mixing device 28 is attached to the bead 128 of the conventional dome 14. Alternatively, the static mixing device is so sized as to align with the bead 168 at the top of the container 16. The design of the static mixing device 28 of the present invention is such as to provide adequate mixing of the ingredients to comply with industry standards. A sealing cap 30 is provided to replace the static mixing device 28 after use.

The directions referred to in the description assume that the container 16 is standing upright. The static mixing device 28 of this invention is round in plan view and is slightly curved for visual attractiveness on longitudinal cross-section. The static mixing device 28 contains a first static mixing component 224, an optional second static mixing component 224, and a dispensing component 226. Depending on the user's needs, there may be no static mixing component, just one static mixing component 224, two static mixing components 224 where the output of the first (bottom) component 224 is the input of the second (top) component 224, or additional mixing components 224.

The static mixing component 224 contains a flexible lower outer edge 228 which is the same size as the skirt 126 of the mounting cup 10 which is crimped to the bead 128 of the dome 14. This outer edge 228 may be attached to the mounting cup 10 by a friction snap fit. There is a stabilizer 229 protruding from the lower edge 231 of the mixing component 224. When the actuator 79 is depressed, the stabilizer presses against the top of the dome 22 or cup 10 to provide for equal pressure on the individual valves 6, 8 so that fluid flow from each of the outlet valves is proper.

Each static mixing component 224 contains at least two conduits 230 which abut with the plungers 6, 8 of the containers 16. Materials entering the conduits 230 are forced into horizontal conduits 232. Materials in these horizontal conduits 232 progress forwardly and inwardly to meet at a common inlet opening 234. From the common inlet opening 234, the materials to be mixed proceed around an oval conduit 236 to a first outlet 238 which is partially occluded by a column 240. The first outlet 238 leads into a circular conduit 242 in which the materials proceed from the front 244 to the rear 246 on each side, passing around multiple columns 240 during this passage. The passage around the columns 240 aids in the mixing process. At the rear 246 of the circular conduit 242, the materials enter a single central conduit 248 containing additional columns 240. The materials, now thoroughly mixed, are forced forwardly to a central outlet opening 250.

Each static mixing component 224 contains three vertical openings 252 substantially equally spaced from the center of the mixing component 224.

Where a second static mixing component 224 is desired, a second static mixing component 224 may be placed on top of the first static mixing component 224 in the same way that the first static mixing component 224 is placed on top of the mounting cup 10. The central outlet opening 250 of the first mixing component 224 leads to the common inlet opening 234 of the second static mixing component 224. From the common inlet opening 234, the mixed materials proceed in the same manner as in the first mixing component 224, exiting through the central outlet opening 250.

The dispensing component 226 contains a flexible lower outer edge 256 which is the same size as the outer edge 228 of the static mixing component 224. This outer edge 256 may be attached to the static mixing component 224 by a friction snap fit.

The central outlet opening 250 of a static mixing component 224 abuts with a central inlet opening 258 of the dispensing component 226. The central inlet opening 258 opens into a vertical conduit 260 which proceeds vertically upwardly to join with a horizontal outlet conduit 262. The mixed materials exit the dispensing component 226 through the outlet orifice 264. Conventional additions (not shown), such as tubes, may be attached to the outlet orifice 264 to perform specialized functions. Each dispensing component 226 has three hollow vertical pegs 266 substantially equally spaced from the center of the dispensing component 226. These pegs 266 fit into and through the corresponding openings 252 of the static mixing components 224. Force is applied to the pegs 266, causing a mushroom effect which secures the dispensing component 226 to the mixing component 224. Pressure applied to the top of the dispensing component 226 will be transmitted downwardly to the mixing component 224 and to the valve plungers 6, 8 to initiate dispensing of the contents of the container 16. Release of the pressure will stop the dispensing of the contents.

Although the invention has been described and illustrated in detail, it is to be clearly understood that the same is by way of illustration and example, and is not to be taken by way of limitation. The spirit and scope of the present invention are to be limited only by the terms of the appended claims.

The invention claimed is:

1. A filling machine comprising a filling head having multiple lower filling stems having vertical axes which are laterally spaced apart, which filling head and stems contain conduits for carrying materials to be dispensed, wherein the filling machine is configured for filling and pressurizing aerosol containers having multiple valves, which valves have laterally spaced-apart vertical axes.

2. The filling machine of claim 1, wherein the filling head has an overhang, the filling head is surrounded by a collar located beneath the overhang, and there is a spring located between the overhang and the collar to bias the collar downwardly so that the collar will abut with the container and hold the container stationary.

3. The filling machine of claim 1 wherein there is a conduit for carrying pressurizing fluid located in the filling head.

4. A method of filling an aerosol container containing multiple valves with vertical outlet openings having laterally spaced-apart axes and at least one bag for material to be dispensed, comprising providing a filling machine comprising a filling head having multiple lower filling stems having vertical axes which are laterally spaced apart, which filling head and stems contain conduits having lower outlet openings for carrying materials to be dispensed, which conduits will about with plungers of the valves of the container, aligning the stems of the filling head above the appropriate valves, bringing the filling head downwardly so that the openings of the filling stems of the filling head connect the outlet openings of the plungers of the valves of the container, and passing the materials to be dispensed from the filling machine to the aerosol container.

5. The method of claim 4, wherein the filling head an overhang, the filling head is surrounded by a collar located beneath the overhang, and there is a spring located between the overhang and the collar, bringing the collar of the filling head into contact with the container, and applying downward pressure on the container to hold the container in place.

6. The method of claim 4, wherein the filling head of the filling machine further comprises a conduit for pressurizing fluid, the container contains multiple pre-expanded bags for the material to be dispensed, and the filling stems of the filling head depress plungers of the valves of the container to expel the air from the pre-expanded bags, the container is pressurized with pressurizing fluid entering the container through the pressurizing conduit of the filling head, and the bags are charged with material to be dispensed.

* * * * *